US008202411B2

(12) United States Patent
Buschmann

(10) Patent No.: US 8,202,411 B2
(45) Date of Patent: Jun. 19, 2012

(54) ELECTROWINNING APPARATUS AND PROCESS

(75) Inventor: Wayne E. Buschmann, Boulder, CO (US)

(73) Assignee: Eltron Research & Development, Inc., Boulder, CO (US)

( * ) Notice: Subject to any disclaimer, the term of this patent is extended or adjusted under 35 U.S.C. 154(b) by 1023 days.

(21) Appl. No.: 12/051,774

(22) Filed: Mar. 19, 2008

(65) Prior Publication Data

US 2011/0120879 A1 May 26, 2011

(51) Int. Cl.

| | |
|---|---|
| ***C25C 7/00*** | (2006.01) |
| ***C25C 7/02*** | (2006.01) |
| ***C25C 1/00*** | (2006.01) |
| ***C25C 1/02*** | (2006.01) |
| ***C25C 1/06*** | (2006.01) |
| ***C25C 1/08*** | (2006.01) |
| ***C25C 1/10*** | (2006.01) |
| ***C25C 1/12*** | (2006.01) |
| ***C25C 1/14*** | (2006.01) |
| ***C25C 1/16*** | (2006.01) |
| ***C25C 1/18*** | (2006.01) |
| ***C25C 1/20*** | (2006.01) |
| ***C25C 1/22*** | (2006.01) |

(52) U.S. Cl. ..... 205/348; 205/339; 205/560; 205/562; 205/563; 205/564; 205/566; 205/571; 205/572; 205/573; 205/575; 205/587; 205/594; 205/598; 205/603; 205/610; 204/225; 204/198; 204/252; 204/263

(58) Field of Classification Search ..... None
See application file for complete search history.

(56) References Cited

U.S. PATENT DOCUMENTS

| | | | |
|---|---|---|---|
| 3,219,318 | A | 8/1961 | Hershler |
| 3,848,363 | A | 11/1974 | Lovness et al. |
| 3,974,049 | A | 8/1976 | James et al. |
| 3,984,049 | A | 10/1976 | Shawen |
| 4,039,402 | A | 8/1977 | LeRoy |
| 4,073,702 | A | 2/1978 | Fleischmann et al. |
| 4,141,804 | A | 2/1979 | Avedesian et al. |
| 4,171,249 | A | 10/1979 | Newton et al. |
| 4,212,722 | A | 7/1980 | Avedesian et al. |

(Continued)

FOREIGN PATENT DOCUMENTS

EP 0323693 A2 7/1989

(Continued)

OTHER PUBLICATIONS

International Application No. PCT/US2009/037271 International Search Report dated Oct. 22, 2009.

*Primary Examiner* — Harry D Wilkins, III
(74) *Attorney, Agent, or Firm* — Conley Rose, P.C.

(57) ABSTRACT

Apparatus and processes are disclosed for electrowinning metal from a fluid stream. A representative apparatus comprises at least one spouted bed reactor wherein each said reactor includes an anolyte chamber comprising an anode and configured for containing an anolyte, a catholyte chamber comprising a current collector and configured for containing a particulate cathode bed and a flowing stream of an electrically conductive metal-containing fluid, and a membrane separating said anolyte chamber and said catholyte chamber, an inlet for an electrically conductive metal-containing fluid stream; and a particle bed churning device configured for spouting particle bed particles in the catholyte chamber independently of the flow of said metal-containing fluid stream. In operation, reduced heavy metals or their oxides are recovered from the cathode particles.

59 Claims, 29 Drawing Sheets

U.S. PATENT DOCUMENTS

| | | | |
|---|---|---|---|
| 4,240,886 | A | 12/1980 | Hodges et al. |
| 4,247,240 | A | 1/1981 | Schora, Jr. et al. |
| 4,255,403 | A | 3/1981 | Mayer et al. |
| 4,272,333 | A | 6/1981 | Scott et al. |
| 4,517,064 | A | 5/1985 | Cook |
| 4,615,792 | A | 10/1986 | Greenwood |
| 5,458,745 | A | 10/1995 | Hradil |
| 5,470,544 | A | 11/1995 | Galloway |
| 5,635,051 | A | 6/1997 | Salas-Morales et al. |
| 5,695,629 | A | 12/1997 | Nadkami et al. |
| 5,962,082 | A | 10/1999 | Hendrickson et al. |
| 6,298,996 | B1 | 10/2001 | Spiegel et al. |
| 6,432,292 | B1 | 8/2002 | Pinto et al. |
| 6,733,653 | B2 | 5/2004 | Jangbarwala |
| 6,936,142 | B2 | 8/2005 | Kradil et al. |
| 7,156,224 | B2 | 1/2007 | Forster et al. |
| 7,601,247 | B2 | 10/2009 | Robinson et al. |
| 2004/0194574 | A1 | 10/2004 | Cardarelli |
| 2006/0124452 | A1 | 6/2006 | Robinson et al. |
| 2006/0163082 | A1 | 7/2006 | Robinson et al. |
| 2007/0102302 | A1 | 5/2007 | Robinson et al. |
| 2008/0169196 | A1* | 7/2008 | James et al. ..... 204/554 |

FOREIGN PATENT DOCUMENTS

| | | | |
|---|---|---|---|
| WO | 02/053809 | A1 | 7/2002 |

* cited by examiner

ELECTROWINNING APPARATUS AND PROCESS

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. EP-D-04-022 awarded by the U.S. Environmental Protection Agency and Grant No. DE-FG02-05ER84320 awarded by the U.S. Department of Energy.

CROSS-REFERENCE TO RELATED APPLICATIONS

Not applicable.

BACKGROUND

1. Technical Field

The present invention generally relates to the field of electrowinning, also referred to as electrorefining or electroextraction, and more specifically to apparatus and processes for electrolytically removing metals from conductive liquids and facilitating recovery of such metals. Still more specifically, the invention relates to such apparatus and processes which provide for particulate cathode bed churning that is uncoupled to the flow of catholyte.

2. Description of Related Art

In an electrowinning process, a target metal ion is electrolytically removed from the solution phase of a conductive liquid and is deposited as a solid metal that can be recovered and potentially sold, either directly or after further purification. This approach to metal extraction is commonly used for the recovery and purification of several metals in the mining industry. Some of the metals that have been previously targeted for electrolytic recovery include copper, iron, lead and zinc. According to the U.S. Census Bureau's Economic Census, Mining Industry Series, in 2002 the electrowinning of copper from leaching operations accounted for more than 30% of copper ore mining production.

Some of the advantages of existing electrowinning methods include low operating costs, no chemical reagents required, solid product in low volume, high value form, reduced disposal issues and harmless byproducts (e.g., oxygen), potential for selectivity, and modular, scalable technology. These advantages are in many cases offset by common drawbacks such as medium to high capital cost, possible side reactions, and electrode fouling, corrosion, or other undesirable chemical reaction. Many existing systems suffer from awkward product removal, in some cases requiring equipment disassembly. Another common drawback of existing electrowinning technologies is low efficiency when processing dilute sources of metals. Most existing methods cannot be satisfactorily scaled up for processing large volumes of liquid and increased space velocities.

Conventional electrolytic technologies include standard plate and frame (2-dimensional) electro-deposition cells. These electrolytic systems are typically either planar or annular in design and operate at only moderate current densities, thus requiring large electrodes with correspondingly larger capital investments. Additionally, such cells generally suffer from large Ohmic losses due to significant interelectrode distances. Conventional plate and frame electrolytic technologies are not suitable for recovery of metals from dilute streams containing less than 1000 ppm metal.

Another type of technology in use today for electrowinning employs porous packed beds which provide large electrode areas (3-dimensional) and operate at higher current densities than typical 2-dimensional systems. Packed beds tend to become occluded by metal deposition, however, and are subject to shorting by interelectrode dendritic growth. Fluidized bed electrodes have also been extensively investigated. These electrolytic systems typically operate at much higher current densities than simple plate cells, and allow, to some extent, for electrode particle growth. Fluidized bed electrolytic systems still suffer from energy-intensive fluidization and dendrite growth leading to bed coagulation and process instability.

Spouted electrode technology (SET) comprises a modification of the fluidized bed technology, in which a jet or stream of electrolyte is introduced into the draft tube of an electrode forming a spout. The stream of electrolyte entrains and transports electrode particles in the particle bed up the draft tube, after which the particles are released onto the top of the particle bed and ultimately move to the bottom of the bed to be picked up again by the electrolyte stream. The electrode particles are in constant motion moving through the draft tube and into and through the particle bed during electrolysis. SET provides a number of improvements that overcome many of the limitations of previous systems, by providing a churning packed bed that resists dendrite growth, accommodates cathode particle growth, allows cathode bed removal/replacement without cell disassembly, and require less fluid transport energy than a fully fluidized bed. Although SET has been studied for many years, it has until recently been hampered by scale-up issues due to the typically annular design and unsuitability at metal concentrations below a few thousand parts per million.

U.S. Pat. No. 5,635,051 discloses a zinc electrowinning process using a mobile bed of particles. Motion of the bed is achieved by imposing a flow on the electrolyte solution in such a manner as to create a levitation region (a spout) in the cell distinct from, and preferably adjacent to, the moving packed bed. Favorable results in terms of production rate, current efficiency and energy consumption are said to be achieved by using a unique combination of design parameters and operating conditions achieved by selected ranges for particle size, current density, particle bed thickness and acid content of the electrolyte.

U.S. Pat. No. 6,298,996 discloses a spouted electrode and its use in electrowinning, in which cathode and anode chambers are separated by an inexpensive microporous membrane that prevents the cell from short-circuiting. The feed solution is jetted upwards into the cathode particle bed and fluidizes the central particles up through a spout tube. At the top of the cell the fluid velocity drops allowing the particles to fall back onto the bed. As with other conventional SET designs, the feed fluid and cathode bed particles are coupled in motion and flow path resulting in moderate removal rates and moderate control of selectivity. A prior art SET configuration, in which fluid and cathode bed flows are coupled, is shown in FIG. 1.

Most existing spouted electrode designs (both annular and planar) rely on the use of an electrolyte jet to churn the cathode bed. The linking or coupling of cathode spouting to electrolyte motion imposes certain inherent limitations on the technology. For instance, since a high flow rate is typically required to achieve spouting, operation parameter flexibility is limited. For heavy materials, such as plated metals, this can waste large amounts of energy to jet the electrolytic fluid fast enough to cause spouting. Also, most electrolyte passes through the spout and bypasses the bed so that excessive amounts of fluid transport occur and most fluid is simply recirculated without being treated. In many cases the result is low per pass removal rates, necessitating batch mode operation and increasing energy demands for pumping. Since most industrial metal recovery applications are more conducive to flow-through treatment, batch mode operation can be especially disadvantageous. The problem usually grows worse at lower metal concentrations where less bed motion is needed and higher electrolyte flow rates in the bed would improve efficiencies by reducing mass transport limitations. At metal concentrations of less than about 2000 ppm, the inherent problems of jetted SET are often glaringly apparent. Therefore, jetted SET is traditionally applied to only relatively concentrated solutions (e.g., 5000+ ppm), in which the above-mentioned limitations are less noticeable and higher operation current densities can be employed to offset the increased pumping demands.

Although there has been considerable advancement in the art of electrowinning, there is continuing interest in reducing process complexity, increasing separation efficiency and providing greater energy efficiency, in order to lower costs and boost productivity in such industries as metal mining, refining and recycling and for conserving natural resources and preventing pollution.

SUMMARY

In accordance with certain embodiments of the invention, a spouted bed reactor is provided which comprises a particle bed, an inlet for a flowing fluid stream; and a particle bed churning device configured for spouting particle bed particles in said reactor independently of the flow of the fluid stream. In certain embodiments the reactor is configured for electrowinning a heavy metal from a fluid stream, wherein the particle bed comprises electrically conductive cathode particles and the fluid stream comprises an electrically conductive solution comprising the heavy metal. In some embodiments, the electrowinning reactor comprises at least one electrolytic cell, with each cell comprising an anolyte chamber comprising an anode and configured for containing an anolyte, a catholyte chamber comprising a current collector and configured for containing a particulate cathode bed and a flowing stream of the heavy metal-containing fluid, and an ion-permeable membrane separating the anolyte and catholyte chambers.

In accordance with certain embodiments, the cathode particles are magnetic and the particle bed churning device comprises a magnetic conveyor assembly comprising a plurality of magnets attached to a conveyor belt or the particle bed churning device comprises an array of electromagnets. In accordance with certain other embodiments, the particle bed churning device comprises a conveyor belt or auger screw assembly.

Also provided in accordance with certain embodiments of the invention is an electrowinning system comprising at least one spouted bed reactor wherein each of the reactors comprises: an anolyte chamber comprising an anode and configured for containing an anolyte, a catholyte chamber comprising a current collector and configured for containing a particulate cathode bed and a flowing stream of an electrically conductive heavy metal-containing fluid, and an ion-permeable membrane separating the anolyte and catholyte chambers, an inlet for an electrically conductive metal-containing fluid stream; and a particle bed churning device configured for spouting particle bed particles in the catholyte chamber reactor independently of the flow of the fluid stream.

Further provided in accordance with certain embodiments of the invention is an electrowinning process comprising: (a) providing an electrowinning system as described above; (b) flowing an electrically conductive anolyte solution through the anolyte chamber; (c) flowing a catholyte solution through a cathode particle bed in the catholyte chamber, wherein the catholyte solution comprises an electrically conductive fluid containing at least one heavy metal salt dissolved therein; (d) establishing a predetermined voltage and current across the electrolytic cell sufficient to effect reduction of a selected heavy metal at the particle bed and cause an oxidation reaction at the anode; and (e) spouting the cathode particles, wherein such "spouting" is independent of the flow of the catholyte solution of step (c). Thus the particles are not required to be levitated and carried by the flow of the catholyte solution in order to redistribute or chum the particle bed. Thus, embodiments described herein comprise a combination of features and advantages intended to address various shortcomings associated with certain prior devices or methods. The various characteristics described above, as well as other features, will be readily apparent to those skilled in the art upon reading the following detailed description of the preferred embodiments, and by referring to the accompanying drawings.

DETAILED DESCRIPTION

Figure 1:
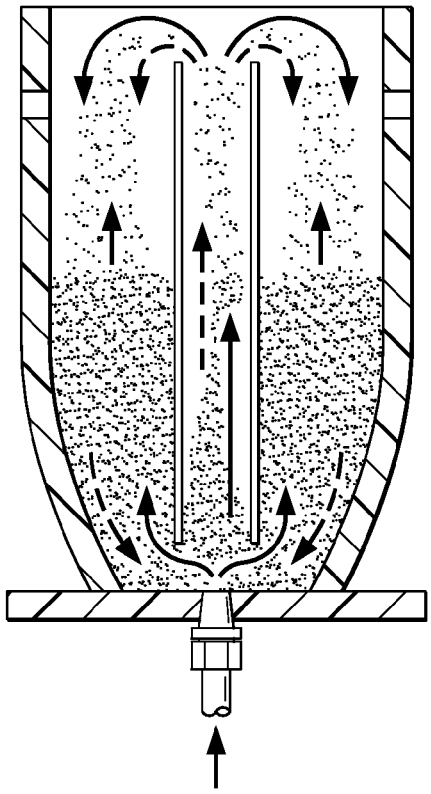
FIG. 1 (PRIOR ART)
FIG. 1 is a schematic illustration of a catholyte chamber employing a prior art spouted electrolytic technology (SET) cathode spouting configuration.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ".

"Spouting" refers to the facilitated movement or transport of particles from one region of a particulate bed of a reactor to another region of the particulate bed away from the first region, to redistribute or churn the particulate bed. Spouting of the particles deters sticking and clumping of particles as may occur during operation of the reactor. Spouting of a particle bed is preferably distinct from any process of removing spent particles and returning fresh particles to the bed.

The term "mechanically spouted" when referring to a particle bed, means that the particle bed is spouted by any mechanical means including, but not limited to, a conveyor belt, auger screw, or magnetic spouting mechanism. The mechanism may include transporting particles through a spout, channel, or tube from a first point (e.g., the spout inlet) to a second point (e.g., the spout outlet).

The term "magnetically spouted," when referring to a particle bed, means magnetically churned or redistributed by being magnetically attracted to a magnet and moved through a spout or channel from a first point (e.g., the spout inlet) to a second point (e.g., the spout outlet), and released by ceasing the magnetic attraction. Magnetic spouting may be accomplished by attracting particles to a series of permanent magnets and then moving the magnets with attached particles, or it may be accomplished by attracting the particles to electromagnets and moving the particles to successive electromagnets by coordinated energizing and de-energizing of neighboring electromagnets, for example.

The term "magnetic bead" or "magnetic particle" refers to a bead or particle that is magnetically attracted to a magnet.

The term "heavy metal" as used in the context of this disclosure refers to metals with densities greater than 4 g/cm$^3$. Heavy metals include, but are not limited to, chromium, manganese, iron, cobalt, nickel, copper zinc, gallium, germanium, arsenic, molybdenum, ruthenium, rhodium, palladium, silver, cadmium, indium, tin, antimony, tungsten, rhenium, osmium, iridium, platinum, gold, mercury, thallium, lead, and bismuth.

The term "couple" or "couples" is intended to mean either an indirect or direct electrical, magnetic or other mechanical connection. Thus, if a first device couples to a second device, that connection may be through a direct electrical, magnetic or other mechanical connection, or through an indirect electrical, magnetic or other mechanical connection via other devices and connections.

Apparatus and methods for mechanically, magnetically or electromagnetically spouting particle beds are described herein in the context of electrowinning of metals from fluids. Embodiments of the apparatus define inlets and outlets for the fluid feed stream which are distinct from the inlets and outlets for the spouted bed particles. Embodiments of the electrowinning methods provide spouted bed particle flow that is not dependent on the flow of the feed stream. Thus it is not a requirement for the flowing feed stream to levitate or hydraulically spout the cathode bed particles. This allows the velocity and residence time of the fluid feed stream on (or thorough) the particle bed to be controlled independently of the rate of spouting (or transport) of bed particles. Optimization of the velocity and residence time of a dilute metal-containing solution enhances recovery of the metal in many instances and improves the efficiency of an electrowinning process.

Electrolytic Cell for Magnetically Recirculating a Particulate Cathode Bed

Figure 2A:
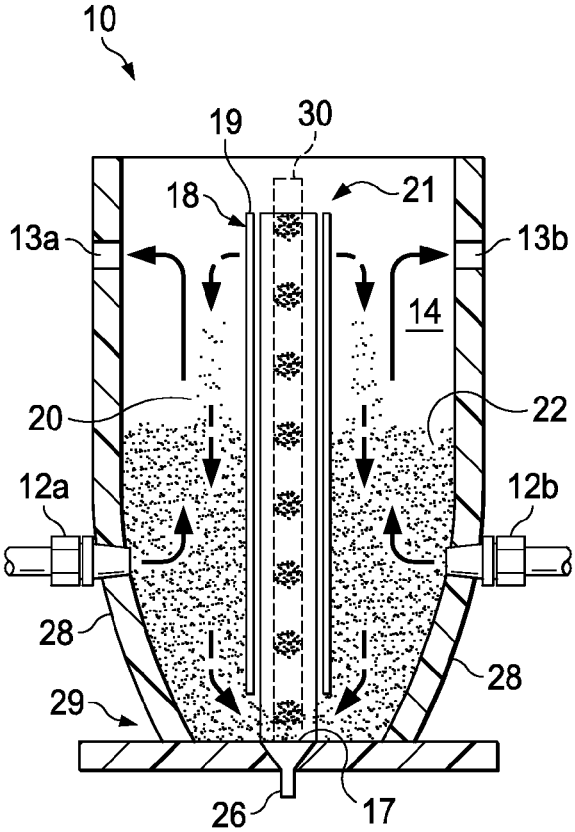
FIGS. 2A-B schematically illustrate a catholyte chamber employing a magnetically spouted electrolytic technology (MSET), in accordance with an embodiment of the invention. A: front elevation. B: side view showing the associated magnetic conveyor assembly.
Figure 2B:
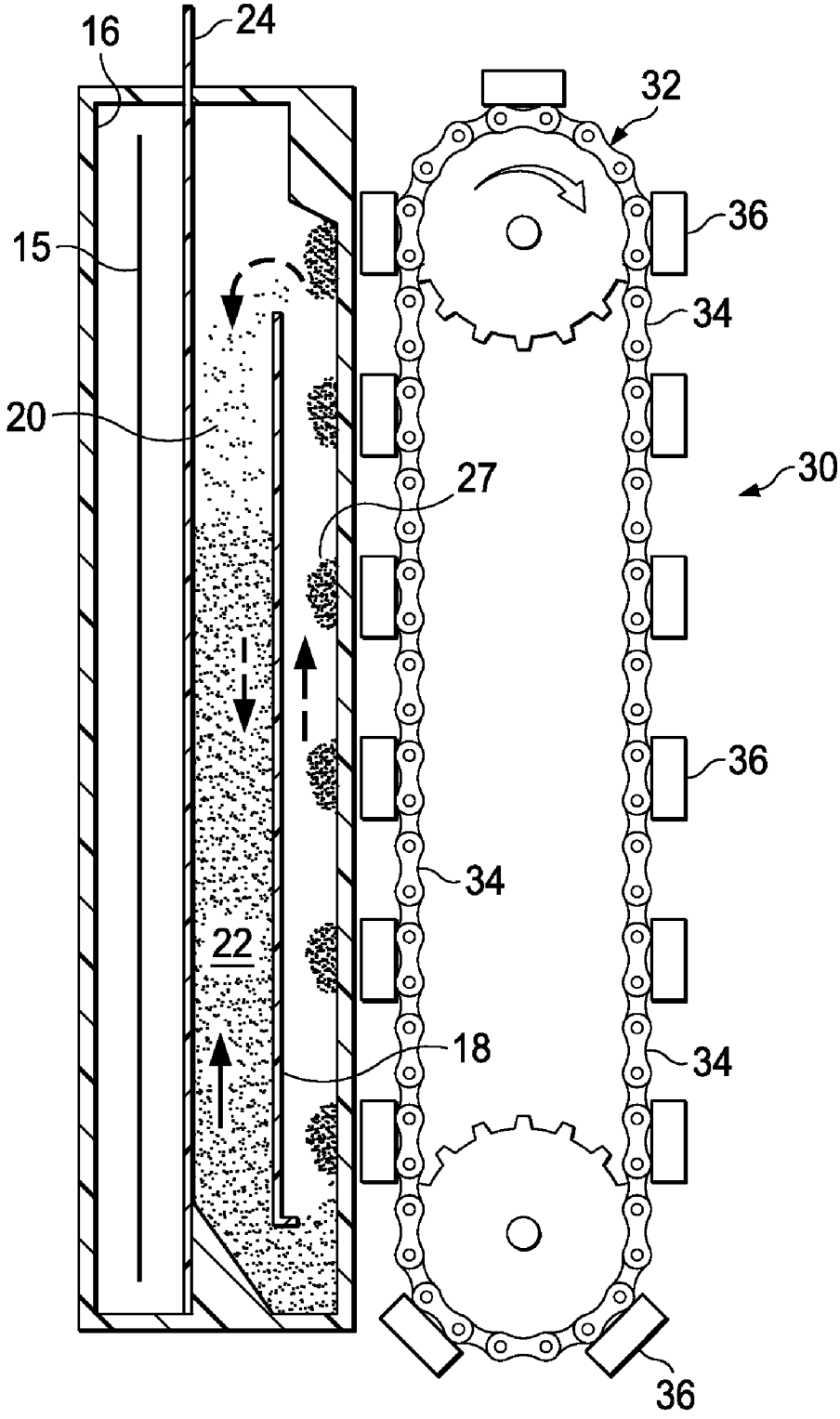
Figure 3:
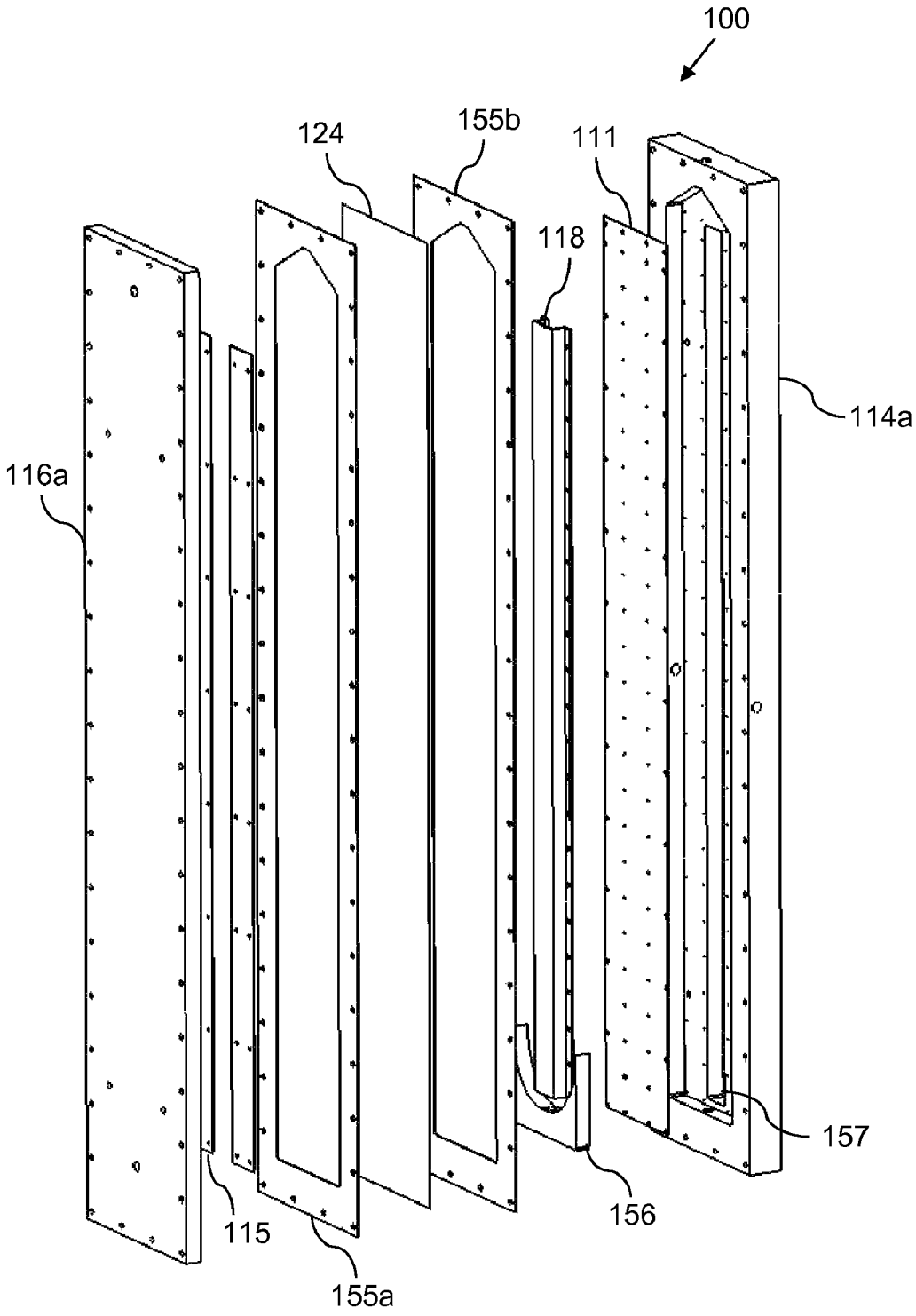
FIG. 3 is an exploded view of an embodiment of a MSET electrolytic cell.

Referring to FIGS. 2A-B, a magnetically redistributed or churned ("magnetically spouted") electrochemical technology (MSET) cell 10 is shown which includes a cathode chamber 14 (also referred to as "catholyte chamber"), anode chamber 16 (also called "anolyte chamber"), spout tube 18, magnetic conveyor assembly 30 and membrane separator 24 between the cathode and anode chambers. Inside anode chamber 16 is anode 15. Cathode chamber 14 has one or more catholyte inlet, such as inlets 12*a*, 12*b*, and one or more catholyte outlet, such as outlet 13*a*, 13*b*, and a spout tube 18. When the spout tube is symmetrically positioned in the middle of the particle bed (as illustrated in FIG. 2A), the catholyte inlets 12*a*, 12*b* are preferably positioned part way up the particle bed so as to balance the back pressure and/or flow distribution that the catholyte fluid encounters in the cathode chamber during use. Alternatively, the catholyte inlets may be located at the bottom of the cell or elsewhere along the wall 28. Cathode chamber 14 also has a cathode current collector 11 (not shown) which is similar in appearance to current collector 111 shown in an exploded view of MSET cell 100 (FIG. 3). When the MSET cell is in use, the cathode chamber 14 also contains a quantity of electrically conductive, magnetic cathode beads or particles 20, and in some instances wall 28 is tapered or sloped toward end 29 of cell 10 to facilitate movement of cathode beads 20 into spout tube 18 through a first (or bottom) opening 17 (FIGS. 2A-B) near end 29 and out the spout tube exit 21. The cathode bed 22 may extend to the top of the spout tube 18 when the cathode chamber 16 is filled with cathode particles. The cathode current collector 11 is configured to contact the particle bed, or a portion thereof, when cathode particles are present in the cell. FIG. 3 is an exploded view of MSET cell 100 which includes (from left to right) an anode chamber body 116*a*, anode plates 115, first gasket 155*a*, membrane separator 124, second gasket 155*b*, channel (spout tube) 118, reticulated bead-guide 156, cathode current collector plate 111, and cathode chamber body 114*a*. The cathode and anode chamber bodies may be constructed of a durable, non-conductive material such as polypropylene, polyvinyl chloride, CPVC, polyacrylate, HDPE, PTFE, PVDF, polycarbonate, ABS polymers, or any combination of any of those.

The anode 115 may be configured as two parts divided by a mechanical support, as shown, or as a single structure in the absence of a mechanical support. Microporous membrane separator 124 separates the anode and cathode chambers. The ion-permeable separator membrane may be any suitable microporous polymer or clay filled polymer or a cation exchange membrane, for example.

Figure 7:
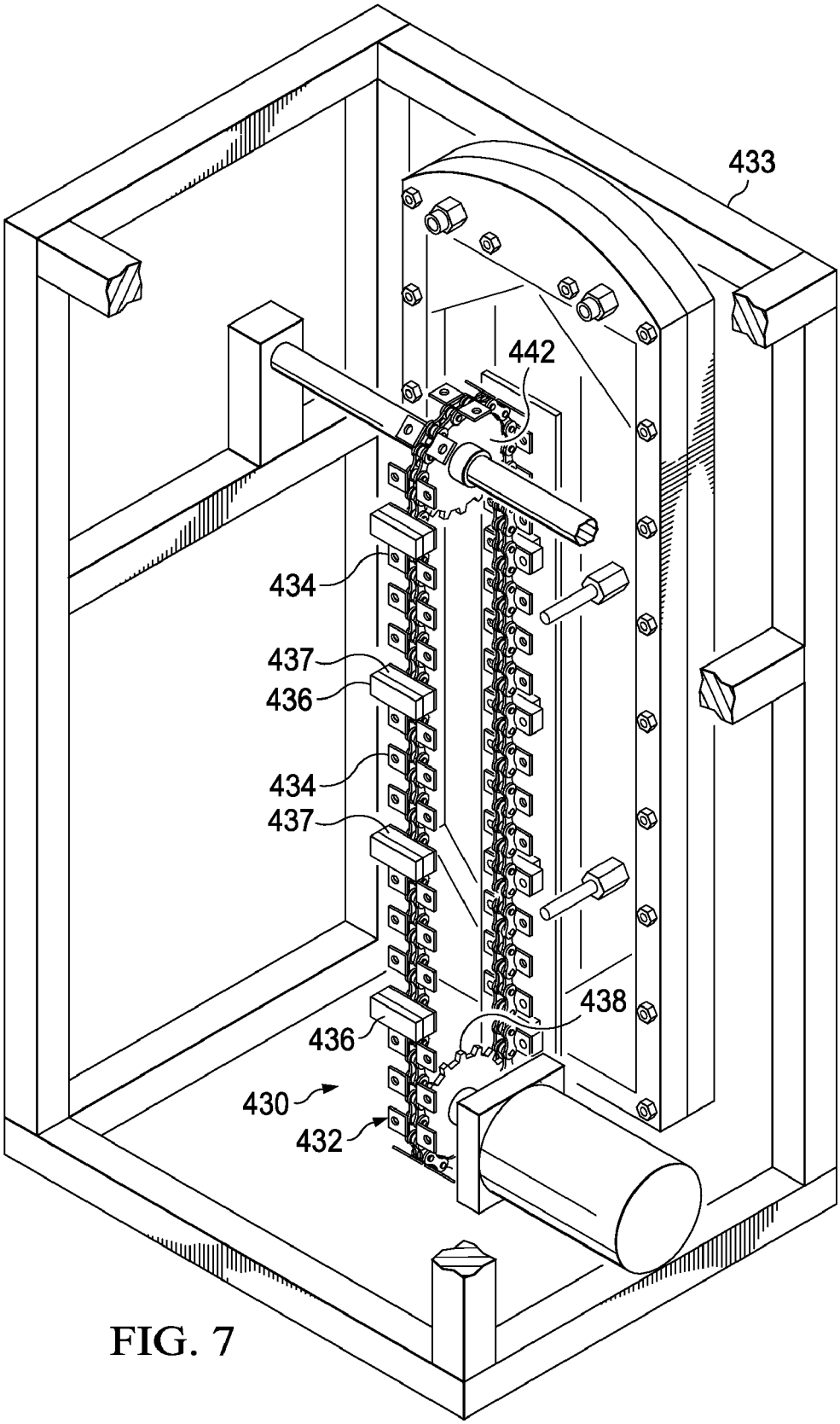
FIG. 7 is a photograph depicting a magnetic conveyor assembly chassis adapted for attachment to the assembled electrolytic cell of FIG. 6A-C.

The cathode current collector plate 111, which may be made of stainless steel or another suitable corrosion-resistant material (e.g., titanium, zirconium, graphite, Hastalloy, Inconel), may also serve as the cathode conveying surface for magnetic coupling to the magnetic conveyor drive (like that shown in FIG. 2B or FIG. 7). Cathode chamber body 114*a* may have a recessed area or window 157 for receiving a magnetic drive like that shown in FIG. 2B or FIG. 7. The cathode chamber may have a cathode bead drain port similar to that shown in FIGS. 2A-B, wherein a cathode bead drain port 26 may be included in the cathode chamber 14. The top of the anode and cathode chambers 14, 16 is at least partially open to allow access to the electrode compartments (e.g., for adding cathode particles to the cathode chamber), and/or to allow any gases formed at the electrodes to escape. A removable cover may be included if desired. In use, the cathode chamber 14 also contains a catholyte fluid. The operation of cell 10 is explained in the section subtitled "Process."

In a marked departure from other spouted electrolytic cells that rely on high velocity fluid flow to spout the cathode beads by levitating the beads, and to thereby churn the cathode bed, a representative MSET cell 10 instead employs a mechanical magnetic conveyer assembly 30 for bed churning. The magnetic conveyer assembly 30 is located adjacent to the cathode chamber 14. As explained in more detail in the section subtitled "Process," the MSET cell provides that the bed churning operation is uncoupled from the transport of electrolyte and will allow for optimal (lower) fluid flow velocities to be used, and also allows for greatly reduced fluid pumping costs, among other advantages.

Magnetic conveyer assembly 30 is shown in FIG. 2B, which is a side view of the cell shown in FIG. 2A. Magnetic conveyer assembly 30 comprises a drive chain belt 32, such as a ANSI 40 single pitch roller chain (McMaster-Carr), with mounting tabs 34 to which a plurality of magnets 36 are mounted at intervals along the chainlink belt 32. One type of suitable permanent magnet is neodymium iron boride grade N40, 0.375"×0.750"×0.125" (Amazing Magnets). Other types of suitable magnets are rare earth magnets with or without a protective cladding (metal or plastic). Groups or clusters of magnetically attracted beads 27 are shown in FIG. 2B.

The magnets may be used singly or stacked, as necessary, to obtain the desired magnet power. The magnets 36, or stacks of magnets, are spaced apart from each other a sufficient distance along the length of belt 32 to avoid detrimental competition between neighboring magnets for attracting cathode beads. When the system is in use, interference between closely-spaced magnets will tend to pull cathode beads in the reverse direction by the next oncoming magnet, causing fewer beads to exit the top of the spout. For example, three stacked magnets spaced at least 5 inches apart on the belt is optimal in an exemplary 36 in.×12 in.×3 in. system, as illustrated in FIGS. 4A-B and FIGS. 6A-C.

Figure 4A:
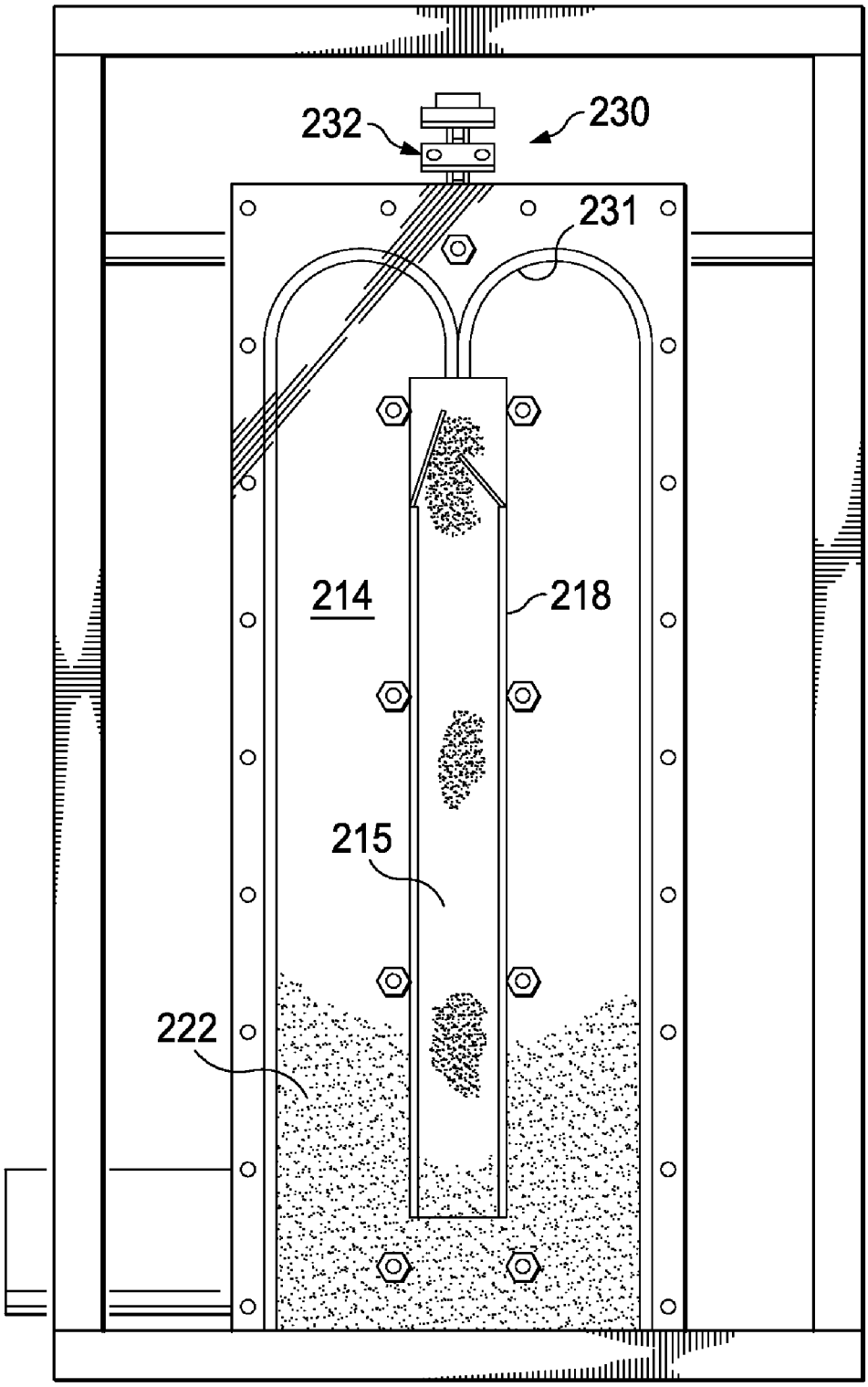
FIGS. 4A-B are photographs depicting a MSET catholyte chamber of an electrolytic cell, and a magnetic conveyor assembly, in accordance with an embodiment of the invention. A: front elevation. B: side rear view showing magnetic conveyor assembly.
Figure 4B:
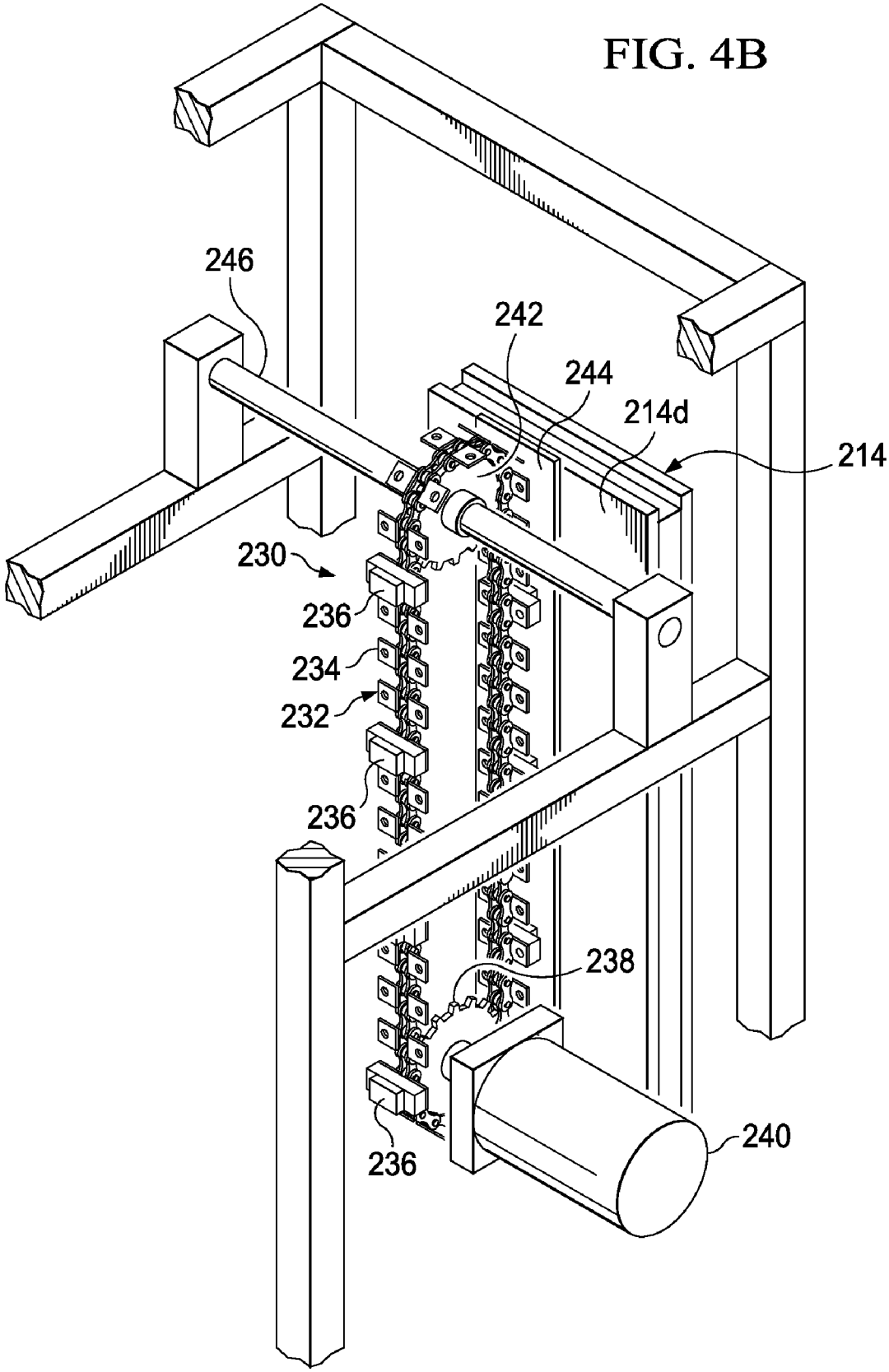

As shown in FIG. 4A, a rectangularly configured cathode chamber 214 of a MSET cell includes a double arch 231 for directing the gravity assisted flow of cathode beads symmetrically outward and back into the cathode bed 222 after release from spout tube 218. The interior wall 215 of spout tube 218 may comprise a low friction surface (e.g., Teflon®) to reduce the frictional resistance to bead movement. FIGS. 4A-B show the magnetic conveyer belt 232 of assembly 230 positioned in close alignment with the spout tube 218. A cushioned low friction surface 244 is preferably secured between spout tube 218 and magnets 236 for absorbing striking shock of the drive magnets and providing a low friction surface for the magnets to travel over on the rear exterior surface 214*d* of cathode body 214. For example, 1/16 inch thick foam strips covered with a 0.020 inch thick sheet of Teflon® could be used as the cushioned low friction surface.

FIG. 4B shows a rear view of a magnetic conveyer assembly 230. The belt 232, which in this example is a drive chain, is mounted on a drive sprocket 238 which is attached to a variable speed motor 240. Opposite the drive sprocket, the belt 232 is attached to an idler sprocket 242 which is mounted on a shaft 246 that can be moved to tension the drive belt. The assembly 230 is mounted such that it can be positioned behind cathode chamber 214 and aligned with the back (not visible in FIG. 4B) of spout tube 218. Although a roller chain containing multiple chain link tabs 234 is illustrated in this example, it should be understood that any other suitable type of articulated or flexible conveyor belt to which magnets can be attached, or the like, could be used instead.

Figure 5A:
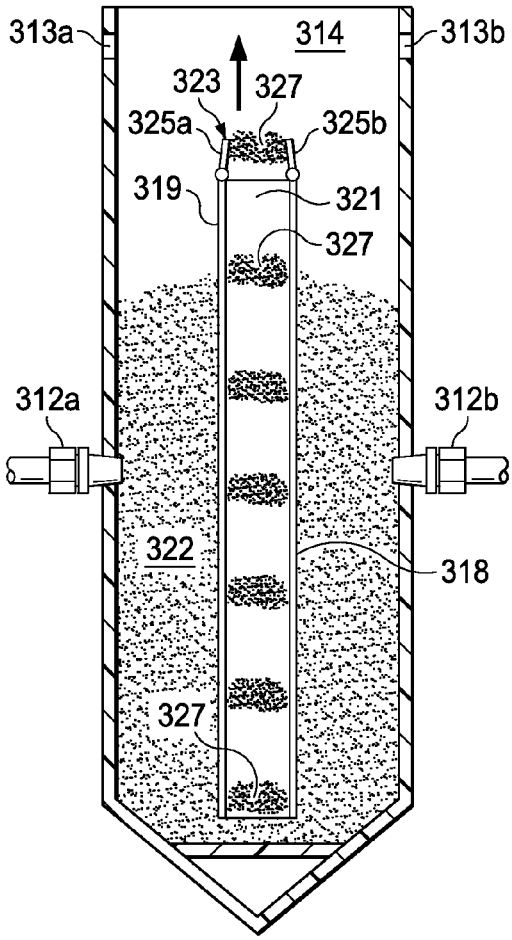
FIGS. 5A-B are schematic illustrations showing cathode spout tube check valve operation within a catholyte chamber. A: particles exiting the spout tube at open check valve. B: check valve in the closed position.
Figure 5B:
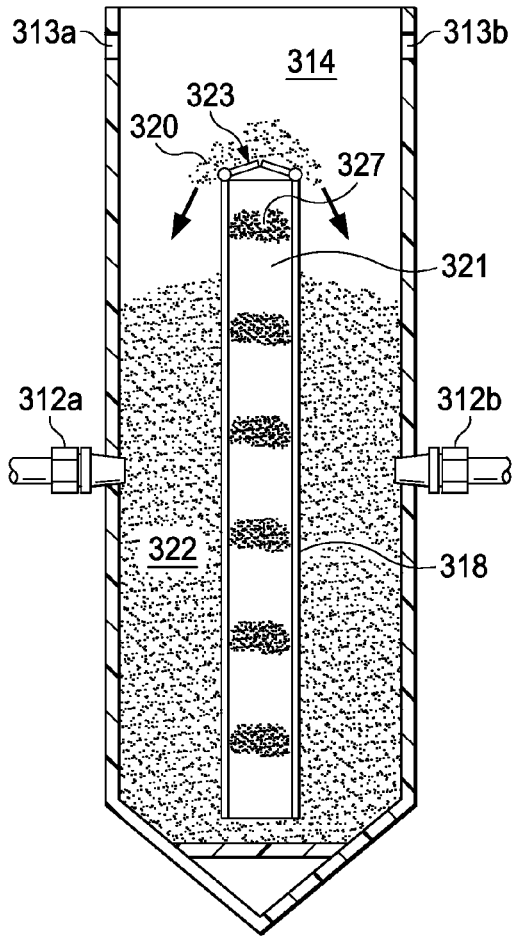

FIGS. 5A-B are schematic illustrations of a substantially rectangular cathode chamber 314 and spout tube 318 similar to that of FIG. 2A. Groups of magnetically attracted beads 327 are shown at intervals along the length of tube 318, held by magnets which are not visible in FIGS. 5A-B behind the spout tube (similar to the position of the magnetic conveyer assembly shown in FIG. 4B).

Figure 36:
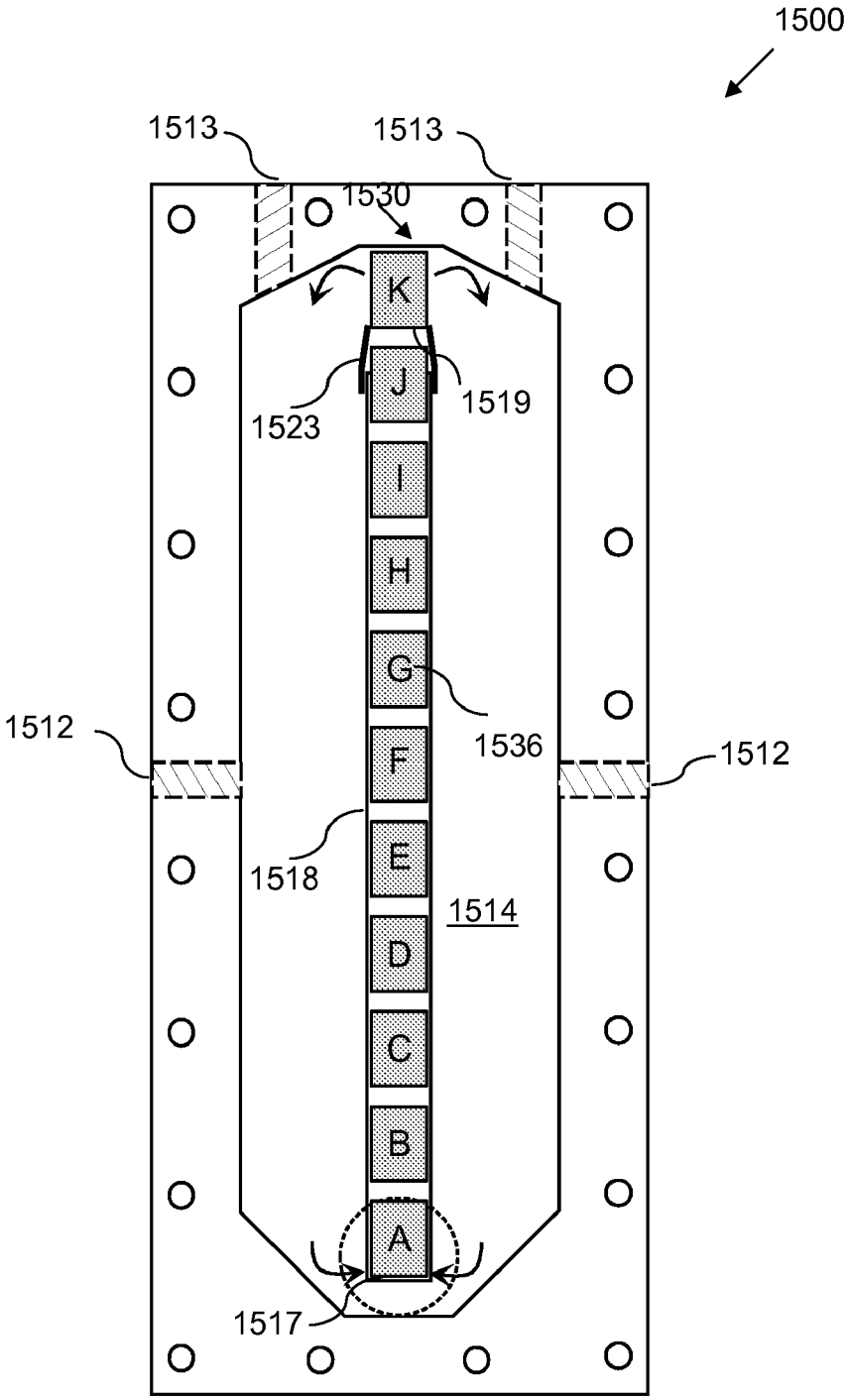
FIG. 36 is a schematic drawing of another configuration of a conveyor mechanism inside the cathode chamber of an electrolytic cell in which a line of stationary electromagnets is mounted on the external side of the cathode chamber, in accordance with certain embodiments of the invention.

Although permanent magnets may be used for many applications, there may be instances in which electromagnets are used instead, as illustrated in FIG. 36 and described in the section titled "Electromagnetic Spouting Mechanism." In FIGS. 5A-B, the double arch configuration of FIG. 4A is eliminated due to the inclusion of check value 323 at end 319 of spout tube 318. Check valve 323 may be two hinged flaps 325*a*, 325*b* of flexible plastic, "rubber," or any other suitable device which will allow each magnetically supported portion 327 of cathode beads 320, drawn from bed 322 to pass through spout tube exit 321 of tube 318. Valve 323 is also designed to cover exit 321 so that substantially all of the exiting portion of the beads do not fall back down the tube after being released from the magnetic drive into cathode chamber 314. The operation of check valve 323 is explained in more detail in the section subtitled "Process." Catholyte chamber 314 also includes one or more catholyte inlet (312*a*, 312*b*) and catholyte outlet (313*a*, 313*b*) that are distinct from the spouting mechanism. As illustrated in FIGS. 5A-B, spout tube 318 is symmetrically positioned in the middle of particle bed 322 and catholyte inlets 312*a*, 312*b* are positioned along the length of the bed (e.g., about half way) in such a manner as to balance the back pressure and/or flow distribution that the catholyte fluid will encounter in the cathode chamber during operation of the cell. In alternative configurations, the catholyte inlets and outlets may be positioned in the cell in any way that will provide the desired co-current, countercurrent and/or crosscurrent flow patterns for the intended application. Preferably the selected positions of the catholyte inlets and outlets promote the same or similar catholyte flow velocity, residence time, and particle surface area encountered throughout the particle bed during operation of the MSET cell.

Bench-scale MSET Electrolytic Cell

Figure 6A:
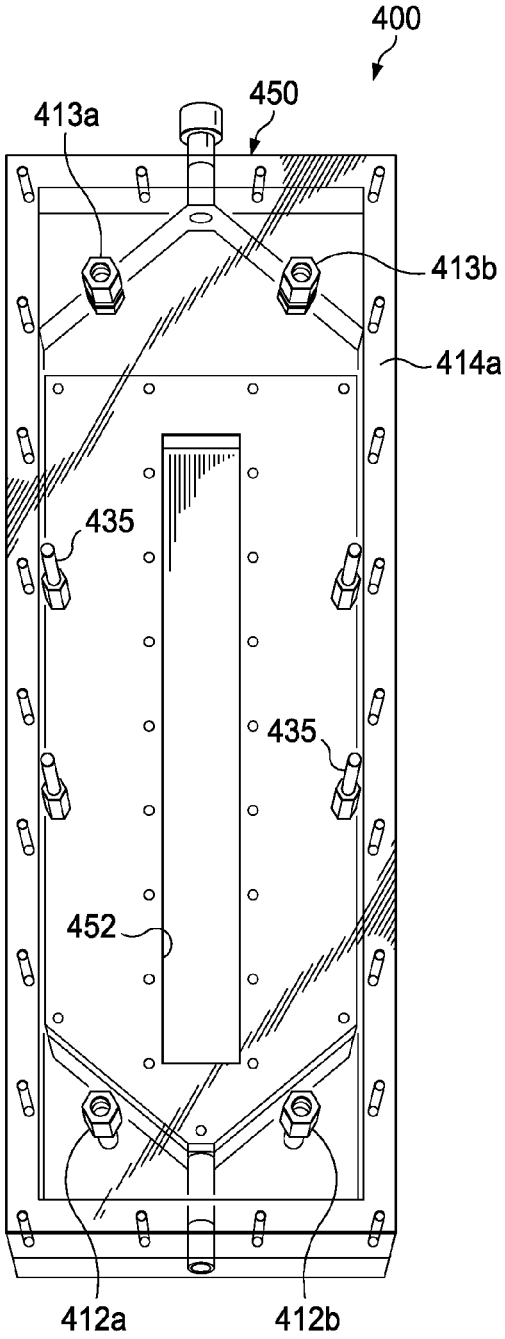
FIG. 6A-C are photographs depicting a disassembled MSET electrolytic cell, according to an embodiment of the invention. A: outside view of catholyte chamber body. B: inside view of catholyte chamber body (reverse side of A). C: outside view of anolyte chamber.
Figure 6B:
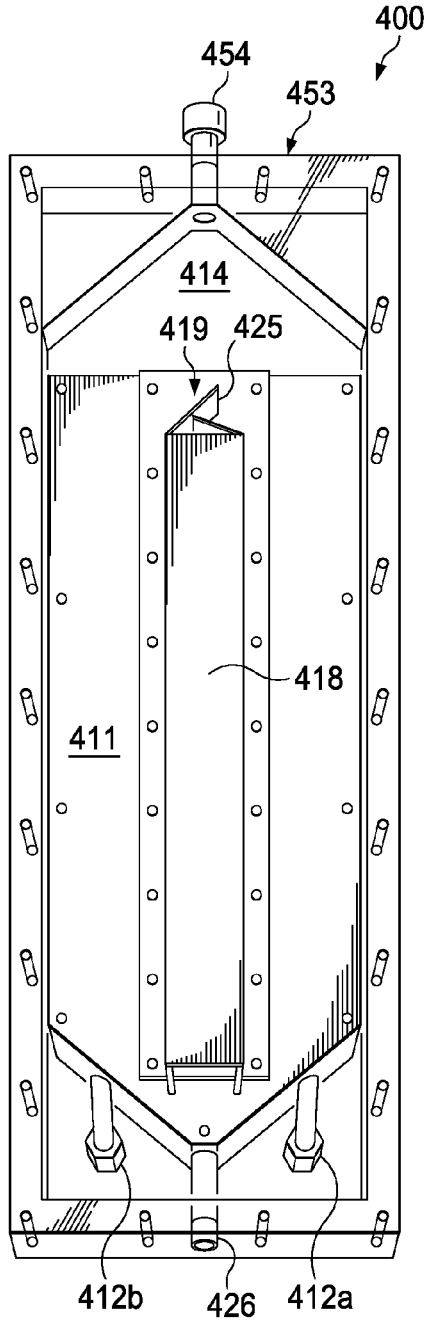
Figure 6C:
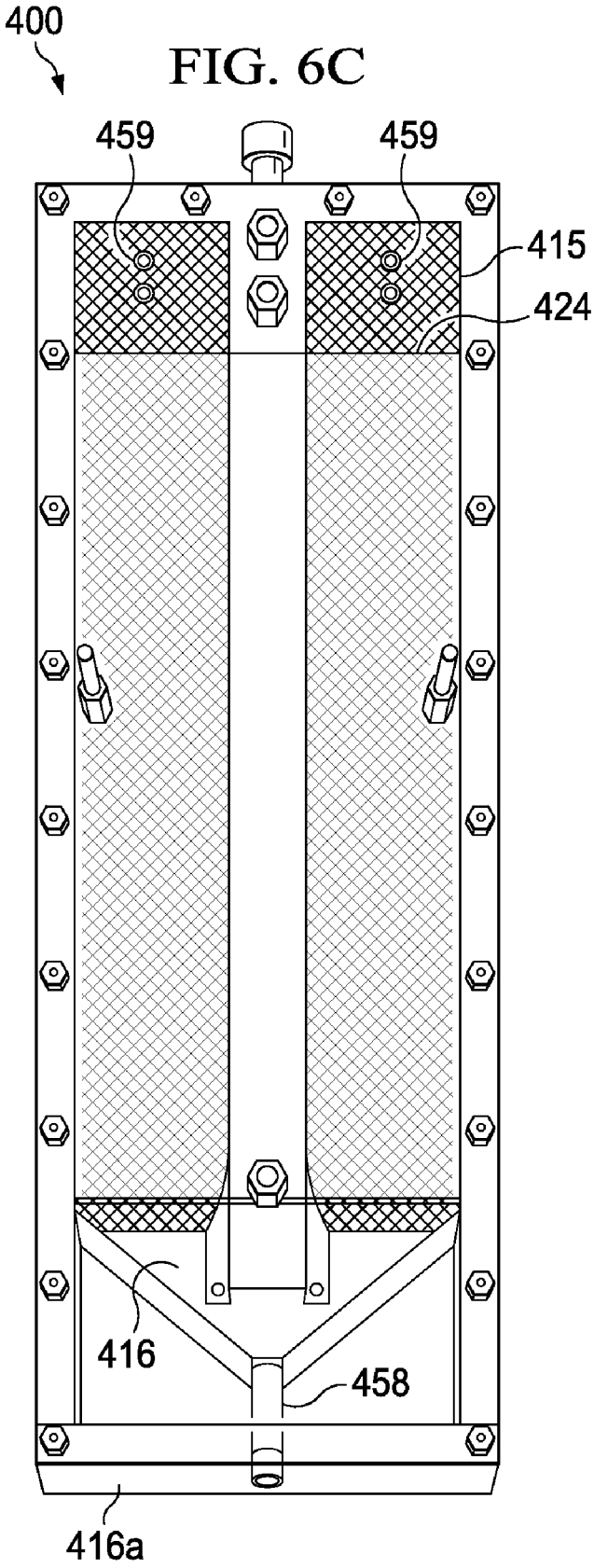

An exemplary bench-scale MSET electrolytic cell 400 is illustrated, disassembled, in FIGS. 6 A-C. In FIG. 6A, the outer face 450 of catholyte chamber body 414*a* is shown, and in FIG. 6B the reverse or interior side 453 of catholyte body 414*a* is shown. FIG. 6C shows the exterior face 416*a* of anode chamber 415. FIG. 7 shows the magnet conveyor drive chassis 433 mounted on cathode face 450 of the MSET cell. The chamber bodies were constructed from 1 in. acrylic sheets. Outer face 450 of the cathode chamber has a window 452 cut through the face to allow the magnets 436 of magnetic conveyor assembly 430 (FIG. 7) to contact the outer face of a stainless steel current collector plate 411 (FIG. 6B) (e.g., made of 1/16 in. thick 316 metal alloy), which is sealed to the inside of the cathode chamber with silicone RTV sealant and machine screws. A low-friction surface (e.g., a thin Teflon™ cladding) may be placed over the portion of the current collector that is to be contacted by the magnets in window 452. Four cathode current collector rods 435 (e.g., 1/4 in. copper) contact the stainless plate and are sealed with polypropylene compression fittings through the cell face. Two fluid inlets 412*a*, 412*b* and two outlet ports 413*a*, 413*b* are disposed at either end of the catholyte chamber. Alternatively, the catholyte inlets may be disposed on the side of the cell, as illustrated in FIGS. 5A-B. Cathode bead fill inlet 454 and cathode bead drain port 426 are in the top and bottom of the cathode cell, respectively, as illustrated in FIG. 6B.

FIG. 6B also shows the interior face 453 of cathode chamber 414 with a stainless steel current collector plate 411 and cathode bead spout tube 418, which is made of polycarbonate, or could be made of another suitable inert material. The top 419 of the spout tube is outfitted with two polyethylene flaps 425 that serve as a check valve to prevent cathode beads from dropping straight back down the spout tube. FIG. 6C, shows the anode chamber 416 defined by anode chamber body 416*a* and membrane 424. The anode 415 may be, for example, an expanded titanium mesh with a catalytic tantalum-doped iridium oxide coating (Eltec-EC-600). Two 1/4 in. diameter anode current collector rods (e.g., titanium, grade 2) contact the anode and are sealed with compression fittings through the cell face. Any other suitable anode/anode current collector may be used instead of titanium. A single anode fluid inlet 458 and two outlet ports 459 are positioned at either end of anode chamber 416.

When cell 400 is assembled, a suitable gasket material is used to seal the edges of catholyte chamber 414 and anolyte chamber 416. One such gasket material is 1/4 inch wide closed cell PVC foam. Cell 400 has a microporous membrane layer 424 (similar to membrane 24 in FIG. 2B or membrane 124 in FIG. 3) separating the anolyte chamber 416 from the catholyte chamber 414. A suitable membrane is DARAMIC II™, which is the standard membrane separator used in lead-acid batteries, has about a 5 year lifetime, and is resilient to abusive conditions such as low pH, cold temperatures, and dry storage cycles. Alternatively, another suitable ion-permeable membrane material may be employed. The membrane layer may be sandwiched between two polypropylene screens (not shown) to enhance its mechanical stability and wear resistance. The magnetic drive assembly 430, like that shown in FIG. 7, can be constructed of commercially available components. For example, the drive may be an ANSI 40 single pitch roller chain with mounting tabs 434 onto which the magnets 436 are attached at regular intervals along the chain-link belt 432. Permanent magnets (neodymium iron boride grade N40) are adhered to aluminum mounting blocks 437 that are fastened to the drive chain 432. The drive sprocket 438 is mounted directly to a variable speed 24 VDC motor (like that shown in FIG. 4B) and an idler sprocket 442 is used to tension the drive chain 432. The entire magnetic drive assembly 430 is mounted such that it is easily aligned with the cathode particle spout tube (FIGS. 6A-C). For example, assembly 430 may be mounted in chassis 433, as illustrated in FIG. 7, to improve the mechanical stability, provide easier alignment with the spout tube, and allow it to be easily removed for maintenance.

In another model of an MSET cell, the magnets were doubled in width compared to an earlier cell, and fits the same original sized window, which was just wide enough to accommodate the wider magnets. The double width magnetic drive was also mounted on a chassis similar to that shown in FIG. 7. The width of the window (similar to window 452 in FIG. 6A) that is cut through the center of the cathode face, and through which the magnetic conveyor drive runs, may be widened by a total of 1/16 inch for extra clearance around the magnets. The magnet conveyor drive may be fixed directly to the electrolytic cell body to minimize potential alignment problems.

As discussed in the "Process" section, below, as a result of this modification of the magnetic drive, the cathode churning or "spouting" rate was doubled compared to the previous version by doubling the width of the magnets to 1.5 inches, to prevent agglomeration of beads at higher metal concentrations (>500 mg/L). Doubling the width of the magnets did increase the volume of beads carried up the recirculation channel by nearly two fold compared to the first version of the electrolytic cell. The polyethylene flaps that act as the cathode bead check valve at the top of the recirculation channel were also redesigned so as to prevent them from inverting under the increased bead load weight, allowing the undesirable backflow of beads down the spout tube. Spacing between the magnets can also be increased to ensure that the timing of cathode bead release (from the magnet drive) is out of phase with the opening of the check valve.

In another MSET cell design, the treatment capacity of the MSET cell of FIGS. 6A-C was increased 2 fold compared to the geometric cathode area of an earlier design by elongating the cell. The catholyte and anolyte chambers, cathode current collector plate, and anode current collector can be elongated vertically about the mid-point by 12 inches. A second pair of electrode contact rods is then added to the anode, resulting in a total electrolytic cell height of 36 inches and a geometric cathode area, packed bed, of about 96 $in^2$ (620 $cm^2$). The cathode particle recirculation channel area, about 36 $in^2$, is also electroactive, but the density of cathode particles is low. The assembled cell dimensions, with doubled capacity, is about 36 in.×9 in.×3 in., excluding hardware and magnet conveyor drive. Increasing the treatment capacity of the electrolytic cell 3.5 fold is accomplished by elongating the cell, as described above, and also widening the cell body and cathode current collector plate a total of two inches symmetrically about the center line. This makes the electroactive geometric cathode area a total of one square foot, 144 $in^2$ (930 $cm^2$). The assembled cell dimensions (not including hardware and conveyor assembly) with 3.5 fold capacity, is about 36 in ×12 in ×3 in. Extra supports for the membrane separator may be added in the anolyte chamber to prevent ballooning of the catholyte chamber.

The representative embodiments shown in FIGS. 2-7 are vertically oriented and are configured for upward flow of catholyte and anolyte fluids, for magnetic spouting of the cathode particles and for gravity assisted movement of the particulate cathode for falling back onto the top of the cathode bed after being released at the top of the spout tube. Any of these designs may be oriented instead at an angle between about −75° to +75° relative to the vertical axis, if desired. Additionally, the anolyte and catholyte chambers may be modified for downward flow of electrolyte fluids, as may be desired for a particular application. Likewise, inlets and outlets for the electrolyte fluids may be varied in number and location from those shown. In a reactor that has a spout tube symmetrically positioned in the middle of the particle bed (as illustrated in FIGS. 2-8 and 33-36) the catholyte fluid inlets are preferably positioned part way up the particle bed. More preferably, the positions of the inlets along the side of the cathode particle bed are selected or adjusted so as to balance the back pressure and/or flow distribution that the catholyte fluid encounters in the reactor.

Magnetic Cathode Particles (MSET Cathode)

A suitable cathode material that is electrically conductive, magnetic, and corrosion resistant is employed as the cathode particles' substrate. A readily available magnetically attractive bead material comprising zinc plated, 2 mm diameter #7 steel shot (Precision Reloading, Inc.) is one such substrate material. Spherical beads are generally satisfactory for magnetically recirculating, while other shapes such as cylindrical beads (e.g., cut wire) do not flow as well in the MSET electrolytic system. Cathode bead surfaces are prepared in a way that minimizes their corrosion by metal/$H_2SO_4$ solutions. In various tests, the zinc plated steel shot were used directly, although care had to be taken to not corrode the zinc coating off of the shot bead in acidic solutions. The bare steel shot could be plated directly with various non-corrosive metals by electroless deposition and thermal annealing. Electroless copper coating was used to create cathode particles that are more stable to corrosion in acid solution. For some of the tests, the electroless plating solution was designed to work for the steel shot from Ballistic Products Inc., at room temperature for convenient bench-scale processing. Shot that has no small holes leading to a hollow center is a generally preferred substrate. Shots that have small holes are more difficult to seal with an initial copper coating.

One representative method for preparing cathode particles is as follows:

1) Prepare Reagents for Copper Plating Solution
a) Weigh solid reagents
6.00+/−0.05 g of $CuSO_4$ pentahydrate
3.73+/−0.05 g of NaOH, dry
8.88+/−0.05 g of EDTA
b) Pour up 6.0+/−0.2 ml of 37% formaldehyde in a clean graduate cylinder
2) Making the Copper Plating Solution
Into a 500 ml volumetric flask add the following, in the order listed,
a) 350 ml of deionized (DI) water
b) the 3.73 g of solid NaOH
c) the 8.88 g of EDTA
d) the 6 ml of 37% formaldehyde
e) Stir the mixture on a magnetic stirrer plate.
f) Continue stirring as the 6.00 g of $CuSO_4$ pentahydrate is slowly added, several flakes at a time. (By adding a small amount of the $CuSO_4$ at a time, the local pH in the mix zone should not fall below pH=3.0)
g) Add DI $H_2O$ to bring the level up to a full 500 ml.
Leave the mixture stirring and clean the shot per next section.
3) Activating Shot Surface
a) Wash the 600 g of shot with isopropanol; drain and quickly wash them with a small amount of 0.1M $H_2SO_4$. Drain again and triple rinse the shot with deionized water.
4) Copper Deposition onto Shot
a) Place the shot into a clean 1 L Nalgene® bottle and pour the copper-bearing solution into the bottle.
b) Seal the bottle; turn the bottle end-over-end several times to gently agitate the shot.
c) Allow the deposition to run 45 minutes, shaking the bottle again every 10-15 minutes.

d) Again triple rinse the shot with DI $H_2O$. Line a glass dish with 2 layers of paper towels and dry the beads. Repeat the towel drying with beads spread out. Air dry shot and store.

5) Anneal the Shot a) Put the 600 g of shot into an alumina boat.

b) Reduce the plated shot in a furnace with 5-10% $H_2$ in an inert gas at a slow bubble rate. Ramp the temperature from 21° C. to 500° C. in 1 hour, and hold the furnace temperature at 500° C. for 2 more hours under the reducing gas.

c) Cool the furnace back to 21° C. under nitrogen.

6) Clean Carbon "Soot" from Copper Surface a) Clean each 600 gram batch in 500 ml of 1:100 Citronox to DI $H_2O$ with agitation and a few minutes of sonication.

b) Rinse with DI and dry as above.

Low Power/Solar Powered MSET Metal Recovery System

Figure 8:
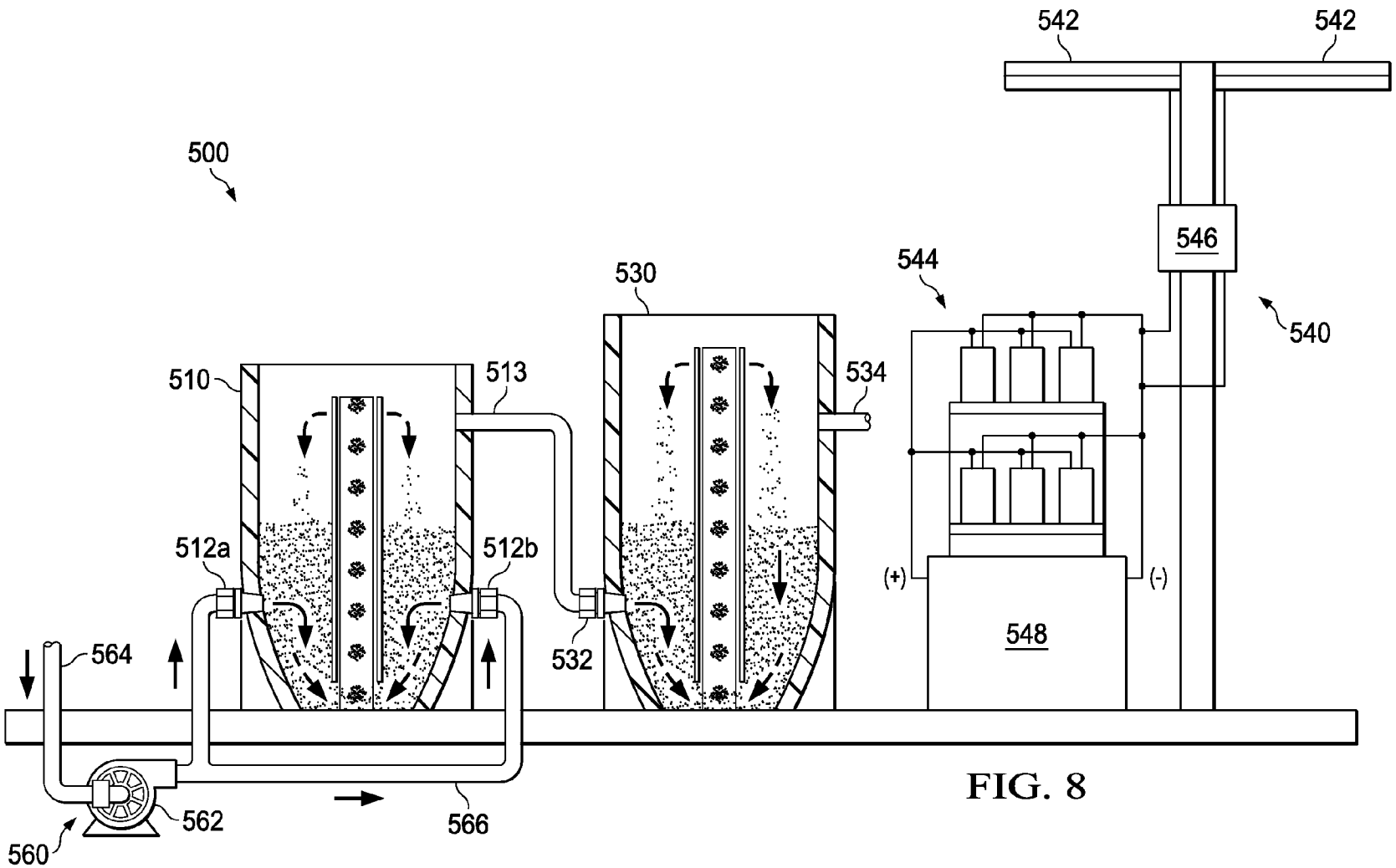
FIG. 8 is a schematic illustration of an electrowinning apparatus comprising two MSET electrolytic cells and solar power capability, in accordance with an embodiment of the invention.

A representative two-cell model of a MSET treatment system 500 is shown in FIG. 8, which is designed to operate off a solar panel/battery self-contained power system. System 500 includes a first MSET cell 510, a second MSET cell 530, a solar power system 540, and pumping assembly 560. First cell 510 is designed to function as a stripping cell for initial treatment of relatively high concentration metal contaminated water, and is similar to the cell shown in FIGS. 2A-B. Cell 510 has catholyte inlets 512*a,b* positioned along the cell wall, away from the bottom of the cell. The first cell is designed to be capable of recirculating the metal-containing fluid (catholyte), if desired. Alternatively, the first cell 510 is configured for a single pass of the metal-contaminated water stream. Catholyte outlet 513 is connected to catholyte inlet 532 of the second MSET cell 530. Second cell 530 is designed for downward flow of the catholyte, and can function as a polishing cell for treatment of a lower concentration of metal contaminated water. Second cell 530 has one or more clean water outlet 534. Pump assembly 560 includes pump 562, an inlet line 564 for receiving metal contaminated water, and an outlet line 566 for feeding the metal contaminated water to system 500 by way of inlets 512*a,b*. Solar power system 540, for powering pump 560 and supplying the necessary electrode potentials to cells 510 and 530, includes a group of solar panels 542, a bank of deep cycle rechargeable batteries 544, a battery charging controller 546, and a control/power supply box 548. Control box 548, which may contain all 12 or 24 V dc components, includes such components as power converters, sensors to monitor performance, I/O for remote monitoring/alerting, and computer chips programmed to carry out the automated removal and addition of cathode particles, allowing continuous operation (not shown). The system 500 may also include a reservoir of fresh cathode particles connected to cells 510 and 530, and a reservoir for receiving used cathode particles containing recovered or electrowon contaminants (not shown). This system may be constructed compactly from modular components for ease of assembly, disassembly and repair.

Additional features of this model may include a "smart" control/alert system for remote operation/oversight, and an automated cathode particle addition/removal/recovery system (not shown) which will allow long-term continuous operation of the system. The system may be configured for both 110V ac power and solar powered operation, for remote site operation. Monitoring and control circuitry may also be included in this system. Some of the potential benefits of a MSET treatment system such as this include the significant reduction in fluid circulation costs and much greater operation flexibility, while retaining the advantages of high operation current densities and efficiencies at low metal concentrations; compact and low capital cells; no need for solution pretreatment; easy and compact contaminant capture with simple removal; and modular and readily automated equipment.

Depending on the anticipated end-use application and location, further modifications may be included in the MSET system if desired. For instance, the system may be weatherproofed and animal-proofed for outdoor use, and extra care taken to ensure that the components of the magnetic conveyor drive are corrosion resistant and all electrical connections are water resistant and that the selected drive motors and pumps are suitable for outdoor use.

MSET-Acid Mine Drainage Treatment Platform

Figure 31:
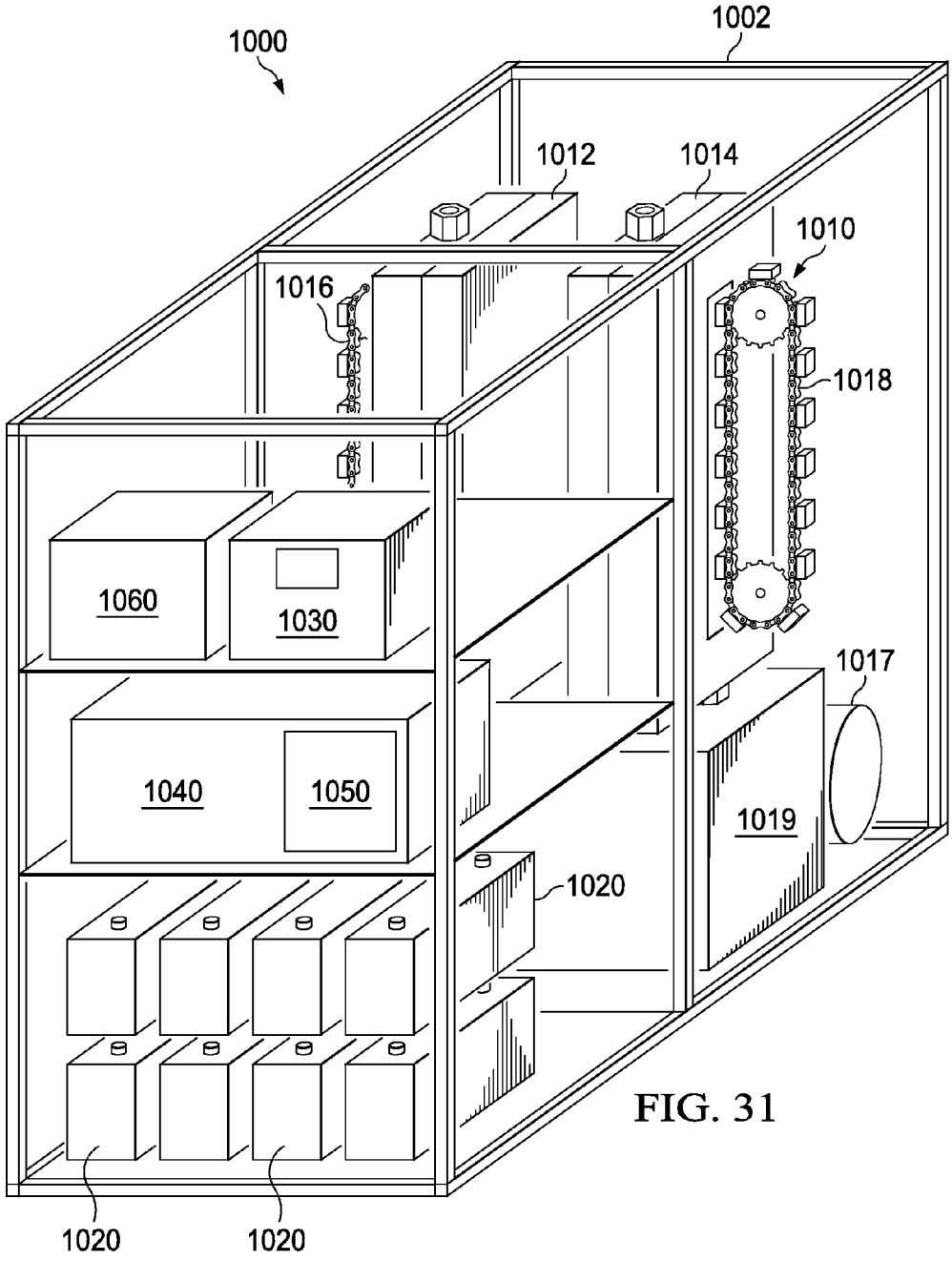
FIG. 31 is a schematic diagram of a MSET treatment system suitable for use in treating acid mine drainage, in accordance with some embodiments of the invention.

An exemplary MSET-AMD treatment system platform 1000 shown in FIG. 31 has overall dimensions of 32 in. (W)×40 in. (L)×56 in. (H). The frame 1002 of the system platform is welded 1.5 in. square steel tubing for rigidity and durability. The system platform is designed to accommodate a battery bank 1020 comprising eight deep-cycle lead-acid batteries. In this embodiment, at least one control module 1030 is employed for simplicity of construction and maintenance. The power regulator module 1040 contains a battery charger 1050 and voltage regulators (not shown) that interface between solar panels (if present), battery bank 1020, MSET system 1010, system control module 1030, and safety shut-down interlock module 1060. In this embodiment, MSET system 1010 includes a pair of MSET electrolytic cells 1012, 1014 with associated magnetic conveyor assemblies 1016, 1018. One or more pump 1017 and solids collection bin 1019 are also included as part of MSET system 1010. Commercial available components may be used for the battery charger (e.g., Trace C-Series Multi Function DC Controller with C-Series LCD Display) and voltage regulators (e.g., Datel single output DC/DC converters for high current/high power or low voltage/low power). In this embodiment, the battery bank comprises eight "deep cycle" batteries each rated for 6V and 215 amp-hours to provide 40 hours of system power without charging.

Figure 32:
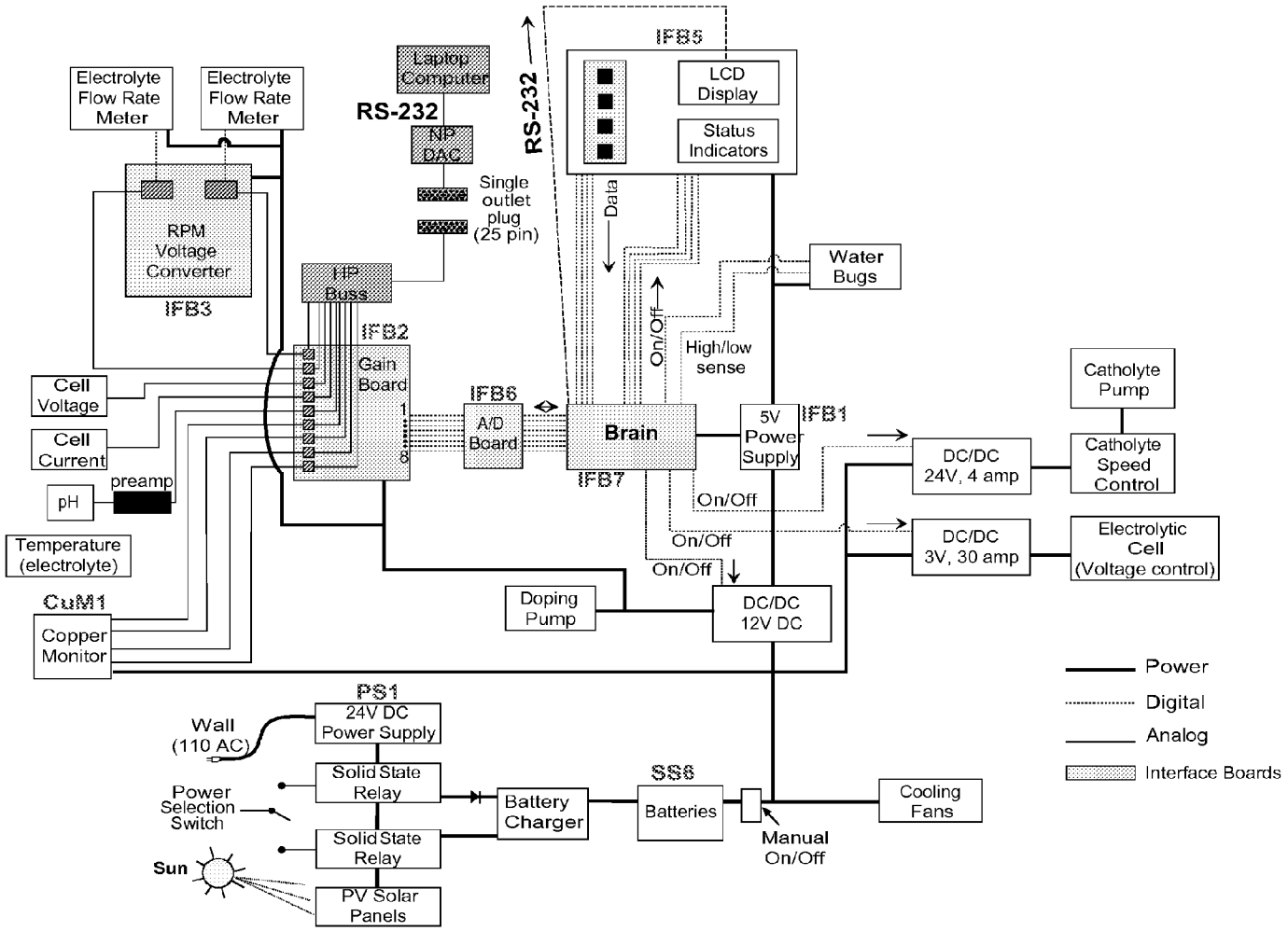
FIG. 32 is a diagram of an exemplary electrical connection scheme for controlling the MSET system of FIG. 31.

The system control module 1030 contains an electronics system for automated control and user interface. System monitoring sensors include appropriately located feed flow meter, cell voltage monitoring, magnetic drive motor speed sensor, pH sensors, temperature sensors, power supply control, and safety shut-down interlock interface. For example, a commercial CPU and A/D board may be used for computer control of the system. The computer is appropriately programmed with system software written in C++ and stored in its non-volatile memory. Circuitries of all other boards (frequency/voltage converter, voltage amplifier, 12V and 5V sources, power control interface, user interface, LCD and keypad) are suitably prepared using known techniques. In FIG. 32, a diagram of an exemplary electrical connection scheme for controlling the MSET system of FIG. 31 is shown.

The safety shut-down interlock module (power interlock module) 1060 functions as the power distribution module to each component of the electrolytic cells. The interlock module contains solid state relay circuits that can be triggered by the system control module and leak sensors to shut down the power distribution to the electrolytic cells, magnetic conveyor drive motor, and feed pump in the event of leaking or other system failures. This module allows for manual or automated power control. Commercially sold control systems such as a programmable logic controller (PLC) will provide this functionality.

Solar panels (like those schematically illustrated in FIG. 29), e.g., Photowatt PW750, may be mounted separately from the system platform and interfaced with the battery charger in the power control module. Panels may be attached to the outside of the frame and sealed to be watertight. Latched doors or removable access panels may also be sealed with weather proof gaskets.

Process

Electro-Refining Process—Single Stage for Batch Mode Metal Removal.

Figure 9:
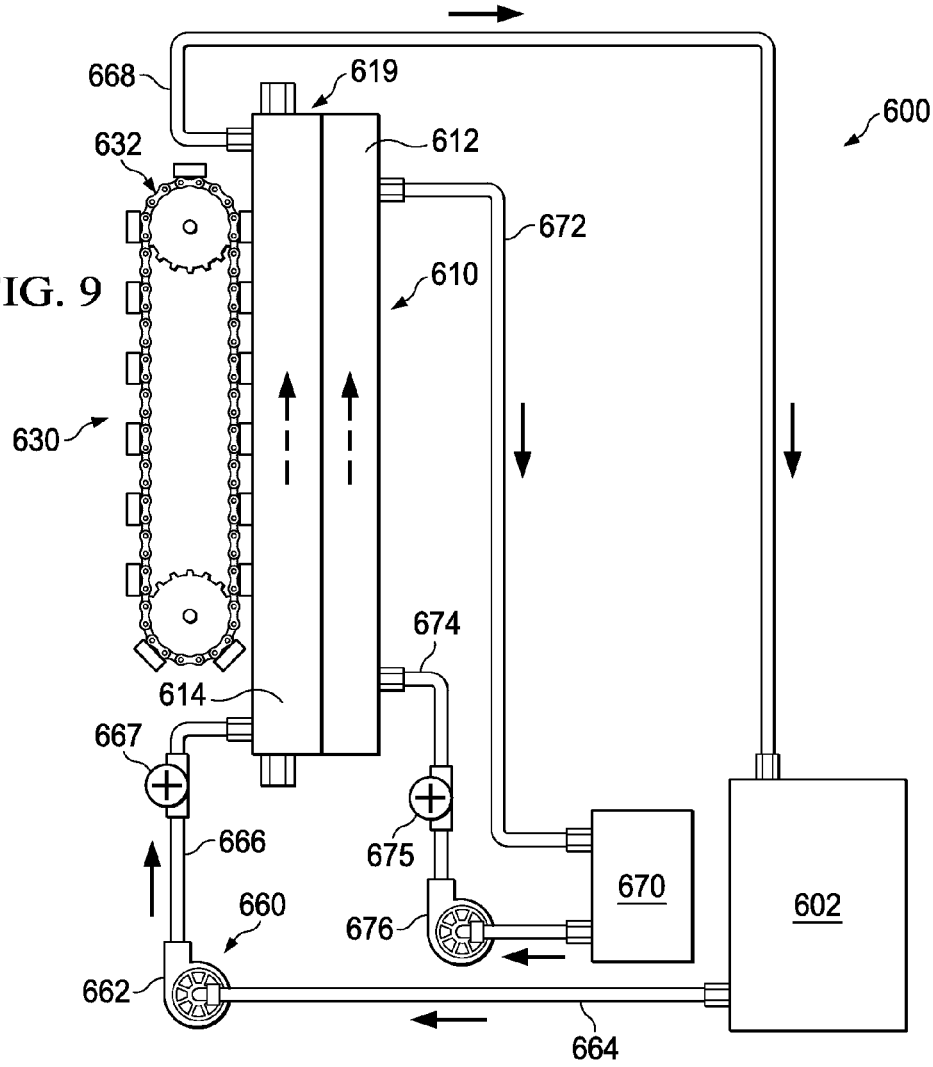
FIG. 9 is a schematic fluid flow diagram of an electrowinning process for batch-mode metal removal from a liquid stream, in accordance with an embodiment of the invention.

An example of a batch mode electrowinning process for recovering a single target metal employs an electrolytic cell as described above, connected to a fluid circulation system for recirculating a metal-contaminated aqueous feed streams, as illustrated in the fluid flow diagram shown in FIG. 9. In some instances, the feed stream may have a low concentration of target metal, i.e., 2000 mg/L or less. For example, the target metal concentration may be in the range of 5 to 2000 mg/L (5 to 2000 ppm). The electrolytically conductive feed stream, or catholyte, is withdrawn from reservoir 602 of system 600 by pumping assembly 660 into line 664, through pump 662 and into cathode chamber 614 of MSET cell 610, via line 666. The catholyte is circulated through the cathode chamber and out the top 619 of cell 610 into line 668, through which the treated stream returns to catholyte tank 602. Catholyte flow rate is maintained at a rate that provides sufficient contact time with the cathode particle bed for acceptable target metal removal from the feed stream. The pH of the catholyte in this and other exemplary processes described herein may range from −1 to 14, and in some embodiments the catholyte pH is in the range of −1 to 6.

A separate reservoir 670 is used for circulation of the anolyte in the anode chamber 612, via lines 672 and 674 anode solution pump 676 and anolyte pump 676. The electrolyte used as the anolyte typically comprises any suitable sulfate, or phosphate, or a combinations of any of those. The anolyte flow rate is maintained at a suitable rate to purge evolved oxygen from the flow chamber and maintain the fluid level over the anode and membrane surfaces. Preferably the cathode and anode solutions are isolated from each other (instead of being fed from the same pump and reservoir), as this was found to decrease the cell current passed during operation by about a factor of ten compared to circulation of an anolyte that is not isolated from the catholyte.

MSET cell 610 and magnetic drive assembly 630 are similar to those shown in FIGS. 2A-B, and catholyte chamber 614 contains a bed of magnetic cathode particles. System startup proceeds by turning the magnetic drive 632 and the anode solution pump 676 first. For example, the anolyte may comprise 3 L of 0.01 $NH_2SO_4$, circulating at a rate of 420 mL/min). Then the catholyte feed pump 662 is turned on and the flow rate set (e.g., between 5 and 13 L/min). The feed pump may be a centrifugal type, positive-displacement or progressing cavity pump, or other suitable pumping device. Finally, the cell power supply (not shown) is turned on at the desired voltage and/or current, depending on the properties of the metal targeted for removal and accompanying metal impurities targeted for separation. The voltage is applied across the electrodes to effect reduction of the target metal at the cathode and oxidation of water at the anode. As a result, the anolyte feed stream is oxidized to produce H+ protons and oxygen. The H+ protons move from the anolyte chamber through the membrane to the catholyte chamber, where the H+ protons maintain the charge balance by combining with free anions that are produced in the catholyte chamber as heavy metal ions are removed from the feed stream.

A high-current power supply, such as 120 VAC power or an alternative off-grid source, e.g., Kepco ATE 55-20M, is used in voltage-control or current-control mode for the electrolytic cell power. Cell potentials are typically in the range of 0.5-12 V. Electrolysis commences and continues by continued application of the voltage and circulation of electrolytes, until the operation is stopped. The system may be set to automatically cease operation when a desired low level of metal in the catholyte is achieved. Digital multi-meters (not shown) can be used for monitoring cell voltage and current. A small amount of anolyte makeup water from the feed stream or another source may be added during operation of the system, if necessary. During operation of the system, cathode fluid samples may be collected periodically and the cell voltage and current recorded and adjusted, if desired. Digital in-line flow meter 667, 675 and an external hand-held ultrasound Doppler flow velocity (not shown) are used to meter the flow of the catholyte and anolyte, respectively. For production of reduced-metal oxides an air line (connected to an air pump or a source of compressed air) may be employed for supplying additional $O_2$ to the catholyte.

The magnetic conveyor belt 632 is operated at a rate sufficient to move successive portions of the magnetic cathode particles from the bottom of the bed, up through the spout tube, and out the top of the tube, thereby returning the particles to the top of the bed. Referring briefly to the exploded view of a reactor (electrolytic cell) 100 shown in FIG. 3, in embodiments in which the cathode particles slide up while in contact with the current collector 111, the particles remain electrified during transport (i.e., spouting). As illustrated in FIG. 2B, a plurality of spaced-apart magnets carry groups of magnetically attracted cathode beads upward through spout tube 18. Like the configuration shown in FIGS. 5A-B, a check valve 323 may be employed to allow groups of cathode particles 327 to pass through spout tube exit 321 when exiting spout tube 318, and then covers spout tube exit 321 so that all or most of the cathode particles do not fall back down the tube after being released from the magnetic drive 30. As illustrated in FIG. 2B, as each magnet on the conveyer belt is carried up and away from the top of the cathode chamber, the magnetic force holding the cathode particles ceases and the particles fall away and drop back onto the top of the cathode bed. Notably, the flow of catholyte is not necessarily directed up the spout tube, and "spouting" of the cathode particles is not coupled to or dependent upon the flow of catholyte to levitate and thereby transport the particles. As discussed above with respect to FIGS. 2A and 5A,B, when the spout tube symmetrically positioned in the middle of the particle bed, the catholyte inlets are preferably positioned relative to the particle bed so as to balance the back pressure and/or flow distribution that the catholyte fluid encounters. Accordingly, the catholyte stream has the same or similar flow velocity, residence time throughout the particle bed, and the fluid encounters the same particle surface regardless of whether the process is operated with co-current, countercurrent or crosscurrent flow. In exemplary tests, when the system was operated at a magnetic cathode particle "spouting rate" in the range of 0.1 to 1 L/min particle agglomeration was prevented at lower concentrations (i.e., <400 ppm) of metal in the feed stream. For feed streams that have higher metal concentrations, the spouting rate can be increased due to the very high metal deposition rates. The spouting rate is approximately doubled by doubling the width of the magnets, as illustrated in FIG. 4B. Continued operation of the magnetic drive causes the cathode particle bed to be churned, independent of the catholyte fluids flow path and flow rate. During operation of the system, cathode fluid samples may be collected periodically and the cell voltage and current recorded and adjusted, if desired. Referring again to FIG. 9, a digital in-line flow meter 667, 675 and an external hand-held ultrasound Doppler flow velocity (not shown) can be included to meter the flow of the feed solution (catholyte) and anolyte, respectively.

Finally, the captured, reduced metal or metal oxide product deposited on the cathode beads is recovered using one or more recovery method that is suitable for chosen application. Some known recovery methods that may be used include settling tanks, particle filtration, cathode recovery, and magnetic separation. Additionally, if significant amounts of hydrogen or arsine gas are generated, suitable gas recovery methods may be implemented. When hydrogen is produced it can be combusted or used as a fuel, depending on the application, location, regulations and other specific requirements. A convenient, passive method for solids separation is settling. This is the common approach used in large water treatment facilities for mass (flocculated) solids removal. The solids are later recovered and fluid is either recycled back into the process or discharged. Most other solids removal methods are active. Particle filtration is useful in either a production/separations process (i.e., a filter press, bag filter, drum filter, conveyor filter) or where there is only a small amount of solids to remove before discharge. Magnetic separation is typically used in industry to remove magnetic products continuously from a process stream containing magnetic particles such as ferrous metals (Fe, Co, Ni) or ferrites. Cathode recovery may be necessary if the cathode substrate beads grow too large with deposited metal. The plated beads may be exchanged for fresh ones or the deposited metal can be re-oxidized into a concentrated liquid solution for further refinement by conventional processes. At the end of batch-mode processing, the concentration of target metal in tank 602 is significantly reduced, in many instances to less than 0.5 mg/L.

Electro-Refining Process—Single-stage Catholyte Flow Through.

A representative single-stage catholyte flow through (one pass) process for removal of a single metal is carried out essentially as described above with respect to the fluid flow diagram shown in FIG. 9, except that the feed flow rate is set at ~8.5 L/min with a current density of 1.16 mA/cm$^2$ in constant current control and the system is configured for flow through instead of batch-mode recirculation. Samples may be taken from the discharge stream to ensure that the desired level of metal removal is achieved.

Electro-Refining Process—Multi-stage (Multi-Metal) Catholyte Flow Through.

Figure 10B:
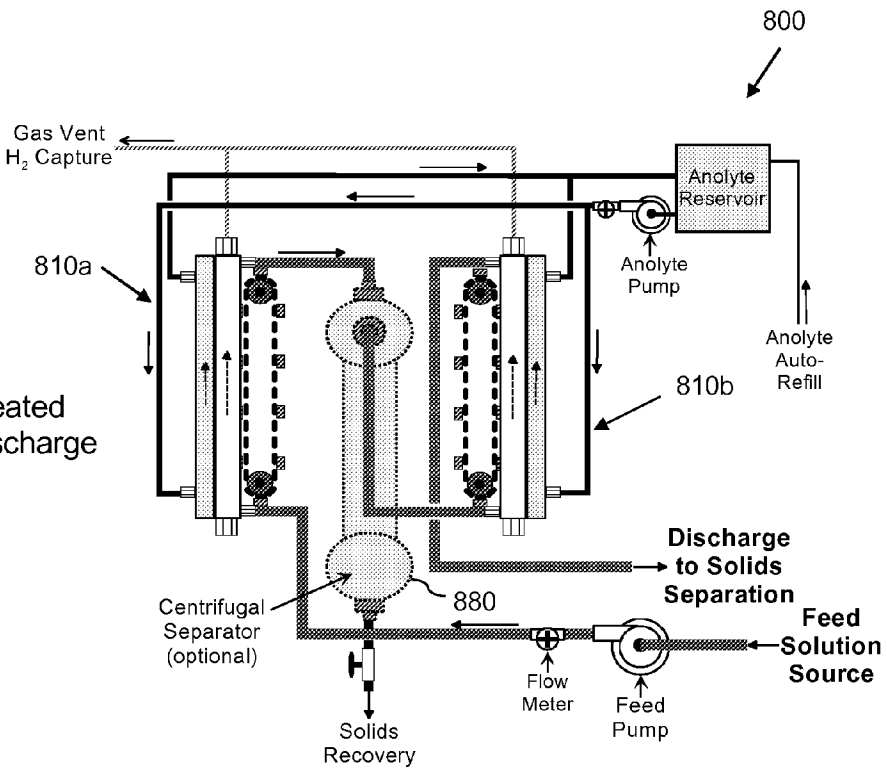
FIGS. 10A-B are schematic fluid flow diagrams of process embodiments employing pairs of MSET cells in series. A: anolyte and catholyte combined. B: anolyte and catholyte separate.
Figure 10A:
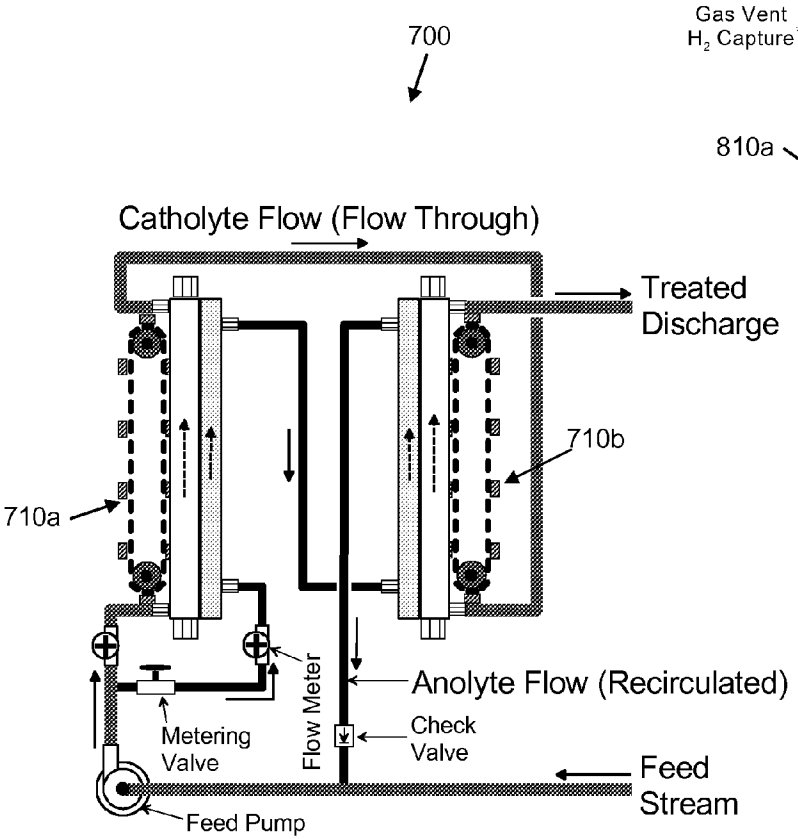

For some applications, multiple electrolytic stages are used to sequentially remove individual metals selectively from a mixed-metal feed stream in order of more positive to more negative reduction potentials. A modified version of an above-described process is employed, which has multiple electrolytic cell stages, each having its current density separately optimized for a respective target metal. System 700, having a pair of electrolytic cells 710*a*, 710*b* with the cathode feed fluid flow connected in series, is illustrated in FIG. 10A. It is estimated that as few as two of these cells in series will provide the targeted flow-through treatment capacity with acceptable discharge concentrations. For example, a pair of 3.5× capacity electrolytic cells, as shown in FIGS. 6-7 is used at a flow rate of 6-9 gallons per minute (gpm) for copper recovery and discharge concentrations of 1 ppm or less. As shown in FIG. 10A, the feed solution flows through the cathode chamber of cell 710*a* and then through the cathode chamber of cell 710*b*. The anolyte solution is split off from the feed solution flow, passed through the anodes in series (remains untreated), and returned to the feed stream for treatment. In a variation of the multi-stage process of FIG. 10A, the feed stream does not circulate to both the cathode and the anode chambers. In this case, the composition of the anolyte is the same or different than the feed stream, and is maintained separate from the catholyte, as in FIG. 10B. Processes using a system configured as shown in FIG. 10A are represented by the experiments summarized in Table 2. Processes carried out in a system configured as shown in FIG. 10B are represented by the experiments summarized in Table 3.

By decoupling catholyte flow and cathode particle "spouting," slower flow rates (cathode chamber space velocity) are made possible, to permit enhanced recovery of low concentration metals. In some applications, the electrolytic cells are operated at lower current densities and at lower voltages compared to typical electrolytic cells used for electro-refining. The metal-containing feed streams may be of a wider variety of electrolyte types and strengths than has usually been possible with other electrowinning systems. In the system of FIG. 10B, a pair of electrolytic cells 810*a*, 810*b* have the cathode feed fluid flow connected in series. The anolyte solution is contained in its own circulation loop with automated water refill to make up for water lost to electrolysis. A solids separator 880, such as a centrifugal separator, may be included to reduce the solids loading between electrolytic cells 810*a* and 810*b*, in series, to avoid plugging the second cell if particle loading becomes too great. In the embodiment shown in FIG. 10B, the electrolytic cells and magnetic drive assemblies are similar to those of FIGS. 9 and 10A.

Figure 17:
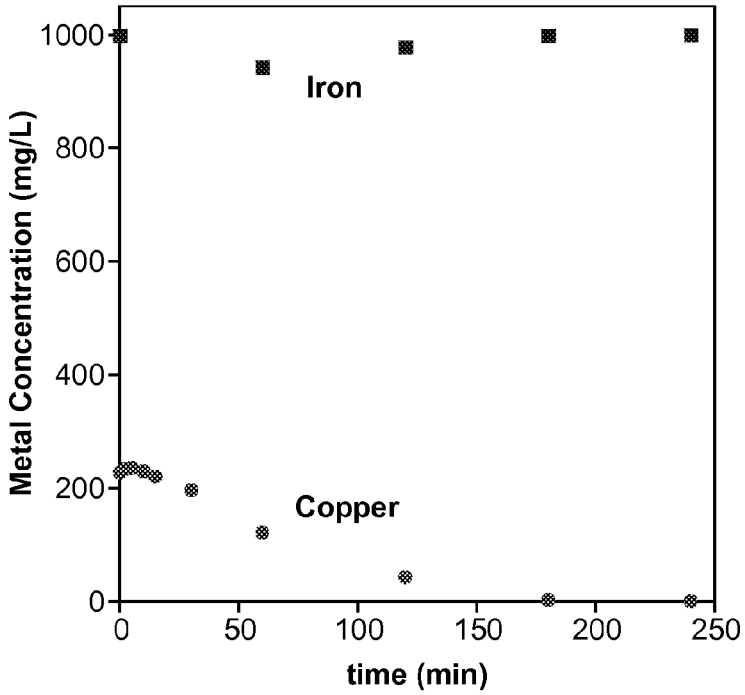
FIG. 17 is a graph showing the selective removal of copper from an iron-containing solution, at pH 2.3 using a $H_2SO_4$ electrolyte.

A major feature for a refining application is the selectivity of metal recovery. The most common and problematic contaminant to be encountered is typically iron. Several experiments were conducted to demonstrate selectivity of this technology for recovering copper from feed streams containing high iron concentrations as shown in FIG. 17. The feed stream contained 1000 ppm iron (about 5:1 $Fe^{2+}$:$Fe^{3+}$) and 230 ppm copper at a pH of 2.3 with sulfate as the primary anion. This is very similar to the Cu/Fe/$SO_4^{2-}$ water composition of the Berkeley Mine pit in Butte, Mont. Copper was selectively recovered down to about a 0.5 ppm concentration without touching the iron. Copper recovered from this experiment is at least 99.9% purity. In fact, the presence of iron is not expected to be a significant issue for copper recovery. Similar selectivity for copper removal from copper/nickel mixed streams was also demonstrated under similar conditions. The primary parameter that affects selective recovery of specific metals from a mixed stream is the cathode potential. Metals of more positive reduction potential are removed first and more positive cathode potentials while metals of more negative reduction potential are remove at correspondingly more negative cathode potentials. The secondary parameter to affect selective recovery of metals is the presence of interferences. One type of interference is caused by the presence of a metal with reduction potential very similar to the target metal resulting in co-deposition onto the cathode. Another type of interference is caused by the presence of a metal with anomalous deposition behavior when in the presence of another, such as that observed for the iron group metals, leading to co-deposition or inhibited deposition rates.

Electro-Refining Process—Multi-Stage (Single Metal) Catholyte Flow Through.

Another variation of a multi-stage process employs a system similar to that shown in FIG. 8, in which the first cell 510 is a stripping cell that receives an aqueous feed stream in which the target metal content is high (e.g., 1000 ppm or greater). The second electrolytic cell 530 is a polishing cell, which receives a comparatively low concentration (e.g., 200 ppm or less) target metal-containing stream after treatment by the first cell. The current density of each cell is individually optimized during operation of the process, and the treated water exiting the second cell 530 is substantially depleted of target metal, having, for example, a target metal concentration below 0.5 mg/L.

Although the foregoing multi-stage processes focus on representative two-electrolytic cell systems, it should be understood that additional electrolytic cells and stages may also be employed, each having its current density and other operating parameters optimized for electrolytic removal of a targeted metal. Likewise, the capacity of a process described herein may be increased by operating, in parallel, one or more additional multi-stage series of MSET cells. It should be appreciated that various features of the apparatus and processes described herein may be employed separately or in combinations other than just the representative embodiments shown.

EXAMPLES

As an aid in implementing a MSET metal recovery process, a list of exemplary target metals and their known reduction potentials (relative to the standard hydrogen electrode, SHE) are given in Table 1, for reference.

Example 1

Nickel, Copper Removal

Figure 11:
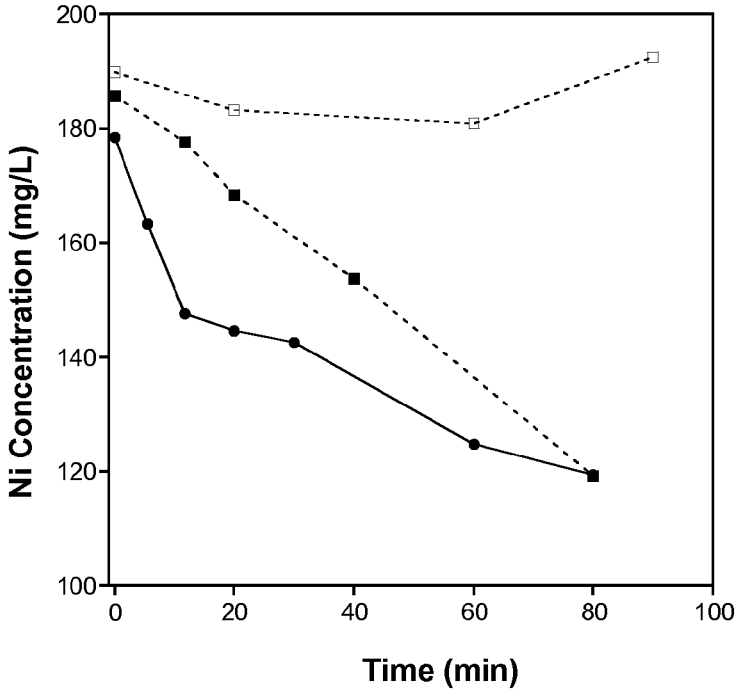
FIG. 11 is a graph showing the results of MSET nickel removal under three experimental conditions of variable feed solution flow rate and pH with constant volume (7 L), cathode area (180 $cm^2$), and initial concentration.
Figure 12:
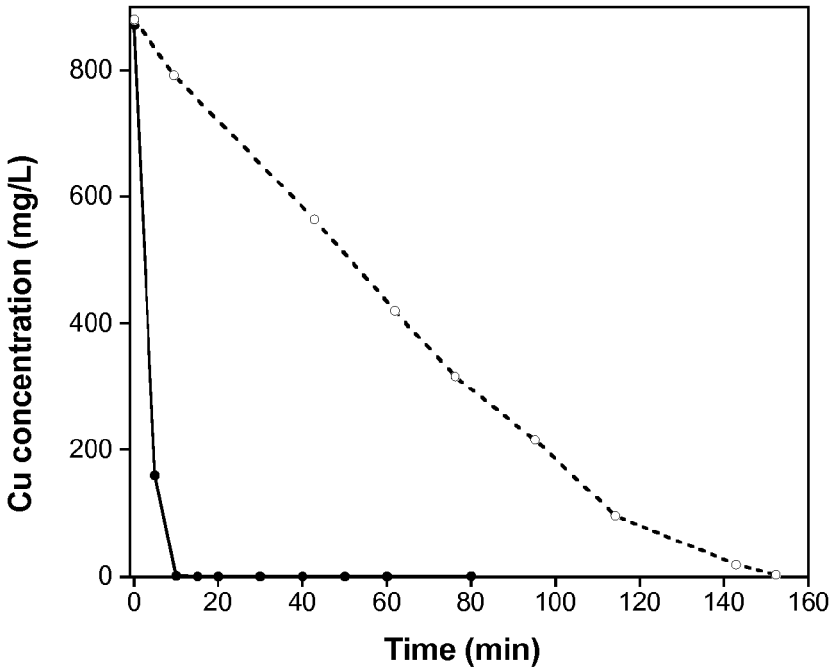
FIG. 12 is a graph comparing the copper removal rate obtained with a representative magnetically spouted electrolytic cell to that of a fluid spouted electrolytic cell under the same conditions.

For a given set of MSET operating conditions, the relative electrowinning efficiency for each metal closely follows the relative reduction potentials making it possible for selective electro-refining from mixed sources. The effect of pH also has an influence on electrowinning efficiency and final metal concentration of the effluent in addition to the feed flow rate and current density as mentioned above. These effects are illustrated in FIG. 11 for nickel using a MSET system configuration similar to that shown in FIGS. 4A-B with different feed solution flow rates and pH (constant current density). At high feed-flow rate there is no removal of nickel, however, these same conditions promote the good copper removal shown in FIG. 12. Reducing the feed flow rate or raising the pH leads to nickel removal, even at very low concentrations. Higher current densities will further increase nickel (and zinc) removal rates. The performance improvement of a MSET system over a conventional fluid-spouted cathode cell design is shown in FIG. 12, starting near 870 mg/L copper as $CuSO_4$. Solid circles represent the MSET cell (7 L, 180 $cm^2$ cathode), and the open circles represent prior fluid spouted electrolytic cell (normalized to 7 L and 180 $cm^2$ cathode). Both solutions contained copper sulfate at pH 0.7.

The copper removal rate for the example of FIG. 12 is 10 lb/day per square foot of geometric cathode area (49 kg/day/$m^2$). A MSET electro-refining plant system having 200 $ft^2$ geometric cathode area is suitable for recovering 1 short ton of copper per day from a relatively dilute (<1000 ppm) aqueous source. Another potential benefit of many MSET designs is greater control of metal reduction/removal selectivity from mixed sources. Still other potential benefits are reduced power consumption for fluid circulation, e.g., many embodiments can be operated with gravity feed. Many embodiments provide reduced mechanical wear and stress on the electrolytic cell by using slower moving cathode particles.

Example 2

Parameterization of Process Variables

The new magnetically spouted electrolytic technology has made possible for the first time the parameterization of the process variables, allowing significant advances to be made in electrowinning rate, efficiency and selectivity. These advances have provided the performance necessary to design simple, low-cost, flow-through metal recovery and refining systems for direct capture of valuable metals from a variety of aqueous sources too dilute to be economically viable with currently available technology.

Since the metal removal rate in a flow-through treatment system is paramount, a series of experiments were conducted to determine how to best increase metal removal rates by adjusting the flow rate and cell current density. The range of operating conditions examined is given in Table 2 and Table 3. The range of flow rates encompassed an acceptable range for a pilot-scale system, such as that described above and illustrated in FIGS. 6 and 7 using the batch-mode process flow scheme illustrated or a flow-through variation thereof. In initial studies (summarized in Table 2), the same fluid was circulated in the anolyte and catholyte chambers (as illustrated in FIG. 10A), drawn from the same reservoir without electrically isolating the anolyte and catholyte chambers. In subsequent studies (summarized in Table 3), the anolyte fluid and the catholyte fluid were separate, similar to the configuration illustrated in the fluid flow diagrams of FIGS. 9 and 10B. Initial metal concentrations were near 200 mg/L, as it is most challenging to reduce metal concentrations to below this level. The feed solutions contained sulfuric acid, $H_2SO_4$, and had an initial pH near 2 (0.01 N) to simulate the pH associated with dilute leaching solutions, spent process liquids and acid mine drainage. Experiments were conducted in either constant voltage control (designated CV) or constant current (designated CC) control. Current density was calculated based on the measured current applied to the electrolysis cell divided by the geometric cathode area, which was measured at about 258 $cm^2$. Faradaic efficiencies were calculated by the ratio of the amount of metal removed from the feed solution divided by the theoretical amount of metal that could be removed times 100%. The theoretical amount of metal that could be removed was calculated from the amount of current passed during an experiment (theoretical amount of metal that could be reduced) relative to the actual amount of metal reduced using the equation: [current(amp=C/s)×time(s)×$6.241e^{18}$ electrons/C×0.5 (2 electrons per divalent metal atom)÷ Avogadro's No.=moles of metal]. Several results were unexpected therefore some quantities were estimated initially.

Copper Removal

Figure 13:
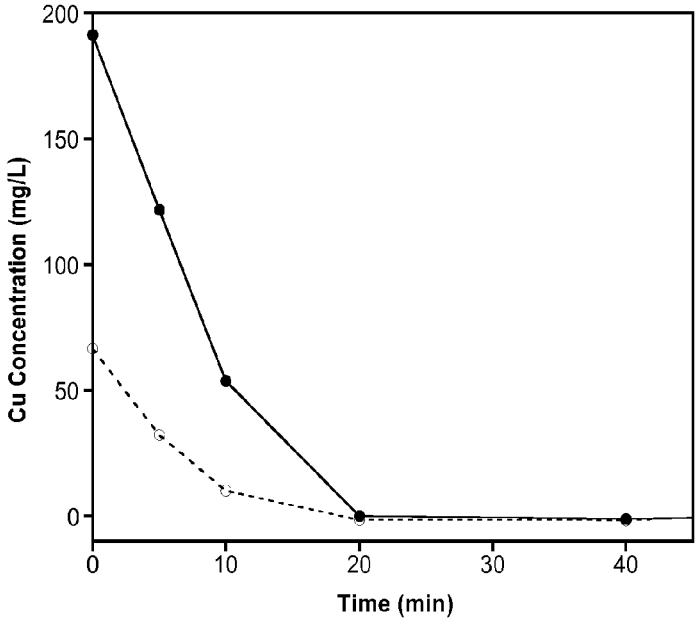
FIG. 13 is a graph showing the results of exemplary copper removal tests at different concentrations of copper in the feed solution.
Figure 14:
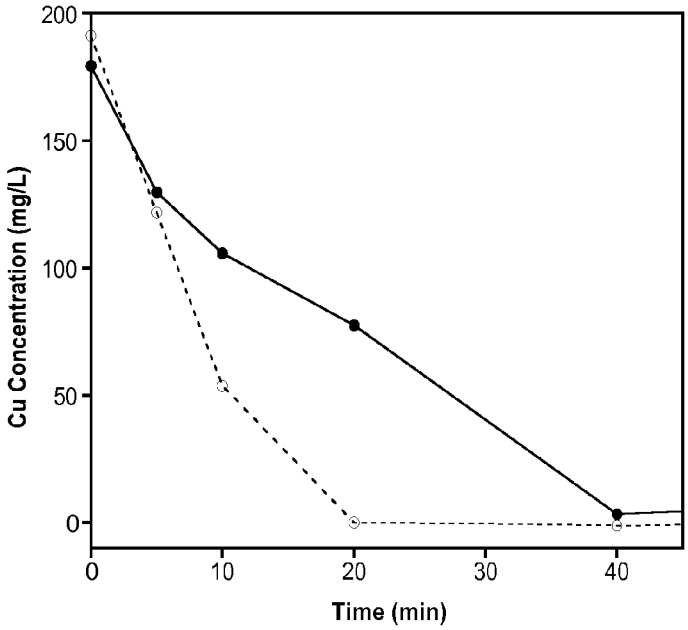
FIG. 14 is a graph showing the results of other exemplary copper removal tests carried out with different volumes of feed solution.
Figure 15:
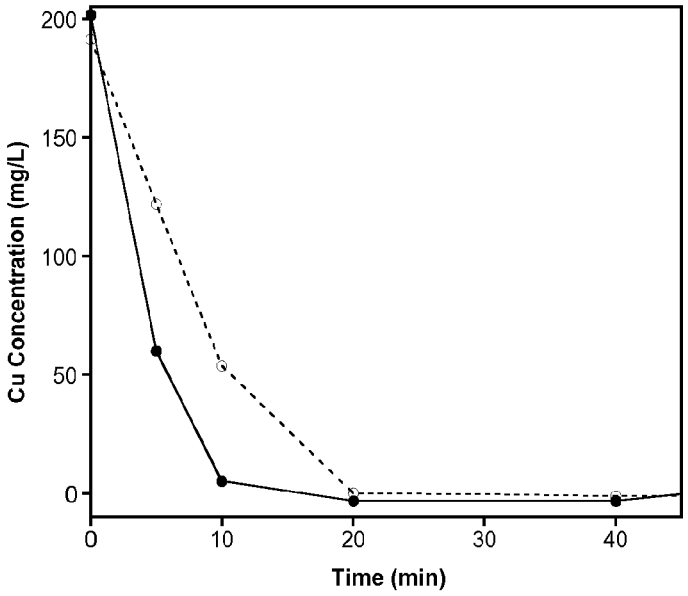
FIG. 15 is a graph showing the results of exemplary copper removal tests at different feed solution flow rates than those of FIG. 14.

Copper removal performance from 0.1 M $H_2SO_4$ (pH 0.7, 200 mg/L Cu) indicated that the rate of copper removal is diffusion limited at the low concentrations of interest. This was clearly shown by the concentration, volume, and flow rate dependencies of copper removal rate. Ex. No. 1 (66.6 mg/L initial Cu conc.) and Ex. No. 4 (191.3 mg/L initial Cu conc.) both required nearly the same amount of time (about 20 min) to reduce the 7 L feed solution concentration to <4 mg/L at the same flow rate and cell voltage (FIG. 13). Open Circles=Ex. No. 2. Solid circles=Ex. No. 4. Increasing the feed solution volume to 12 L essentially doubled the time to reduce the same initial concentrations for trials Ex. No. 4 (7 L, 191.3 mg/L Cu feed solution) and Ex. No. 5 (12 L, 179.5 mg/L Cu feed solution) shown in FIG. 14. In FIG. 14, open circles=Ex. No. 4, 7 L, and solid circles=Ex. No. 5, 12 L. The geometric cathode area in these studies was 180 $cm^2$, and the 20 minute and 40 minute time points represent 12.5 and 25 turnovers, respectively, of the 7 L feed solution, at a flow rate of 7.5 Lpm. A third comparison showed that increasing the feed solution flow rate by a factor of three through the cathode increased rate of copper removal by nearly a factor of two for Ex. No. 4 (7.5 Lpm, 191.3 mg/L Cu feed solution) and Ex. No. 7 (22.4 Lpm, 201.8 mg/L Cu feed solution) shown in FIG. 15.

For Ex. No. 1 (Cu) in Table 2 the copper concentration was reduced to about 0.4 mg/L after 20 min and to 0.09 mg/L after 60 min of run time. This is lower than the copper concentration measured in the municipal tap water in the building (~0.1-0.2 mg/L) and is much lower than the action limit for copper in drinking water (1.3 mg/L). This clearly demonstrates the potential for water polishing at low metals concentrations by this electrolytic technology.

Figure 16:
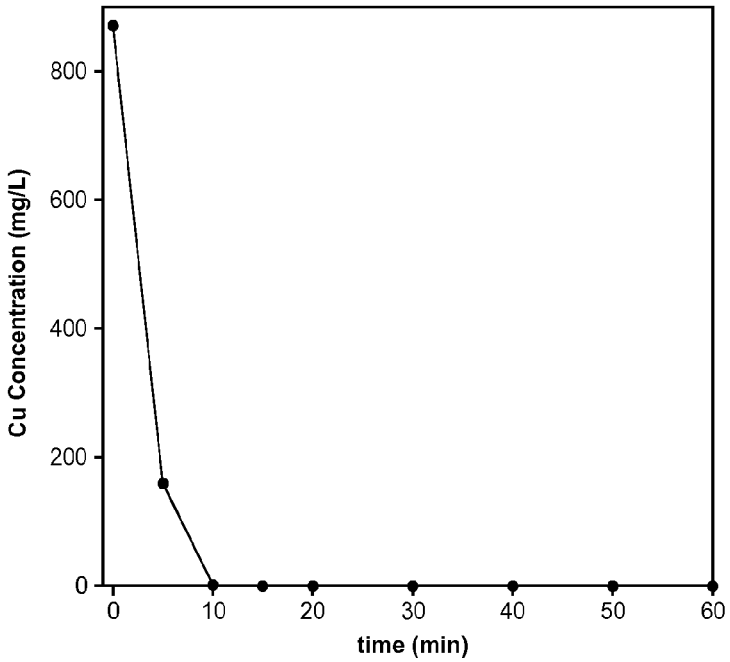
FIG. 16 is a graph showing the results of another exemplary copper removal test.

The most significant results for copper removal were obtained from Ex. No. 10 (Cu) in Table 2 (FIG. 16) in which the higher initial concentration of 872 mg/L was reduced to 1.7 mg/L in the first 10 minutes and to 0.4 mg/L after 15 min. The 10 minute point represents 19.7 turnovers of the 7 L feed solution, at a flow rate of 13.8 Lpm. This results in very high recovery rates, 36.5 g/h. Given that the electrolytic cell is being operated at only half its cathode bead capacity, a modest scale-up (4×) will result in a single electrolytic cell that can recover about 146 g/h or 11*b* every 15 h with power costs absorbed by solar-powered system. One technical issue that occurred was partial agglomeration (seizing) of the cathode beads due to the high rate of copper deposition. A higher cathode spouting rate will prevent this from occurring.

Nickel Removal

Nickel removal was investigated first under the same conditions used above for copper (0.1 M $H_2SO_4$, pH 0.7) and then at lower acid concentration (0.01 M $H_2SO_4$, pH 1.7) with low and high flow. Overall, the higher pH resulted in higher initial nickel removal rates while low feed flow of the catholyte allowed nickel removal to occur (high feed flow minimized nickel removal).

In Table 2, Ex. 6 (Ni) showed a 35.8% reduction of its initial concentration (7.5 Lpm, 185.8 mg/L Ni, 0.1 M $H_2SO_4$ feed solution), FIG. 11 (solid squares=Ex. 6 (Ni)). Removal of nickel was slow over the test period at ~7.5 Lpm feed flow rate. Almost no nickel removal occurred at the higher 23 Lpm feed flow rate in Ex. 8 (open squares). The reduction potential of Ni is −0.257 V more negative than the hydrogen reduction potential (Table 1) and was obviously affected by this.

Ex. 11 (Ni) (solid circles in FIG. 11) showed a 33.2% reduction of its initial concentration with feed solution conditions of 178.5 mg/L Ni, 0.01 M $H_2SO_4$, 13.6 Lpm flow rate. The initial reduction rate for the first 10 min (22 mg/min) was 4.2 times the removal rate over the following 70 min (5.2 mg/min). The initial removal rate was much faster than that of the first trials at 0.1 M $H_2SO_4$. The same test conditions (0.01 M $H_2SO_4$) were used with a feed flow rate of 23 Lpm in Ex. 12 (Table 2) also resulting in a high initial removal rate of 25 mg/min in the first 10 min.

Zinc Removal

Figure 18:
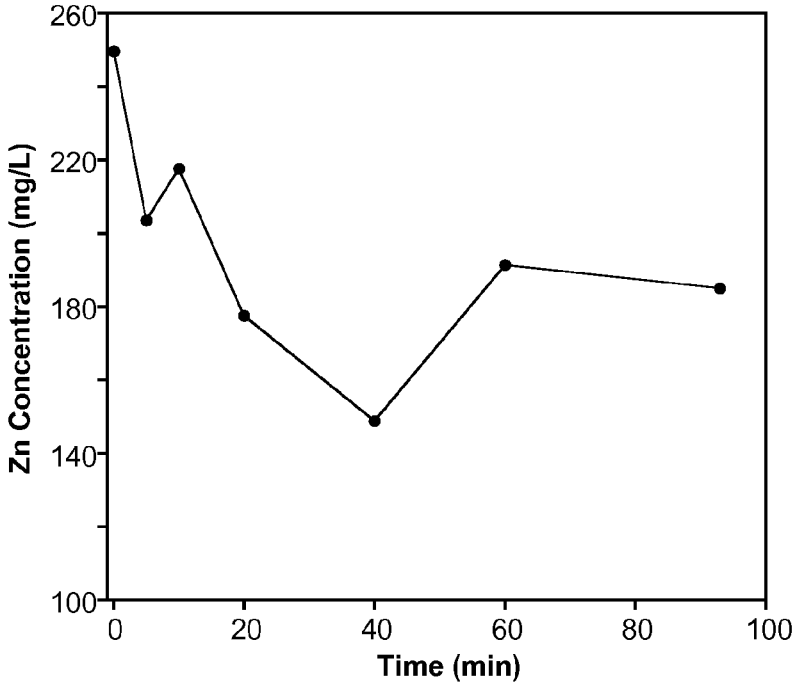
FIG. 18 is a graph showing the results of an exemplary zinc removal test.

Zinc removal was investigated under the best conditions used above for nickel (0.01 M $H_2SO_4$, pH 1.7, 6.7 Lpm feed flow). Two tests, Ex. 13 and Ex. 14 in Table 2, provided very similar results in that the initial zinc concentration was rapidly reduced during the first 10-20 min followed by little change in the concentration. The results for Ex. 14 are shown in FIG. 18. The zinc removal experiment of FIG. 18 was carried out in a system configured as shown in FIG. 10*a*, in which the anode and cathode solutions were not electrically isolated. This configuration allows current densities to be increased for electrowinning of zinc without excessive voltage levels that result in high power consumption. The removal of zinc looked very promising for the first 40 min, 40% removal, until the feed solution was pH neutral. The reduction potential of Zn is −0.762 V more negative than the hydrogen reduction potential (Table 1) and was affected by this.

pH Conditioning

During the initial studies of MSET removal of Ni, Zn, and Mn from 0.01 M $H_2SO_4$ solutions the pH was shifted relatively rapidly to pH neutral. This occurred within 20-30 min due to rapid consumption of acid protons for hydrogen production. Longer treatment time was required to neutralize 0.1 M $H_2SO_4$. Neutralization of the test solutions from pH 1.7 occurred fairly rapidly indicating that higher pH levels more often encountered (pH 2-3) will be easily neutralized by this electrolytic process. It was observed several times that, after the acid protons were removed and the feed solution was neutralized, the cathode beads can become the most reactive part of the system resulting in re-dissolution of metals or precipitation of metal oxides/hydroxides. Accordingly, the treatment times in most situations is kept shorter than the pH neutralization times. When the MSET system is intended for use in treating acid mine drainage (AMD), for example, neutralization of mine drainage pH is desirable, so that no post-conditioning of the effluent is necessary.

Faradaic Efficiencies

Very good Faradaic efficiencies were obtained for copper removal with >80% being an achievable goal at a copper concentration below 200 ppm. This is an improvement over the Faradaic efficiencies typically obtained with the prior fluid-spouted electrolytic cell. When Faradaic efficiencies were greater than 100% an electroless deposition process was thought to be active. Faradaic efficiencies for nickel and zinc were poor (on the order of 12-20%) due to the slow removal rates from solution. Lowering the feed flow rate and raising the pH helped to increase deposition rates/efficiencies for these metals. This may indicate that the co-generation of hydrogen inhibits the deposition of these metals at lower flow rates. Higher flow rates are necessary to overcome mass transport limitations created by a high gas bubble load on the cathode surfaces.

The large difference in metal removal efficiencies between metals with positive and negative reduction potentials will allow a system to be designed with high selectivity in metal removal. The direct benefit is partial or complete refinement of metals being recovered by this electrolytic system, thus increasing the sale value of metals recovered. This was demonstrated for the case of recovering copper from a solution containing both copper and iron shown in FIG. 17.

Example 3

Metal Oxide Production

During the course of carrying out the foregoing studies it was discovered that when the anode and cathode solutions were isolated from one another, a partial electrical short from the system was eliminated, and greatly reduced the current density (at constant voltage) at the cathode by about 10 times. This was found to be important for scale-up reactor process design, since the partial electrical short had not been previously identified and its contribution to the current density would change with changing reactor size and with the number of reactors in series. The greatly reduced current density allowed for a new process/production capability of this technology to be discovered, i.e., the selective production of reduced metal oxides by partial reduction of target metals in the presence of dissolved oxygen. This has not been previously described with respect to spouted cathode reactor technologies. Two of the metal oxides the system produced directly from solution are cuprous oxide ($Cu_2O$) and iron ferrite ($Fe_3O_4$). Both of those materials are of great commercial value and this new production method has the potential to significantly reduce their production costs compared to current methods.

In the studies summarized in Table 3, the anolyte fluid and the catholyte fluid were separate. FIG. 9 is a fluid flow diagram illustrating one such configuration.

Example 4

Isolation of Anolyte and Catholyte Fluids

As discussed above with respect to Table 1, the electrolytic reduction potentials of metal ions has the greatest influence on their electrolytic deposition/removal from waste streams. Secondary, yet important effects are reaction kinetics, or reduction/oxidation rates, at electrode surfaces. Competing reduction/oxidation processes are also important in some circumstances such as processing iron group metals. Two important reference potentials are indicated in italics in Table 1 for proton reduction resulting in hydrogen production (defined as 0.0 V) and water reduction that results in production of hydrogen and hydroxide (−0.8277 V). The competition between metal reduction and hydrogen production/re-oxidation becomes less favorable as potential becomes more negative. Hydrogen reduction can be shifted more negative by the use of additives that increase the reduction overpotential or making the process kinetically less favorable. At more negative potentials water reduction occurs and water itself will oxidize metals with more negative reduction potentials. For all of these reasons, reducing metals with more negative potentials in acidic, aqueous media is challenging.

Example 5

Copper Removal (Isolated Catholyte and Anolyte)

The removal of copper from relatively dilute sulfuric acid solutions was initially examined with a MSET system similar to that shown in FIGS. 2A-B with anolyte and catholyte fluid flow configured like that shown in FIG. 10A, i.e., not isolated from each other. This allowed performance differences to be identified by direct comparison with previous work using a SET system like that shown in prior art FIG. 1. Copper(II) sulfate pentahydrate was dissolved in 0.01 $NH_2SO_4$ to make nominally 200 mg/L copper feed solutions at pH 2. Feed solution volume was 12 L. The feed solution was put into the cathode feed reservoir (see FIG. 9). The prepared copper coated shot (#7, ~2 mm diameter) was used as the cathode substrate (−645 $cm^3$). System startup proceeded by turning the magnetic spout drive and the anode solution pump (anolyte: 3 L, 0.01 $NH_2SO_4$, 420 mL/min) first. Then the catholyte feed pump was turned on and the flow rate set between 5 and 13 L/min. Finally, the cell power supply was turned on at the desired voltage (for constant voltage experiments) or current (for constant current experiments). Cathode fluid samples were collected at regular time intervals from the reservoir (except for flow-through mode) and the cell voltage and current were recorded.

The rate of copper removal was determined from the analysis of copper remaining in the feed solution. Analysis of dissolved copper was conducted by colorometric analysis using the CuVer2™ color indicator reagent purchased from HACH, Inc. Sample preparation was conducted by using the indicator reagent as instructed and visible spectroscopic measurements were made using a Hewlett Packard Model 8453 UV-Vis Spectrophotometer. A 1 cm pathlength solution cell was suitable for detecting copper in the concentration range of ~0.1 to 10 mg/L. A linear five-point calibration curve of concentration versus absorbance was first made with prepared copper standard solutions (0, 0.5, 1, 2, 5, mg/L).

Figure 19:
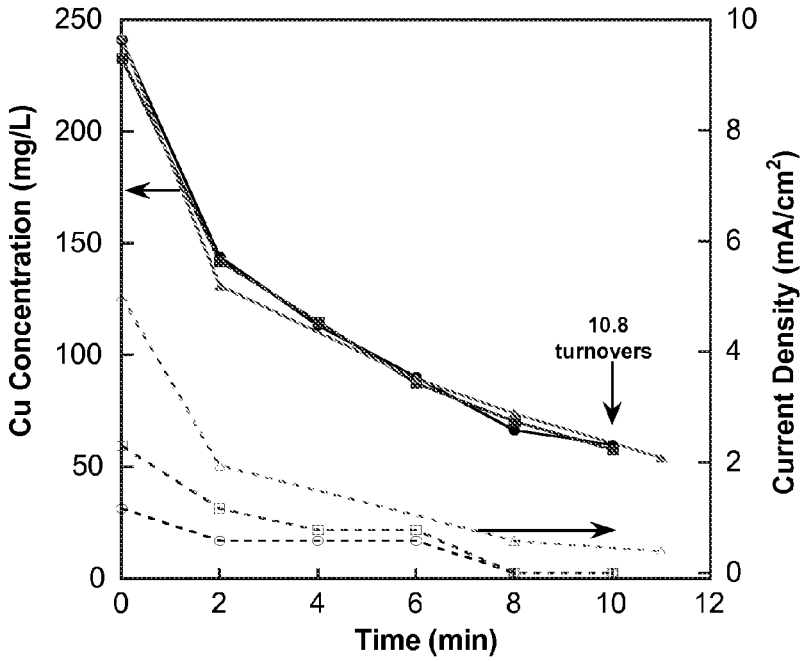
FIG. 19 is a graph showing the results of copper removal tests at constant voltage control at 13 L/min feed flow.

Further experiments were first conducted under constant voltage control with the catholyte and anolyte solutions isolated from each other as in FIG. 9. The removal of copper at constant potentials of 0.83, 1.4, and 2.0V was conducted over a ten minute period with about the same feed flow rate of 13 L/min. These results are shown in FIG. 19. The solid symbols are copper concentration; open symbols are current density. The circles are 0.83V (Ex. 16 in Table 3); squares are 1.4 V (Ex. 18 in Table 3); and triangles are 2.0 V (Ex. 19 in Table 3) There was no discernable difference for removal rate based on voltage even though the current densities increased with increasing voltage. No gaseous hydrogen was observed to be produced at the cathode at these voltages/current densities. The feed solution pH did increase slightly from about 2.2 to 3.5 indicating the consumption of acid protons either by hydroxide produced by reduction of dissolved oxygen or simply reduction of acid protons at a slow rate.

Figure 20:
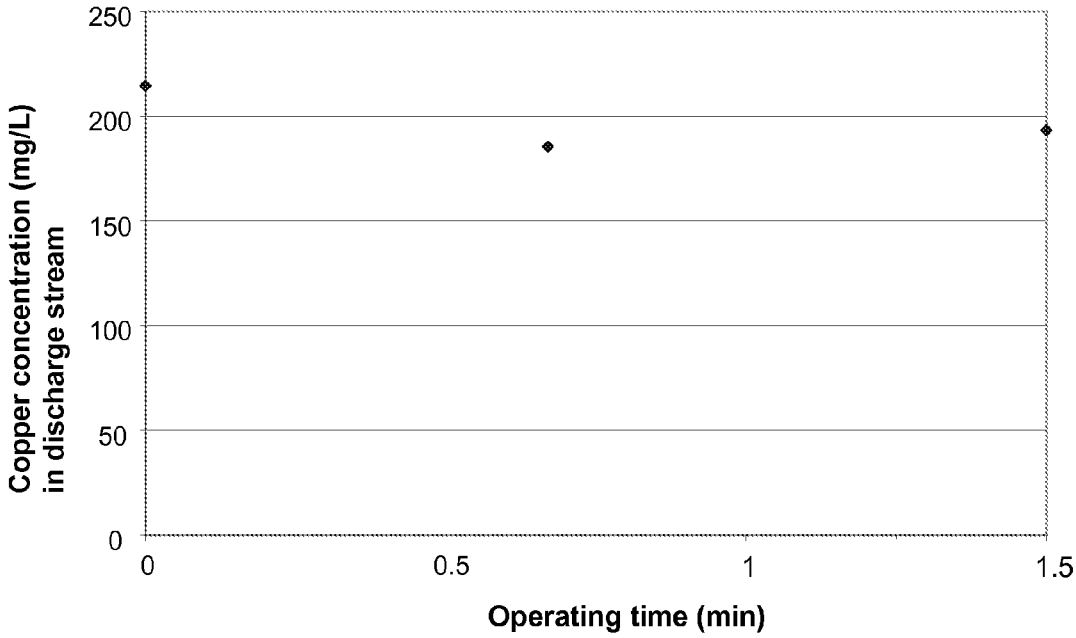
FIG. 20 is a graph showing the results of a single-pass copper removal test of a 215 mg/L Cu feed solution at pH 2.

Copper removal was also examined in single-pass flow-through operating mode. For these experiments a second reservoir was added above the cell (see FIG. 9) for the feed solution (standard composition, 12 L), and the original reservoir was used as the terminal receiving container. The feed flow rate was set at ~8.5 L/min with a current density of 1.16 $mA/cm^2$ in constant current control. Samples were taken from the discharge stream before mixing in the receiving container. The feed concentration of copper was 215 mg/L (average of four measurements) and the discharge concentration was 185 mg/L. The removal of 30 mg/L copper in a single pass is greater than the above removal rate per turnover in batch mode even when normalized to the same flow rate (assuming a linear change with flow rate). This difference is expected since in batch-mode the feed solution in the reservoir reconcentrates the depleted discharge stream. FIG. 20 is a graph showing the single-pass operation data for the copper recovery test "Ex. 25" listed in Table 3.

Figure 21:
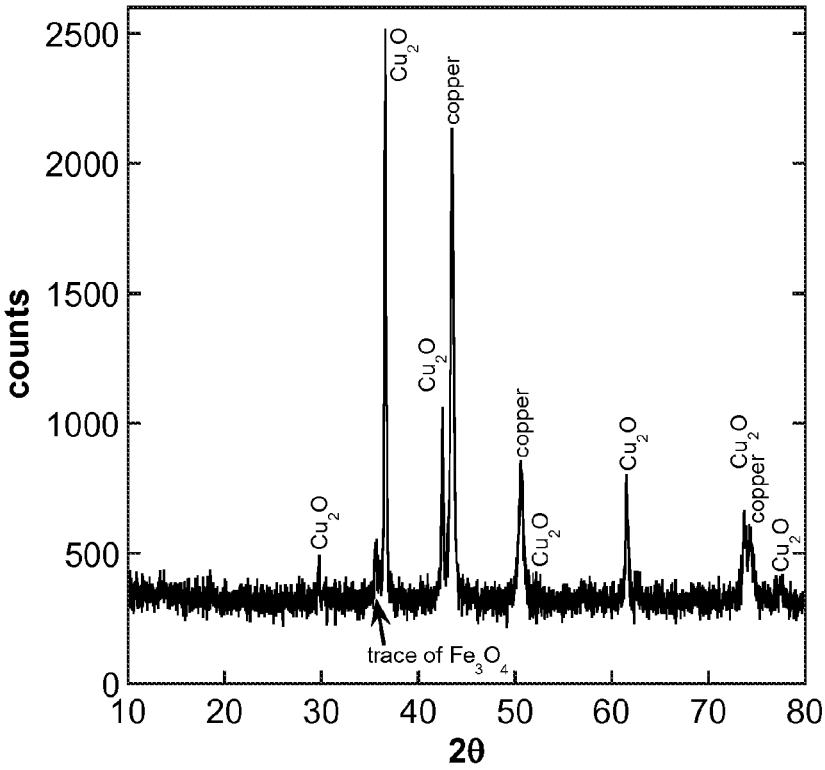
FIG. 21 shows the x-ray diffraction pattern of reduced copper metal and cuprous oxide powder produced in one embodiment of a process according to the invention.

In the experiments described in Table 3, the Faradaic efficiencies were calculated in excess of 100% by one to two orders of magnitude indicating that electroless deposition or reduction processes were occurring. The current response of the reactor may indicate that the initial current applied serves to initiate electroless copper reduction. The application of an applied voltage is still required to perpetuate the copper reduction processes as indicated in the constant current experiments. The terminal reductant that would have to account for the large amount of charge not measured in the applied cell current is not immediately obvious. The reductant could be hydrogen produced at the cathode, although producing it from the acid would also require passage of charge. The more likely explanation is the exposed steel of the cathode particles' core behaving as a sacrificial anode for copper reduction. This activity is similar to the commercial cementation process used for copper precipitation from solution. The end result, however, is that very low current densities will promote copper removal from water. The solids produced in all of the copper experiments were dark red-black to brown powders that were flushed from the reactor (no cathode removal necessary for product recovery). X-ray diffraction analysis of about 1.5 grams of solids recovered from experiment number "18" in Table 3 (1.4 V, 13 L/min) showed approximately a 1:1 mixture of copper metal and $Cu_2O$ powder, FIG. 21.

The multi-gram quantities of $Cu_2O$ production has not been reported before for a spouting electrolyte technology. Previously, the production of copper metal was nearly exclusive at higher current densities (>45 mA/cm$^2$). $Cu_2O$ appears to be produced by incomplete reduction of $Cu^{2+}$in the presence of water and/or an oxygen-containing gas through a complex series of partial reductions and/or oxidations. For copper metal recovery, the current density threshold (at 0.8 V) appears to be near 1.16 mA/cm$^2$ geometric cathode area (~15.5 μA/cm$^2$ absolute cathode area calculated by assuming close-packed 2 mm spheres using the Kepler conjecture). At this current density the amount of copper versus cuprous oxide formed is about 1:1. At higher current densities (at 0.8 V) near 45-80 mA/cm$^2$ geometric area copper metal is almost exclusively produced (previous work). These results indicate that the production of pure $Cu_2O$ should be promoted at even lower current densities in the presence of additional oxygen injected into the solution.

Figure 22:
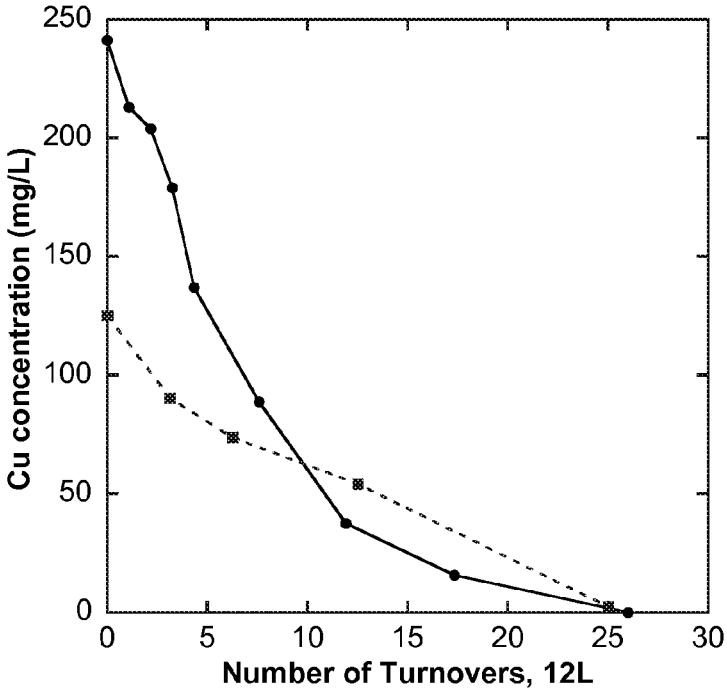
FIG. 22 is a graph comparing the copper removal performance (at constant voltage) obtained with isolated catholyte and anolyte solutions (circles) compared to the copper removal performance under similar conditions when the catholyte and anolyte solutions were combined (squares).

Copper removal rate from solution was approximately 25% greater than the previous configuration (of FIG. 10A) at 100 times lower current density based on the number of turnovers of the feed solution volume through the reactor. This difference is shown in FIG. 22 comparing constant voltage experiments from a MSET cell to that of a prior SET cell under similar operating conditions (cathode area normalized). Voltage was constant at 0.82 V, 12 L feed). Circles indicate the data points for the MSET system and process, and the squares are the data points for the prior SET system and process. The initial current density in this work was near 0.4 mA/cm$^2$ while the initial current density in the previous configuration was near 50 mA/cm$^2$. This is on the order of a 100 times lower cell power consumption with better copper removal rates. At constant voltage control the copper removal performance of Ex. 24 in Table 3 (FIG. 22) shows a reduction of copper concentration from 240 mg/L to <50 μg/L (undetectable) in 24 minutes.

Figure 23:
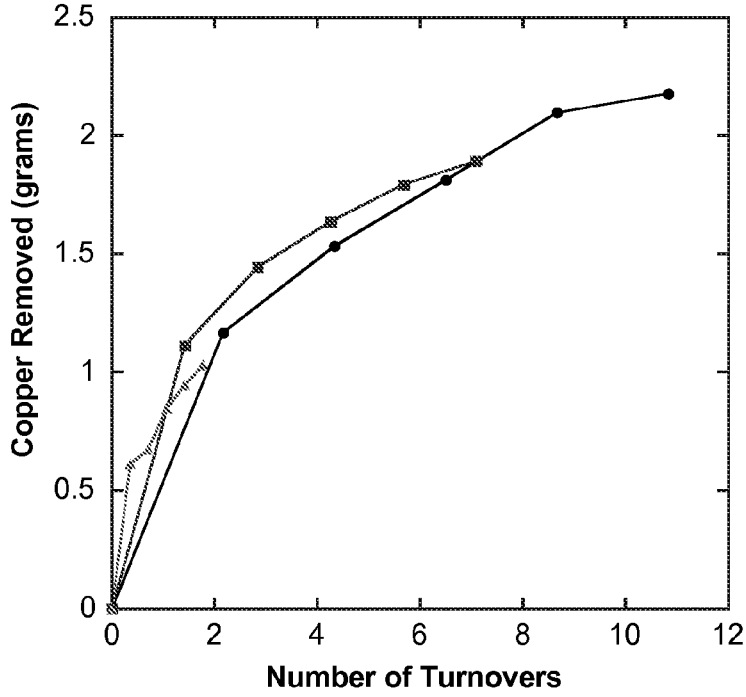
FIG. 23 is a graph showing copper removal performance at different feed flow rates at constant voltage, in a representative test carried out with isolated catholyte and anolyte solutions.

Initial rates of copper removal at three different flow rates at 0.83 V (constant voltage, 12 L) increased with increasing flow rate, but removal rates were almost constant with number of feed solution turnovers. In FIG. 23, circles=13 L/min; squares=8.5 L/min; and triangles=4.25 L/min, corresponding to Ex. Nos. 16, 19 and 21 (in Table 3), respectively. Higher flow rates give faster turnover rates in recirculated batch processing. The results shown in FIG. 23 indicate that the amount (mass) of copper removed from solution per feed volume turnover is nearly the same at the three feed rates tested: 13, 8.5 and 4.25 L/min. In these experiments the same voltage/current density appears to remove about the same amount of copper per turnover. The lower concentration limit may be limited somewhat by feed flow rate. These results indicate that the feed solution residence time and current density are major parameters to optimize when targeting single-pass flow-through metal removal.

Figure 24:
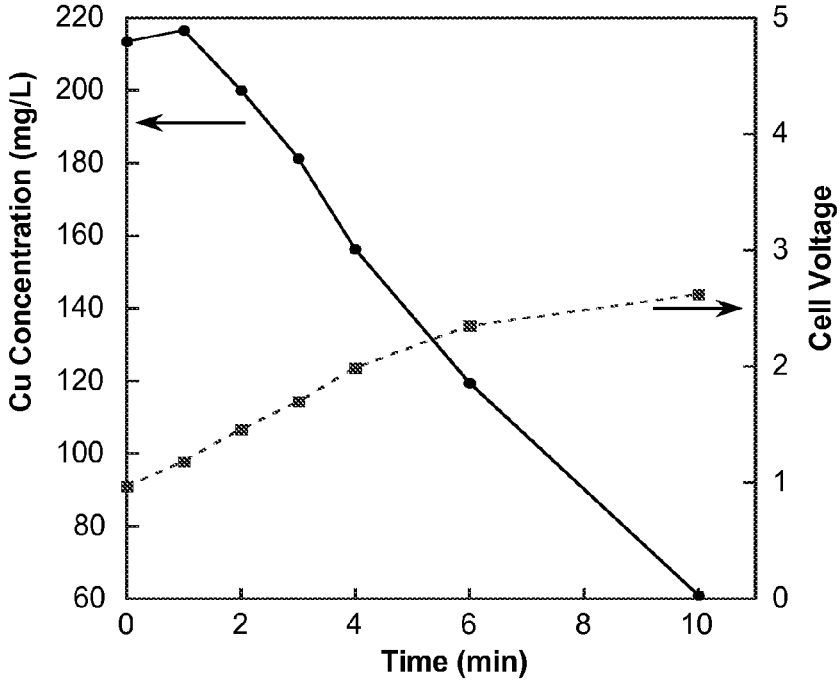
FIG. 24 is a graph showing copper removal performance at constant current and constant flow rate in a representative test carried out with isolated catholyte and anolyte solutions.

Copper removal under constant current control (1.16 mA/cm$^2$, 13 L/min) was essentially linear with concentration and time after the initial startup period (0-1 min) (Ex. 23 in Table 3). As shown in FIG. 24, the copper concentration decreased from 217 mg/L to 61.0 mg/L (Δ155 mg/L) in nine minutes, or 9.75 turnovers of the 12 L feed solution. The reduction of copper concentration per turnover is about 16 mg/L. This shows that current density does control copper removal rates, even when electroless deposition/reduction processes are occurring. The cell power consumed also increases with decreasing concentration since the cell voltage increases as cathode overpotential increases at lower copper concentrations. These results indicate that the removal rate of copper can be made linear with constant current control. The primary trade-off is cell power, which is small compared to typical pumping costs. Under constant current control the reduction of copper concentration from 215 mg/L to 0.1 mg/L (drinking water standards are <0.4 mg/L Cu) is expected to take 8.5 minutes assuming a linear fit to the data in FIG. 24.

Example 6

Nickel-Iron Removal

The removal of nickel was initially intended, but the degradation of the prepared copper coating on the cathode beads, which appeared to spall off, resulted in some dissolution of iron from the steel shot during these experiments. The result was mixtures of 200 mg/L nickel (as $Ni^{2+}$) and approximately 200-500 mg/L iron (as $Fe^{3+}$). What was found in these experiments was the surprising production of iron ferrite during the first several minutes of operation, followed by partial removal of nickel, most likely as nickel metal.

Nickel(II) sulfate hexahydrate was dissolved in 0.01 N $H_2SO_4$ to make nominally 200 mg/L nickel feed solutions at pH 2. Feed solution volume was 12 L. The feed solution was put into the cathode feed reservoir (see FIG. 9). The prepared copper coated shot used in the copper studies was used as the cathode substrate (about 645 cm$^3$).

A system configured as shown in FIG. 9 was employed. System startup proceeded by turning the magnetic spout drive and the anode solution pump (anolyte: 3 L, 0.01 $NH_2SO_4$, 420 mL/min) first. Then the catholyte feed pump was turned on and the flow rate set between 5 and 13 L/min. Finally, the cell power supply was turned on at the desired voltage (for constant voltage experiments) or current (for constant current experiments). Cathode fluid samples were collected at regular time intervals and the cell voltage and current were recorded.

The rate of nickel removal was determined from the analysis of nickel remaining in the feed solution. This analysis was very problematic in the presence of dissolved iron. Four approaches were attempted, three involved iron oxidation or precipitation, pH adjustment and complexation with a color indicator. The final preparation and analysis method that worked was particle filtration of the raw samples, which were then analyzed directly for the $Ni^{2+}$ $(H_2O)_6$ species. The $Ni^{2+}$ d→d transition absorbance band at ~0.395 nm does not overlap with those of $Fe^{2+}$ or $Cu^{2+}$ and has minimal interference from $Fe^{3+}$ as baseline offset. Visible spectroscopic measurements were made using a Hewlett Packard Model 8453 UV-Vis Spectrophotometer. A 30 cm pathlength solution cell was suitable for detecting nickel in the concentration range of ~0.5 to 1800 mg/L. A linear four-point linear calibration curve of concentration versus absorbance was first made with prepared copper standard solutions (0, 10, 56.1, 112.25, 224.5 mg/L).

Figure 25:
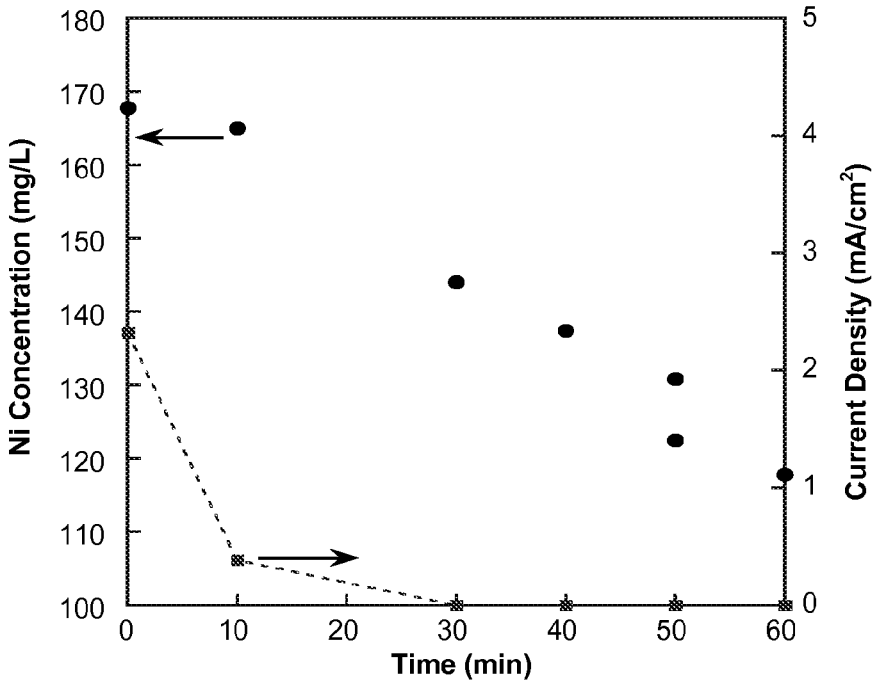
FIG. 25 is a graph showing nickel removal under constant voltage control and constant flow rate in a representative test carried out with isolated catholyte and anolyte solutions.

In general, nickel was removed slowly relative to copper at the low voltages and current densities tested (2-3 V, 0.4-0.6 mA/cm$^2$). Nickel reduction seemed to be disrupted by dissolution of the iron cathode substrate or reduction of dissolved of iron to solid iron products that fouled the cathode surface. A clear example of nickel removal from solution is shown in FIG. 25. This experiment was conducted under voltage control at 2.0 V. At this voltage there was not any visible evolution of hydrogen gas. After the first 20 minutes of run time the concentration of nickel was depleted from its initial 168 mg/L to 118 mg/L over the next 40 minutes. This equates to the removal of 0.60 g of nickel, or 15 mg/min removal rate. As for the copper studies, the Faradaic efficiency of nickel removal exceeded 100% by a significant amount, about 10 times, indicating electroless deposition/reduction processes were active. A higher removal rate of 43 mg/min was achieved in Ex. 26 (the highest observed yet), but the data is less reliable due to dissolved iron ($Fe^{3+}$) interfering with the analysis. The dissolved iron concentration (from the cathode beads) was estimated at 200-500 mg/L based directly on the optical spectra used for nickel analyses. Increasing the voltage to 3.0 V or operating under current control at 0.6 mA/cm$^2$ did not increase nickel removal rate.

Figure 26:
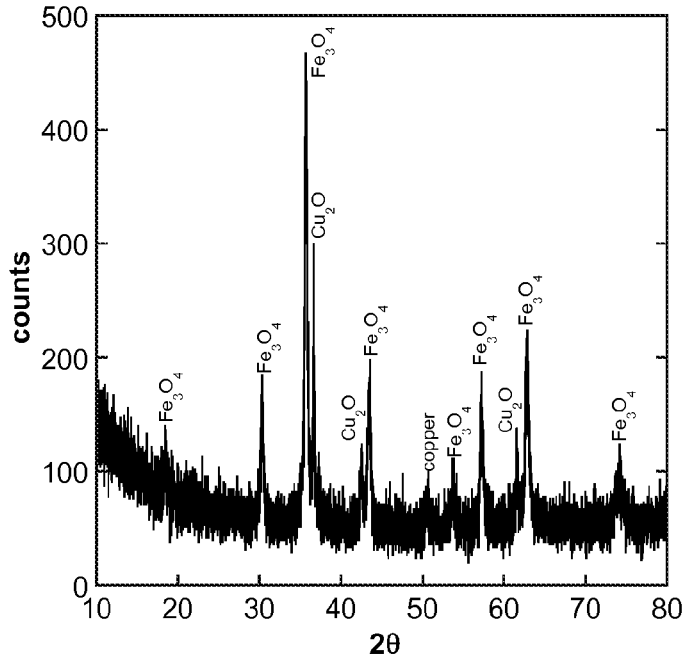
FIG. 26 shows the x-ray diffraction patterns of iron ferrite powder produced in a representative test carried out with isolated catholyte and anolyte solutions.

During the first 10-20 minutes of each test a significant amount (several grams) of dark/black fine solid was generated in the feed solution. It was determined by X-ray diffraction and elemental analysis (by energy dispersive X-ray analysis, EDX) that this solid is iron ferrite ($Fe_3O_4$). Its persistent production was selective for iron ferrite, an inverse spinel-structured oxide, in multi-gram quantities from a mixture of nickel and iron. This is the most surprising result of the program since $Fe_3O_4$ is a highly refractory material that is normally produced synthetically by solid state reaction of oxides or carbonate precursors at high temperatures (>1000° C.) or under extreme hydrothermal conditions around 600° C. The X-ray analysis in FIG. 26 shows the pure, crystalline spinel phase isolated from Ex. 26 (residual copper/$Cu_2O$ from the previous experiments contaminated the sample). About 3 g of fine powder were recovered from this experiment. The particle size of the powdered iron ferrite was analyzed by scanning electron microscopy (SEM) and nitrogen gas sorption surface area analysis. SEM images show compacted grains that are less than 0.2-0.5 μm across. Surface area analysis indicates that these solids are composed of smaller particles with measured surface area of 37.1 m$^2$/g and a calculated mean diameter of 31 nm (assuming dense spheres the diameter=6÷ (5.18 g/cm$^{3\times37.1}$ m$^2$/g)). In either case, the particles are small enough to eliminate the extensive grinding necessary in commercial production to make powders for object forming.

Example 7

Zinc Removal

The removal of zinc from sulfuric acid solutions was examined because zinc is a very reactive metal to acid solutions and represents a significant challenge for electrowinning without the use of additives (ammonium salts, glucose, surfactants) to assist in zinc reduction. Zinc(II) sulfate pentahydrate was dissolved in 0.01 $NH_2SO_4$ to make nominally 200 mg/L zinc feed solutions at pH 2. Feed solution volume was 12 L. The feed solution was put into the cathode feed reservoir. Zinc plated #7 steel shot (purchased) was used as the cathode substrate (~645 cm$^3$).

Figure 27:
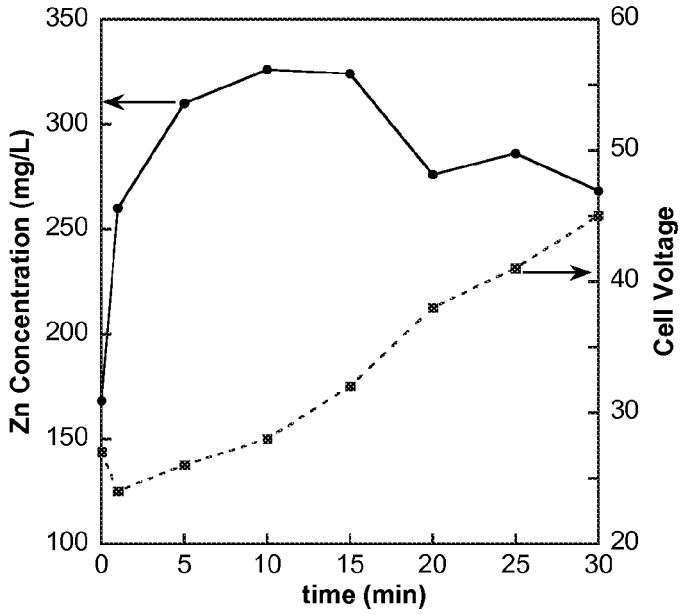
FIG. 27 is a graph showing zinc removal performance at constant current and constant flow rate, in a representative test carried out with isolated catholyte and anolyte solutions.

A system configured as shown in FIG. 9 was employed for carrying out the test shown in FIG. 27. System startup proceeded by turning the magnetic spout drive and the anode solution pump (anolyte: 3 L, 0.01 $NH_2SO_4$, 420 mL/min) first. Then the catholyte feed pump was turned on and the flow rate set between 5 and 13 L/min. The cell power supply was turned on as soon as liquid hit the cathode to prevent removal of the zinc coating from the shot. The power supply was set at the desired voltage (for constant voltage experiments) or current (for constant current experiments). Cathode fluid samples were collected at regular time intervals from the reservoir or discharge stream and the cell voltage and current were recorded.

The rate of zinc removal was determined from the analysis of zinc remaining in the feed solution. Analysis of dissolved zinc was conducted by colorometric analysis using the ZincoVer™ color indicator reagent set purchased from HACH, Inc. Sample preparation was conducted by immediately filtering zinc particles off of the samples (to prevent re-dissolution) and using the indicator reagents as instructed. Visible spectroscopic measurements were made using a DR890 HACH meter (accuracy was confirmed with a Hewlett Packard Model 8453 UV-Vis Spectrophotometer). A linear four-point calibration curve of actual concentration versus the DR890 HACH meter concentration response was first made with standard zinc solutions.

At low current densities near 4.65 mA/cm$^2$ (regardless of voltage) the removal of zinc did not occur. In fact the acid corrosion of the cathode's zinc coating occurred as indicated by an increase in solution concentration of zinc and corrosion/tarnishing of the cathode beads. At higher current density, 11.6 mA/cm$^2$, there was no net gain or loss of zinc from solution at 448 mg/L (trial G14-23). Corrosion rate of the cathode's zinc coating was suppressed, but the current density was not great enough to drive reduction of zinc from solution at a greater rate than corrosion.

At the highest current densities tested, 58.1 and 69.8 mA/cm$^2$, the removal of zinc did occur. A representative test, shown in FIG. 27, was run at 58 mA/cm$^2$ (constant current) and 13 L/min. In FIG. 27, the zinc concentration initially increases while the system power is being set and the process equilibrates (first 5-10 min). The zinc concentration then decreases as it is reduced out of solution. Some form of zinc metal was recovered as a dark grey powder, whose phase could not be identified by X-ray analysis, but this powder did evolve hydrogen gas when put in acid and dissolve while turning light in color. The zinc removal rate in FIG. 27 is approximately 35 mg/min (0.70 g removed in 20 min) at a Faradaic efficiency of about 11.4%. The low efficiency is due to charge being consumed by water reduction/hydrogen evolution at this high current density.

At slightly higher current density, 69.8 mA/cm$^2$, but lower feed flow rate, 7 L/min, the removal of zinc was slower (Faradaic efficiency of 3.1%). The lower flow rate appears to be reducing the removal efficiency on a feed-volume turnover basis indicating that the space velocity through the cathode bed is an important parameter for a reactive/corrosive metal like zinc. The zinc plated cathode beads remained shiny throughout this experiment with only a little zinc lost to solution during startup. At lower feed flow there was much less zinc-like powder flushed from the reactor than at high flow (13 L/min).

At the higher current densities used for zinc removal there were significant pH shifts measured for the feed solution and anolyte solution. For Ex. 33 (Zn) the feed solution pH increased from 2.5 to 4.7 during the 30 min experiment. At the same time the anolyte solution pH decreased from 2.3 to 1.9. The pH shift of the feed solution is due to electrolytic reduction of acid protons to hydrogen gas and reduction of dissolved oxygen to hydroxide, both processes reduce the acid proton concentration. The sulfate anions left behind will transport through the membrane separating cathode from anode since this membrane (DARAMIC™) is not very selective to ions. The pH shift of the anolyte solution is made possible by the sulfate left over from acid reduction at the cathode passed through the membrane separator to balance charge with acid protons generated at the anode.

Consuming acid protons is a useful capability for treating (neutralizing) acid mine drainage at the same time as recovering metal products. The hydrogen generated by acid reduction can also be captured for use in a fuel cell to help generate power for the system or combusted to provide heat or steam for power generation.

Example 8

Arsenic Removal

The removal of arsenic from sulfuric acid solution was examined because it is such a toxic hazard (upwards of 10-20 mg/L) in groundwater and aquifers near ore deposits such as copper and gold and found in many geothermal brines. Arsenic(III) acid (from $As_2O_3$ dissolved in nitric acid as an atomic absorption standard) was diluted into 0.01 N $H_2SO_4$ to make 10 mg/L arsenic feed solutions at pH 2. Feed solution volume was 7 L. The feed solution was put into the cathode feed reservoir Zinc plated #7 steel shot (purchased) was used as the cathode substrate (~645 $cm^3$).

A system configured as shown in FIG. 9 was employed. System startup proceeded by turning the magnetic spout drive and the anode solution pump (anolyte: 3 L, 0.01 $NH_2SO_4$, 420 mL/min) first. Then the catholyte feed pump was turned on and the flow rate set between 7 and 13 L/min. The cell power supply was turned on as soon as liquid hit the cathode to prevent removal of the zinc coating from the shot. The power supply was set at the desired voltage (for constant voltage experiments) or current (for constant current experiments). Cathode fluid samples were collected at regular time intervals from the reservoir or discharge stream and the cell voltage and current were recorded.

Figure 28:
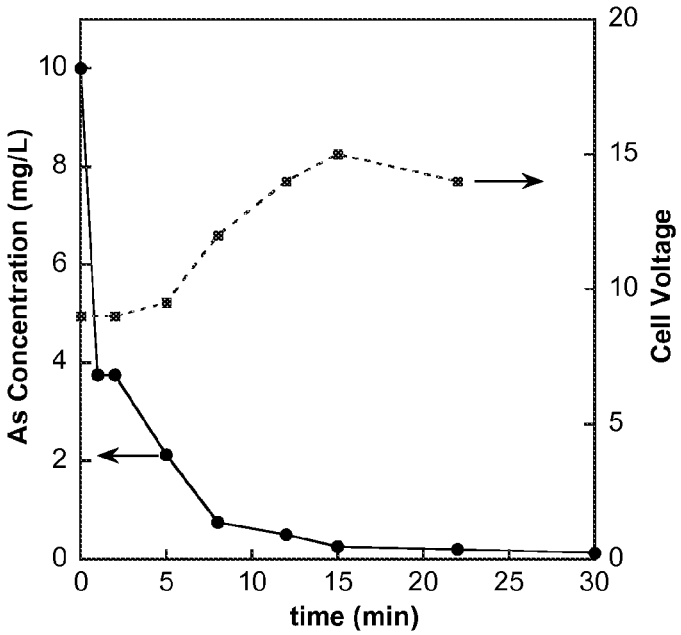
FIG. 28 is a graph showing arsenic removal at constant current and constant flow rate, in a representative test carried out with isolated catholyte and anolyte solutions.

The rate of arsenic removal was determined from the analysis of arsenic remaining in the feed solution. Analysis of dissolved arsenic was conducted by semi-quantitative colorimetric analysis using the arsenic test kit (based on the well known Marsh test) purchased from HACH, Inc. The error bars for concentration measurements between 400 and 2000 μg/L are near±250 μg/L with a practical detection limit around 100 μg/L. The reduced arsenic forms expected are either elemental As or arsine, $AsH_3$. Elemental arsenic is a semi-metal with electrical resistivity about 20 times that of copper, therefore electrical passivation of the cathode is not expected if it is deposited as a metal. Arsine is a highly toxic gas that can escape from solution and will require proper containment/capture controls if this is the primary reduced form. In an exemplary test, arsenic was depleted from a 10 mg/L solution (0.01 $NH_2SO_4$) down to about 125 μg/L concentration in 30 min under constant current control, as shown in FIG. 28. The reduced arsenic form was then examined. The cathode beads were analyzed for reduced, elemental arsenic by EDX elemental analysis, and none was detected. At the given process conditions (zinc cathode surface in acid solution under reducing potentials that evolve hydrogen) the most likely form of arsenic removed from solution is $AsH_3$. $AsH_3$ is typically produced by reduction of an arsenic compound or complex over zinc metal in HCl with the evolution of $H_2$. $AsH_3$ thermally decomposes to its elemental form at 250-300° C. and can be plated out onto surfaces in this manner. Venting $AsH_3$ through a heated pipe to strip out As is one possible approach to recovery.

Example 9

Parameterizing Operating Conditions for Metal Recovery

As noted above, the dramatic change in current density at a given cell voltage encountered in these studies was a result of changing the reactor's fluid flow configuration. This difference, in comparison to previous work, clearly demonstrated that the metal removal rate is a function of current density while the voltage difference between anode and cathode is less important as a process parameter.

The influence of feed flow rate on removal rate for copper and iron was negligible at the lower current densities examined, which allows for lower space velocities to be used to increase the feed solution residence time in the electrolysis cell. Higher space velocities will be generally needed for zinc and nickel recovery. Residence time and space velocity are important parameters in the design of a MSET system for a particular end use application.

Large-scale dynamic flow electrolysis reactors have electrode areas that are typically too great for meaningful use of reference electrodes due to inhomogeneities in solution concentrations, electric field strengths, resistances, changing electrode surfaces, competing processes, and so forth. Rather, the dominant electrolytic processes in large membrane reactors appear to determine the "pinning" potentials at the electrodes while the current density (electron transfer rate) determines the rate of reaction at the electrodes. (For example, the oxidation of water at the anode producing $O_2$ and $H^+$ can potentially pin the anode potential at the oxidation potential of water, roughly 1.2 V vs NHE.) There still exists a critical relationship between cell current, cell voltage, metal concentration, and cathode potential that must be balanced to promote the desired reactions and process rates.

The new magnetically spouted electrolytic technology makes possible the parameterization of the above-mentioned variables, allowing significant advances to be made in electrowinning rate, efficiency and selectivity. These advances have provided the performance necessary to design a simple, low-cost, flow-through metal recovery and refining system for direct capture of valuable metals from a variety of aqueous sources too dilute to be economically viable with currently available technology. A fully developed MSET electro-refining system will have the capability to sequentially removal of metals selectively from mixed-metal feed streams in order of more positive to more negative reduction potentials. This is expected to be accomplished by a flow-through system with multiple electrolytic cell stages, each with its own flow velocity and current density optimized for each target metal.

Optimal operating conditions for electrodeposition of individual target metals, particularly those providing selective metal removal of a selected metal from binary and tertiary mixtures of metals can be determined. The removal of copper and silver are relatively straight forward, as their reduction potentials are more positive than that of hydrogen, as can be seen in Table 1. Therefore, copper's electrodeposition is determined primarily by diffusion kinetics of the metal ion to the cathode surface, cathode potential, and cell current density. In the electrolytic cell, improving electrodeposition rate of copper translates to higher flow rates (producing more turbulent mixing of the cathode particles) and higher current density. The removal of metals with reduction potentials more negative than that of hydrogen (e.g., iron, lead, nickel, zinc) becomes more difficult as the reduction potential becomes more negative due to competing hydrogen production and parasitic corrosion of these metals by protons in acid solution. This is why zinc metal corrodes in sulfuric acid, producing hydrogen gas. The situation is even more difficult when a metal's reduction potential is more negative than water, such as manganese, for example, which can also react and be corroded by water as well as acid protons. The end result is that electrodeposition of metals with negative reduction potentials is determined by many factors including diffusion kinetics of the metal ion and protons, pH, current density, and selectivity of electron transfer kinetics for each reductant species present. It is expected that as the pH is raised, the metal removal rate will increase. Related to acid concentration is electrolyte strength. Feed solutions containing low acid concentrations and low metal concentrations are more electrically resistive resulting in higher operating voltages and greater power consumption. This issue can be greatly reduced in membrane reactors by keeping the anode solution electrolyte concentration high (e.g., 0.1 N $H_2SO_4$). This concentration provides a high enough density of acid proton charge carriers through the membrane to minimize charge transport resistance between anode and cathode. The electrolyte strength at the cathode, however, can still have a strong influence on the rate of the desired electrolytic processes. In the electrolytic cell, improving electrodeposition rates for metals with negative reduction potentials translates to properly balancing flow rate (intermediate or low), with current density (higher) and pH level or pH gradients near the surface of the cathode particles.

Optimization of metal removal rates, a major issue in a flow-through treatment system, is obtained by adjusting the flow rate and cell current density in the new electrolytic cell. For instance, the initial range of operating conditions may be as shown in Table 4, representing a range of flow rates that encompass an acceptable range for a pilot-scale flow-through treatment system suitable for use in the magnetically spouted electrolytic treatment of acid mine drainage, for instance. The initial metal concentration in the test feed solution is 200 ppm, and the feed solution also contains sulfuric acid, $H_2SO_4$, and has a pH of 2-4, to simulate the pH associated with acid leach solutions, acid mine drainage, and acid rock runoff.

Initially, screening of these operating parameters is made at either end of the flow rate range while using the minimum current density. For example, the best of these two flow rates are then used to examine metal removal at the highest current density. These results are evaluated to determine the trade-off between flow rate and current density. From those results, an optimal current density is estimated and tested. Selective metal removal for recovery of enriched metals and increased value from low grade ore and mixed waste streams is just one of several potential applications of the new electrolytic cell. Similar optimization procedures are employed for treating binary and tertiary mixed-metal feed streams Metal ions with more positive reduction potentials are expected to be removed first followed by removal of metal ions with more negative reduction potentials, in the approximate order Listed in Table 1.

Industrial Applications of MSET Systems and Processes

Various embodiments of the above-described MSET systems and processes are potentially useful in a number of industries, including but not limited to, the mining industry, metal finishing industry, semiconductor/electronics industry, environmental remediation industry and naval/commercial shipping industry.

Mining. The mining industry represents about 5% of the United States' gross domestic product. Today, nearly 47,000 pounds of materials are mined for each person in the US annually to maintain the current standard of living. The ever-mounting pressures from resource demand, foreign competition, rising energy costs, and tightening environmental impact regulations make it essential to develop new, innovative processing methods that can increase efficiency, competitiveness, and productivity while being environmentally responsible.

The mining industry utilizes heap-leach and solvent extraction processes (e.g., Merrill-Crowe Process or in-situ mining) for recovery of a number of metals. The traditional Merrill-Crow type process utilizes cyanide solutions for ore extraction followed by addition of zinc powder to precipitate the desired value metal. Other metal extraction products now exist that replace cyanide as the chemical complexing agent for solvent extraction and in-situ mining, however, the grade (purity) of extracted metal solution is typically low and high leach concentrations (>1%, 10,000 ppm) are necessary to make this process economically viable. For example, iron, lead, arsenic, and cobalt (and added zinc) are often problematic impurities in silver and copper extractions. Conventional electrowinning technologies can increase extracted metal purity, however, they are economically limited to high metal-concentration solutions and they typically leave behind a large amount of metal value which is lost to toxic mine drainage waste and runoff that must be treated. A MSET electro-refining system will potentially provide better control over product purity, and recovery of a much greater yield (estimated 10-80% greater) of metal from lower concentration leach solutions. For use in the magnetically spouted electrolytic treatment of acid mine drainage, an exemplary feed solution further contains sulfuric acid, $H_2SO_4$, and has a pH of 2-4, to simulate the pH associated with leach solutions, acid mine drainage, and acid rock runoff.

Some of the new MSET systems and processes will be of potentially great benefit to smaller-scale mining operations around high quality ore deposits. Many smaller ore deposits (i.e., those yielding at least 100 million pounds annually), as in the case of copper, are not utilized due to the large capital costs that must be recovered for the typically massive operations. By using an appropriate MSET system and process, small copper oxide deposits can now potentially be mined to increase their total yield, increase purity, and reduce effluent metal concentrations. The same is true for mining of silver, cobalt, nickel and other valuable metals.

Other metal sources that can potentially employ one or more of the new MSET systems and processes include mining sites with very large volumes of runoff, waste effluent, legacy wastes and contamination. One such example is the Berkeley Mine Pit in Butte, Mont. This mining pit is considered to be the largest contaminated body of water in the US with over 36 billion gallons of acidified mine drainage containing toxic levels of valuable metals. Table 5 lists the primary contaminants that are found in the Berkeley Mine Pit's water. One MSET process suitable for use in an acid mine drainage application employs a system 900, schematically illustrated in FIG. 29, for operating a MSET treatment/recovery system 910. A battery bank 920 that is coupled to solar panels 930 and/or an external power supply 940 is also connected to the MSET system 910. System 910 includes a pair of MSET electrolytic cells 912, 914, which may be similar to those shown in FIG. 8. A system controller 950, which contains a control module 952 and a power interlock 954, is also connected to battery bank 920. The system is operated as described above in multi-stage batch or flow-through mode for removing one or more heavy metals.

Figure 29:
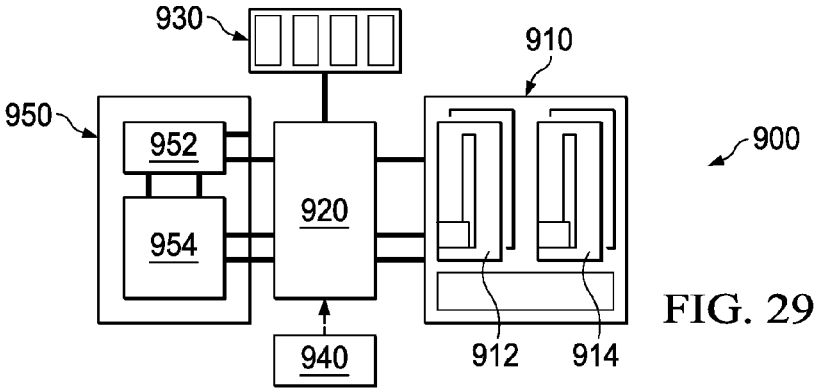
FIG. 29 is a block diagram of a solar powered MSET two-cell system according to an embodiment of the invention.
Figure 30:
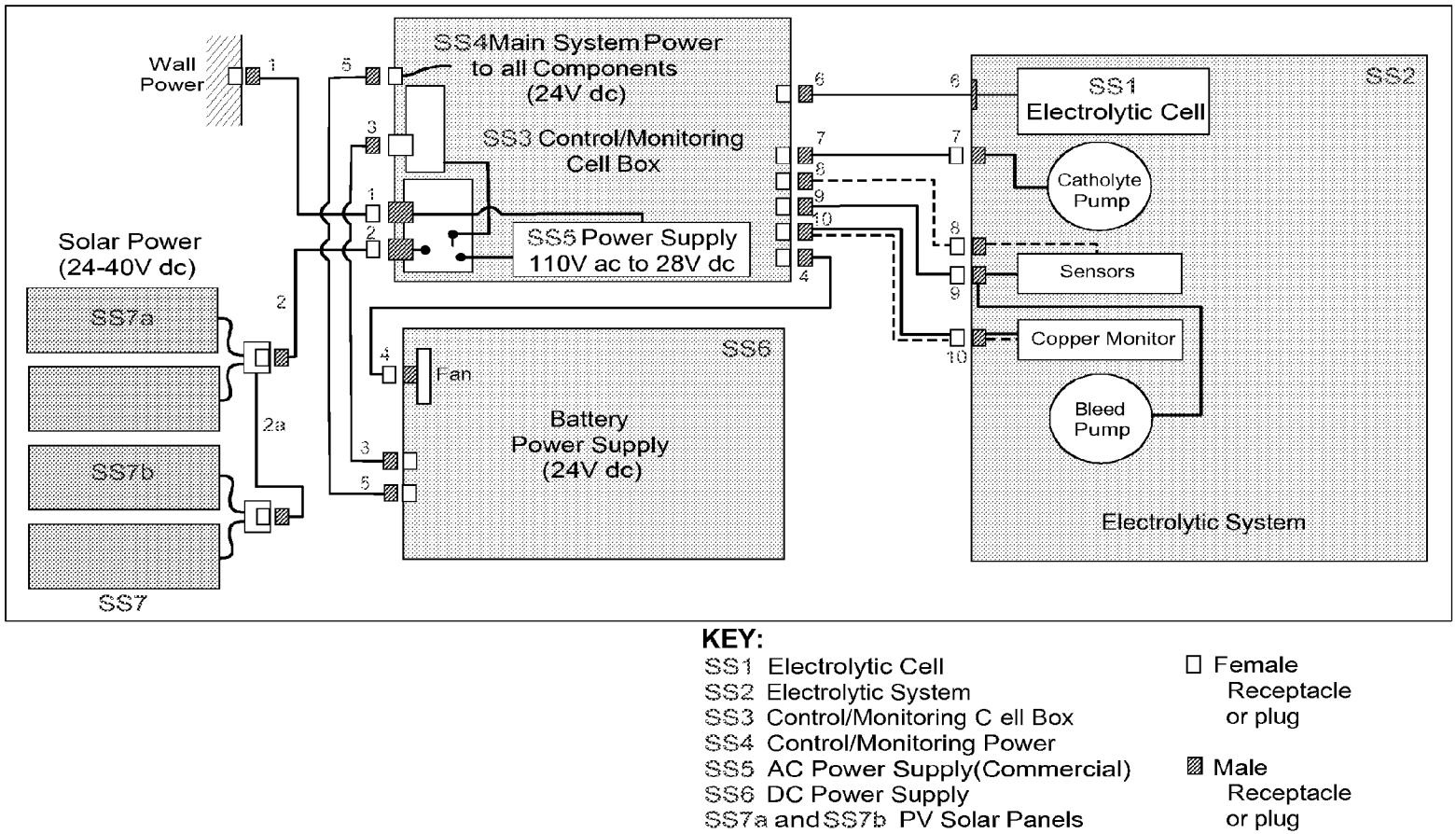
FIG. 30 is a block diagram of an electrical connection scheme for operating the system shown in FIG. 29.

FIG. 30 illustrates an electrical connection scheme for operating a system like that shown in FIG. 29 for electrowinning copper from a liquid stream. At line 1 grid power is 5 amp at 110V ac. Line 2 solar power is 15 amp at 24-40V dc. Line 2a solar power connection is 5 amp at 24-40V ac. Line 3 battery charging power is 15 amp at 24-40V dc. Line 4 battery cooling fan power is <1 amp at 24V dc. Line 5 main system power is 20 amp at 24-40V dc (with locking plugs). Line 6 electrolytic cell power is 30 amp at 3.0V dc (with locking plug). Line 7 catholytic pump power is 5 amp at 24V dc. Line 8 sensor signals less 24-40V dc. Line 9 component power 3 amp at various V dc. Line 10 copper monitor power and signal is <1 amp at 24 V dc.

Using a MSET-AMD treatment/recovery system platform such as that shown in FIG. 31, power consumption estimates indicate ten 75 W panels will be required to have the charging capacity for continuous 24 hour operation. The proposed 4-6 gpm flow through MSET-AMD treatment system will consume an estimated 180 W (40 W for each of two electrolytic cells, 20 W for the magnetic conveyor drive motor, and 80 W for the feed pump). Eight batteries have a power storage rating of 10,320 W-hours and can be expected to provide 7224 W-h after a 30% derating for power losses in the electrical distribution and converter system. This provides approximately 40 h of treatment system power without recharging. In a 24 hour period, a treatment system such as this can be expected to consume about 4320 W-h of power. A bank of ten 75 W solar panels can be expected to provide about 4500 W-h of battery charging power in a 24 hour period. This estimate assumes a 750 W bank of solar panels is derated 25% for losses and provides power equivalent to 8 hours of full sunlight exposure in a 24 hour period. Elimination of the feed pump power consumption by a gravity fed arrangement may permit reduction of the number of solar panels.

For some end-use applications, in which reliability is a major issue, it may be more appropriate to use a propane-powered generator for intermittent charging of the system battery bank, rather than relying entirely on solar power. The power buffer time may also be reduced, thus reducing the number of batteries (e.g., from 8 to 4), and at the same time reducing the overall weight of the treatment platform. This type of a system makes possible a small footprint, lowered maintenance requirements, and lower construction cost than a large bank of solar panels, and offers the possibility of providing power at regular, predictable intervals including night time, stormy days, and dark underground locations.

Geothermal Fluids. The direct utilization of geothermal brines as a low-concentration metal source is also possible with some of the new MSET systems and processes. Geothermal fluid compositions vary dramatically as they reflect the local mineralogy and temperature of the source making metal and mineral extraction potential very site-specific. Higher temperature geothermal sources can carry up to several ppm arsenic. One of the needs for practical geothermal power utilization is the ability to meet discharge criteria for spent brines, especially for direct-use geothermal heating systems. A suitable MSET system and process can potentially meet this need. One example of a geothermal fluid application is the CalEnergy Mineral Recovery Project for the geothermal power complex on the Salton Sea in southern California's Imperial Valley. That facility currently utilizes existing solvent extraction, ion exchange, and electrowinning technologies to recover high-grade zinc. Such a zinc recovery process could potentially be simplified with direct capture or could potentially be made more energy efficient for electrowinning by employing a suitable MSET system and process.

Metal Finishing. Some MSET systems and processes will be of potential use in the metal finishing industry, and may benefit by gaining the ability to recover and recycle metals and to reduce metal waste discharge. Spent plating and washing fluids are generally too dilute or impure for direct recycle back into the plating process. Recovering metals from the spent fluids in a pure, solid form in a single step is possible with a suitable MSET system and process which will minimize toxic waste discharge from plating activities.

Semiconductor and Electronics Fabrication and Recycling. Discharge from semiconductor and electronics fabrication plants has become a significant issue due to the toxicity of the metals present (e.g., cadmium, tin, chromium, nickel, lead, silver, copper and others). These waste streams are created primarily during metal plating, etching, and cleaning steps during printed circuit board and lithographic fabrication processes. Recovery of these metals from waste streams by using a suitable MSET system and process will potentially help reduce the cost burden of waste disposal from this industry. Similarly, the recyclable metal components of discarded electronic components and batteries may be solubilized and then recovered by a MSET system and process, for reuse.

Environmental Remediation Industry. Environmental remediation, especially for the cleanup of acid mine drainage (AMD) and legacy wastes at numerous DOE sites, is another application that is well-suited for many of the new MSET metal removal/recovery systems and processes. Significant heavy metal contamination of waterways largely arises from decontamination or decommissioning of nuclear and industrial sites and results from runoff associated activities in both metal and coal mining, chemical processing of ores and AMD. Table 6 summarizes the main contaminant metals found in AMD and at contaminated DOE sites and their typical concentration ranges. The U.S. mining industry spends over $1 million per day treating AMD at active mines while losing tons of valuable metals because conventional electrowinning technology is generally unsuitable for the dilute streams created. Suitable MSET systems and processes have the potential to efficiently treat these waste streams and at the same time recover metal value that can help to offset the remediation costs.

Naval/Commercial Shipping Industry. Suitable MSET systems and processes are used for mitigation of heavy metal contamination in water for problematic issues such as copper, lead, zinc, and nickel leaching into water circulation systems, metal loading in greywater, and release of metals from paint during hull cleaning of naval and commercial ships.

Manufacture of Specialty Metal-based Materials. Manufacturing of specialty metal-based materials will also potentially benefit from some of the newly found capabilities of suitable MSET systems and processes for producing reduced metal oxides directly from metal solutions. One example, which is described above, is cuprous oxide ($Cu_2O$), which is recovered in pure powder form by settling, filtration or centrifugal separation. Today, the bulk production of $Cu_2O$ is primarily accomplished by electrolytic oxidation of metallic copper or by caustic chemical reduction of copper sulfate. Use of a suitable MSET system and process eliminates the need for refined copper as a feed stock and eliminates the use of additional chemical processing steps, as it produces $Cu_2O$ in powder form directly from acidic copper sulfate (or sulfate-based heap-leach extraction fluids). Cuprous oxide is widely used as an anti-fungal agent in agriculture and horticulture, and it is the typical active ingredient in anti-fouling marine paints and coatings.

Another example of a valuable metal oxide that may be advantageously produced directly from metal solutions using a suitable MSET system and process is iron ferrite (magnetite), $Fe_3O_4$. The production of spinel-structured oxides such as magnetite from solution at room temperature is extremely significant in that these types of materials are typically made in bulk by high temperature (600-1200° C.) solid state synthesis methods or rigorous hydrothermal conditions from metal oxide and carbonate precursors. The products must then be ground to small particles and powders for use. The selective production of iron ferrite (magnetite), $Fe_3O_4$, as a pure, crystalline powder was demonstrated repeatedly from a mixed stream containing nickel and iron sulfates. A suitable MSET system and process eliminates the high temperature production energy cost and greatly reduces the amount of energy and time necessary for grinding the product. Iron ferrite is a technologically important material for magnetic recording media, magnetic cores in electric power transformers and chokes, magnetic shielding, ferrofluids, biomedical imaging, and it is also an important feedstock for manufacture of color pigments. Additional common applications of ferrites, and other spinel-structured oxides, are catalysts, battery electrodes, and refractory ceramics.

The new magnetically spouted electrode technology (MSET) disclosed herein decouples the feed fluid and cathode bed particle motion and flow paths providing greater control over the feed fluid flow dynamics while retaining the advantages of a spouted cathode bed. Many embodiments of the MSET make it possible to achieve a marked increase in removal efficiency and rate at low metal concentrations (<300 ppm), thereby making possible a practical flow-through operation instead of batch-mode. Metal concentrations in the discharged effluent can even be reduced to the μg/L (ppb) range. The performance improvement is illustrated in FIG. 12 comparing copper removal using a representative embodiment of the new MSET(solid circles, 7 L, 180 $cm^2$ cathode) and an original fluid-spouted electrolytic cell (open circles, normalized to 7 L and 180 $cm^2$ cathode). Both solutions contained copper sulfate at pH 0.7.

In some embodiments, the copper removal rate of a MSET system is 10 lb/day per square foot of geometric cathode area (49 kg/day/$m^2$). A MSET electro-refining plant system having 200 $ft^2$ geometric cathode area is generally suitable for recovering 1 ton copper per day from a relatively dilute (<1000 ppm) aqueous source. Power consumption cost for the new magnetically spouted cell performance shown here (including cell current, magnetic drive, and fluid pumping) are typically better than that of other electrowinning systems.

Another potential benefit of many embodiments of the new MSET is greater control of metal reduction/removal selectivity from mixed sources. Other important potential benefits are reduced power consumption for fluid circulation (can be operated on gravity feed) and reduced mechanical wear and stress on the electrolytic cell by slower moving cathode particles. Thus, many embodiments of the new MSET technology offer a low cost electrowinning approach that provides the necessary performance for energy efficient and selective metal reclamation and refining, even at very low concentrations.

The anticipated public benefits from successful development of the proposed high-efficiency electro-refining system are economic and environmental. Benefits include very low-cost and selective (high purity) metal recovery from liquid feed streams and the profitable utilization of metals that are currently discharged as waste from mining operations. Production of a pure or near-pure metal from low-grade ore extractions and mixed-metal sources in a single process will also reduce the cost and complexity of metal refining. This, in turn, leads to lower supplier costs to manufacturing and consumer goods as well as making the metal refining industry more profitable and competitive.

Magnetically-spouted electrolytic technology (MSET) makes possible a variety of compact, reagent-free systems that require no feed stream pre-treatment. In many instances, metals and reduced metal oxides are recovered in a purified, solid form that can be easily recovered for direct sale or use. Selective metal recovery from multi-component feed streams is also made possible with many of the MSET systems. A major capability of the many MSET systems and processes is efficient (>80%) removal of metals from low concentration (<500 mg/L) feed-streams. Typically, economic recovery of metals at low concentrations is not possible in conventional electrowinning technologies. In many instances, effluent metal concentrations can be reduced enough with a MSET system and process to meet waste-water discharge and even drinking water standards, which is typically done by non-electrolytic methods such as precipitation, ion exchange, filtration and the like.

Continuous flow-through MSET electrowinning/refining systems that eliminate processing steps and greatly reduce energy consumption in the production of specialty metal-based products are also made possible. The electrowinning efficiency provided by this technology can potentially boost product recovery from low concentration or low-grade heap-leach and Crowe-type extraction fluids.

Existing metal removal processes using carbon felt cylinder technologies are typically useful for liquid streams containing metal (e.g., Cu) in the concentration range of log $C^0$-1.0 to 2.0 ppm. For packed bed technologies, the range is also about log $C^0$-1.0 to 2.0 ppm. With fluidized bed (removal on carbon) technologies, the concentration range is about log $C^0$ 0.0 to 3.0 ppm. The conventional scraped rotating cylinder technology generally offers a metal removal concentration range of log $C^0$ 0.5 to 3.5 ppm. For mesh in inert fluidized bed technologies, the metal recovery range is typically about log $C^0$ 1.5 to 3.0 ppm. In the case of conventional rotating drum electrowinning processes, the range is usually about log $C^0$ 3.5 to 5.0 ppm. Metal removal processes employing a sparged parallel plate technology typically operate in the concentration range of about log $C^0$ 3.0 to 4.5 ppm, and conventional parallel plate methods are generally applicable to liquid streams containing a metal concentration of about log $C^0$ 3.75 to 5.0 ppm. By contrast, many embodiments of the present electrowinning method are applicable to liquid streams ranging in metal concentration from log $C^0$ 1.0 to 3.5 ppm.

In many instances, removal rates with MSET systems are as much as 25% greater at 100 times lower power consumption, compared to most existing systems. Still another potential advantage of MSET is that many of the new MSET systems and processes provide the conditions needed to observe more complex reduction chemistry and interactions/reactions between metal ions and oxygen dissolved in solution producing reduced metal oxides that are specialty metal-based products of commercial value and technological importance. Discovering new process complexities results in additional capabilities for controlling system performance and product output.

Although magnetic conveyer assemblies and processes are emphasized in the foregoing description, it should be understood that other suitable mechanical or electromagnetic devices could be used similarly for churning a particle bed independently of the flow of a fluid. In additional embodiments, mechanical devices such as conveyer belts and auger screw devices are configured for churning a particle bed to eliminate reliance on the flow of catholyte for transporting and churning a cathode particle bed. In another alternative embodiment, an electromagnetic assembly is used to move cathode particles in such a way that the cathode bed is mixed. One of these alternative electrowinning systems and processes that decouple cathode particle churning from the catholyte fluid flow may be preferred in certain applications.

Auger Screw Spouting Mechanism

Figure 33:
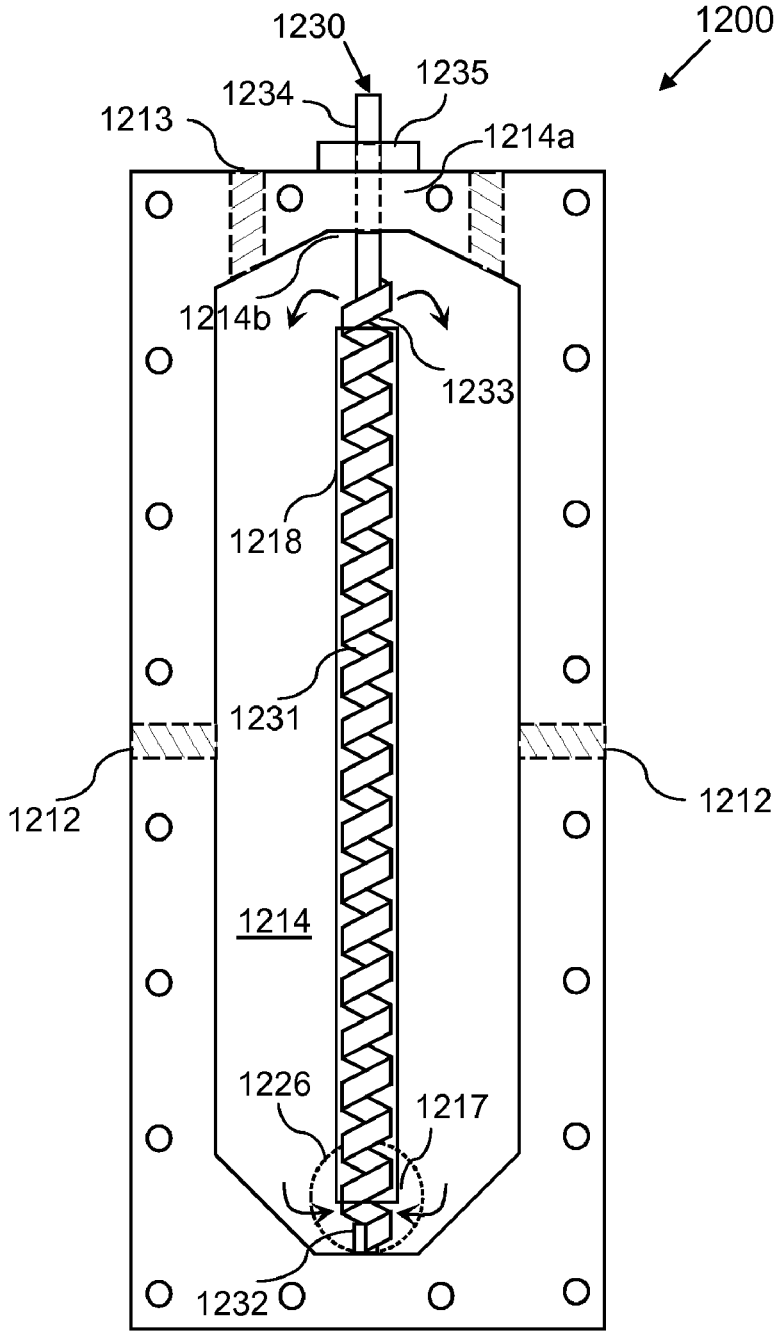
FIG. 33 is a schematic drawing of an auger screw spouting mechanism according to certain embodiments of the invention.

In an alternative embodiment, an electrowinning apparatus is equipped with an auger screw mechanism 1230 which "spouts" the cathode particles. FIG. 33 is a cutaway view of the cathode side of electrolytic cell 1200 which is similar to that shown in FIG. 3, except that cathode chamber 1214 is modified so that an auger screw 1231 is positioned inside a suitably configured particle channel 1218 in cathode chamber 1214. For example, the auger screw may be a modified auger drill bit obtainable from a standard tool supplier. The "spout" tube (particle channel) is preferably cylindrical, to accommodate the auger screw and the cathode particles in transport. The curved arrows indicate the movement of cathode particles into the bottom 1232 of the auger screw 1231 and out of the top 1233 of the auger screw. The auger screw drive shaft 1234 extends through the top of the cathode chamber frame

1214*a* with a water tight seal bearing 1235. A drive motor or other rotary drive mechanism (not shown), as known in the art, is coupled to the shaft. The bottom end 1217 of the auger screw 1231 is preferably held in position in a recess or sealed bearing (not shown) that accommodates the shaft centered below the draft tube (i.e., particle channel) 1218. The dotted circle at the bottom of the cathode frame 1214*a* represents a removable drain port 1226 (for cathode particle removal). Pairs of cathode fluid inlets 1212 and outlet ports 1213 are positioned at mid height and at the top of the cathode frame, respectively. New cathode particles may be loaded into the reactor through one or more cathode fluid outlets 1213. Alternatively, a second removable port similar to drain port 1226 may be added to the top of the reactor for the purpose of loading new cathode particles into the reactor. As discussed above with respect to FIGS. 5A-B, in a reactor that has a spout tube symmetrically positioned in the middle of the particle bed the catholyte fluid inlet ports are preferably positioned part way up the particle bed (as also shown in FIGS. 33-36). More preferably, the positions of the inlets 1212, 1312, 1412, 1512 are selected or adjusted so as to balance the back pressure that the catholyte fluid encounters in the reactor. This promotes the same or similar flow velocity, residence time, and particle surface area encountered throughout the particle bed, both up and down (i.e., co-current and counter-current flow). In use, the catholyte fluid enters the reactor by way of side inlets 1212, 1312, 1412, 1512 essentially cross-current at the inlets. In this type of configuration, catholyte fluid that passes upward through the particle bed exits upward though fluid outlets 1213, 1313, 1413, 1513 at the top of the respective reactors in FIGS. 33-36. Catholyte fluid that passes downward through the particle bed exits through the bottom of the particle spout tube 1218, 1318, 1418, 1518 and flows upward in the tube and out though the fluid outlets at the top of the reactor. In contrast, if the catholyte fluid inlets are at the bottom of the reactor, as illustrated in FIG. 1, most of the fluid follows the path of least resistance up the spout tube rather than counter-current up through the particle bed. Accordingly, in any of the reactor configurations described herein, the fluid inlets are preferably positioned in such a manner as to promote uniform velocity, residence time and particle surface area exposure of the fluid in the passing through the reactor.

Conveyor Drive Spouting Mechanism

Figure 34:
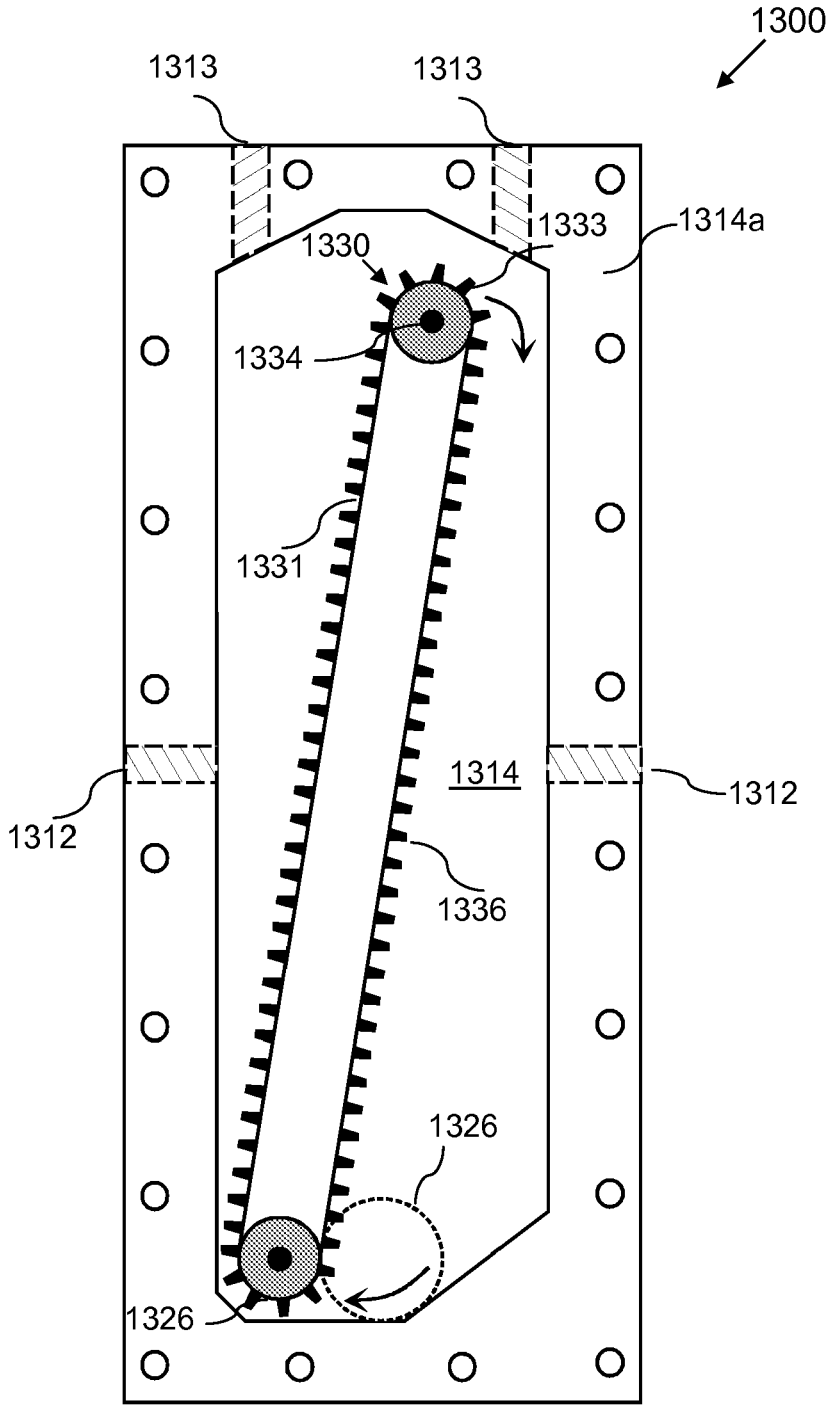
FIG. 34 is a schematic drawing of a conveyor mechanism inside the cathode chamber of an electrolytic cell, in accordance with certain embodiments of the invention.

Another embodiment of an electrowinning apparatus is equipped with a conveyor drive spouting mechanism 1330 which transports cathode particles to chum the cathode bed. FIG. 34 is a cutaway view of the interior of the cathode side of electrolytic cell 1300, which is also similar to that shown in the exploded view of FIG. 3. Conveyor mechanism 1330 is positioned inside the cathode chamber 1314 with the conveyor face 1336 oriented perpendicular to the cathode current collector face (current collector not shown, but similar to current collector 111 shown in FIG. 3). The carriers mounted on the conveyor belt may be flat, cupped, V-shaped, bristle brush, buckets, or scoops, or other suitable configuration. The carriers may be formed with the material of the conveyor (e.g., injection molded) or attached by adhesive or fasteners. The carriers may be composed of the same material as the conveyor belt, rubber, elastomeric polymers, thermoplastic polymers, thermoset polymers, plastic, metal, or carbon. A spout tube or guide (not shown) may be positioned between the conveyor belt and membrane to prevent wear on the membrane and to prevent cathode particles from interfering with the conveyor mechanism. If present, the guide may be similar to channel 118 of FIG. 3, although configured to receive the conveyor belt. The curved arrows in FIG. 35 indicate the movement of cathode particles into the bottom 1326 of conveyor mechanism 1330 and out of the top 1333 of the conveyor mechanism. The conveyor drive shaft 1334 extends through the face of the cathode frame 1314*a* (into the page, not shown) with a water tight seal bearing (not visible in FIG. 35). A drive motor or other rotary drive mechanism, as known in the art, is coupled to the shaft 1334. The dotted circle at the bottom of the cathode frame 1314*a* represents a removable drain port 1326 (for cathode particle removal). In this example new cathode particles may be loaded into the reactor through one or both of the cathode fluid outlet ports. Alternatively, a second removable port similar to drain port 1326 may be added to the top of the reactor for the purpose of loading new cathode particles into the reactor. Two pairs of cathode fluid inlets 1312 and outlet ports 1313 are positioned at about mid height and at the top of the cathode frame 1314*a*, respectively.

Figure 35:
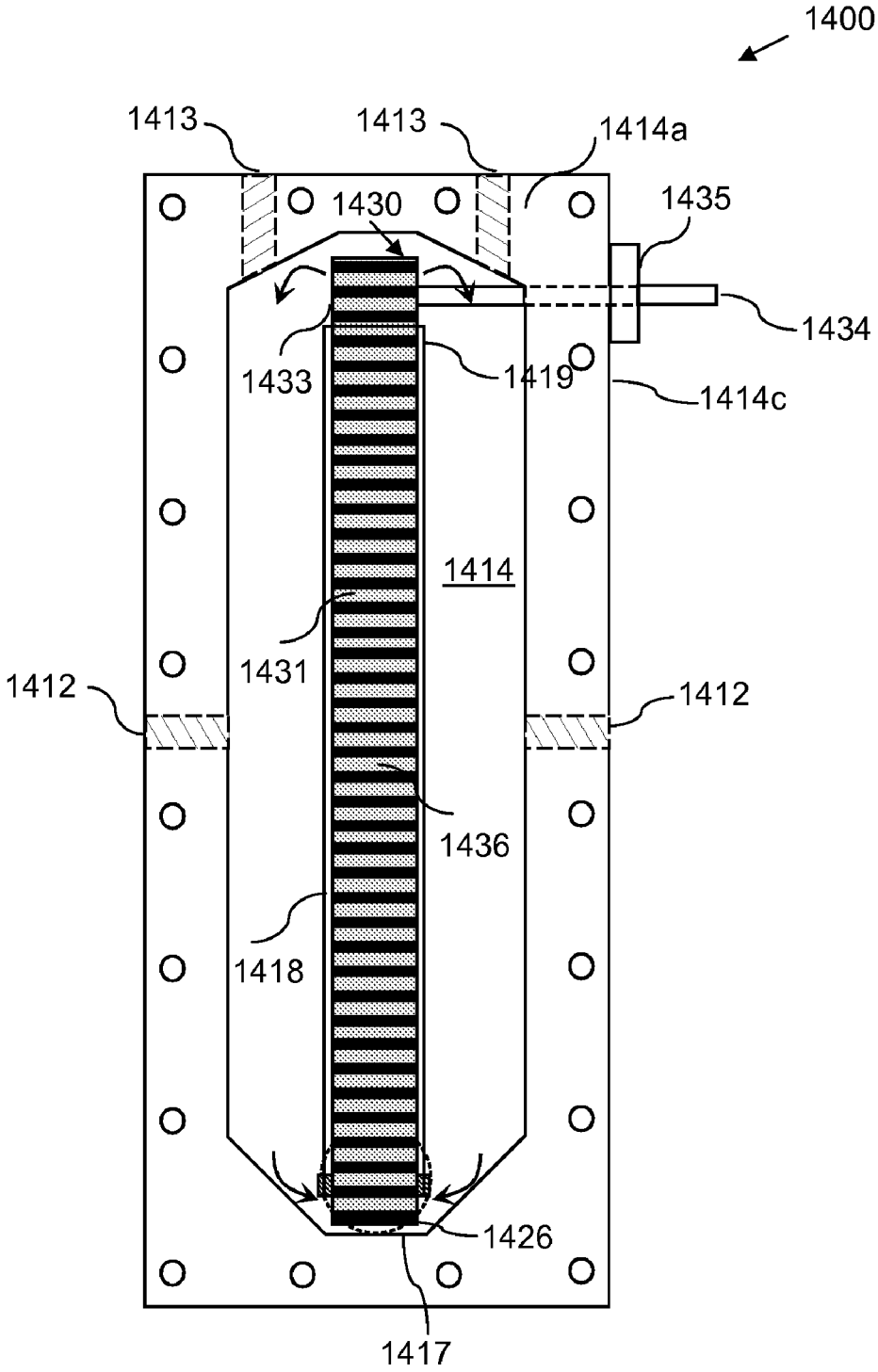
FIG. 35 is a schematic drawing of another configuration of a conveyor mechanism inside the cathode chamber of an electrolytic cell, in accordance with certain embodiments of the invention.

Referring now to FIG. 35, still another embodiment of an electrowinning apparatus is equipped with a conveyor drive spouting mechanism 1430 to transport cathode particles to churn the cathode bed. The cutaway view of the cathode side of electrolytic cell 1400 is also similar to that shown in FIG. 3. Conveyor belt 1431 is positioned inside the cathode chamber 1414 with the conveyor face parallel to the cathode current collector face (not shown, but similar to current collector 111 shown in FIG. 3). As illustrated, a draft tube or guide 1418 may be positioned around conveyor belt 1431 to prevent the cathode particle bed (not shown) from interfering with the conveyor mechanism. Curved arrows indicate the movement of cathode particles into the bottom 1426 of the conveyor mechanism 1430 and out of the top 1433 of the conveyor mechanism. The conveyor belt drive shaft 1434 extends through the side 1414*c* of the cathode frame 1414*a* with a water tight seal bearing 1435. A drive motor or other rotary drive mechanism, as known in the art, is coupled to shaft 1434. The dotted circle at the bottom of the cathode frame illustration represents a removable drain port 1426. Two pairs of cathode fluid inlets 1412 and outlet ports 1413 are positioned at mid height and top of the cathode frame, respectively.

Electromagnet Spouting Mechanism

Another embodiment of an electrowinning apparatus is equipped with an electromagnetic spouting mechanism which transports cathode particles in order to churn the cathode bed. FIG. 36 is a cutaway view of the cathode side of electrolytic cell 1500, which is similar to that of FIG. 3. Electromagnetic spouting mechanism 1530 is positioned outside the cathode chamber 1514. Mechanism 1530 includes a line of stationary electromagnets 1536 (labeled A through K) mounted on the external side of the cathode chamber. Stationary electromagnets 1536 are positioned along the length of the draft tube 1518, extending above the exit 1519 of the draft tube 1518. Curved arrows indicate the movement of cathode particles into the bottom 1517 of the draft tube and out of the top 1519 of the draft tube. The electromagnet spouting mechanism 1530 operates on the same principal as the moving magnet drive illustrated in FIGS. 4A-B in that the cathode particles having a magnetic core are moved from the bottom to the top of the draft tube by attraction to the magnetic force applied. In this embodiment the magnets are stationary electromagnets instead of moving permanent magnets. The electromagnets 1536 are energized in sequence to provide the necessary moving magnetic force field to transport the cathode particles in the desired direction. In the configuration shown in FIG. 36, the cathode particles are moved upward by energizing electromagnet A to draw the cathode particles up into the draft tube 1518. Electromagnet B is then energized followed by de-energizing electromagnet A, resulting in an upward shift in the magnetic force field experienced by the cathode particles and an upward shift of cathode particle position from electromagnet A to electromagnet B. This sequence of energizing the next electromagnet in alphabetical order prior to de-energizing the previous electromagnet will draw the cathode particles up the draft tube and cause them to exit the top 1519, preferably through a check valve mechanism 1523. When the final electromagnet in the sequence (electromagnet K in this example) is de-energized the cathode particles are released above the draft tube exit 1519 and fall to the top of the cathode particle bed (not shown in FIG. 36, but similar in appearance to the particle bed shown in FIGS. 5A-B). This sequence may be started over again at regular intervals to provide cathode particle spouting. Low power electromagnets suitable for this design may be purchased from known suppliers such as AEC Magnetics Automatic Equipment Corporation.

A potential advantage of using stationary electromagnets in some situations is that this approach eliminates moving mechanical parts from the magnetic spouting mechanism. Another potential advantage of stationary electromagnets in some situations is that they need not be arranged in a strictly linear fashion. Rather they may be offset to effect cathode particle transport laterally as well as vertically, or at any desired angle. For some applications, it may be preferred to position an electromagnet to the side of electromagnet K above the draft tube, in order to transport the cathode particles to that side of the draft tube where the particles are then released back to the cathode bed without having a mechanical check valve mechanism on the top of the draft tube. This approach potentially provides more reliable and more efficient spouting in some embodiments, and eliminates moving parts within the reactor.

Continuous Electrowinning Reactor Design and Process

Figure 37A:
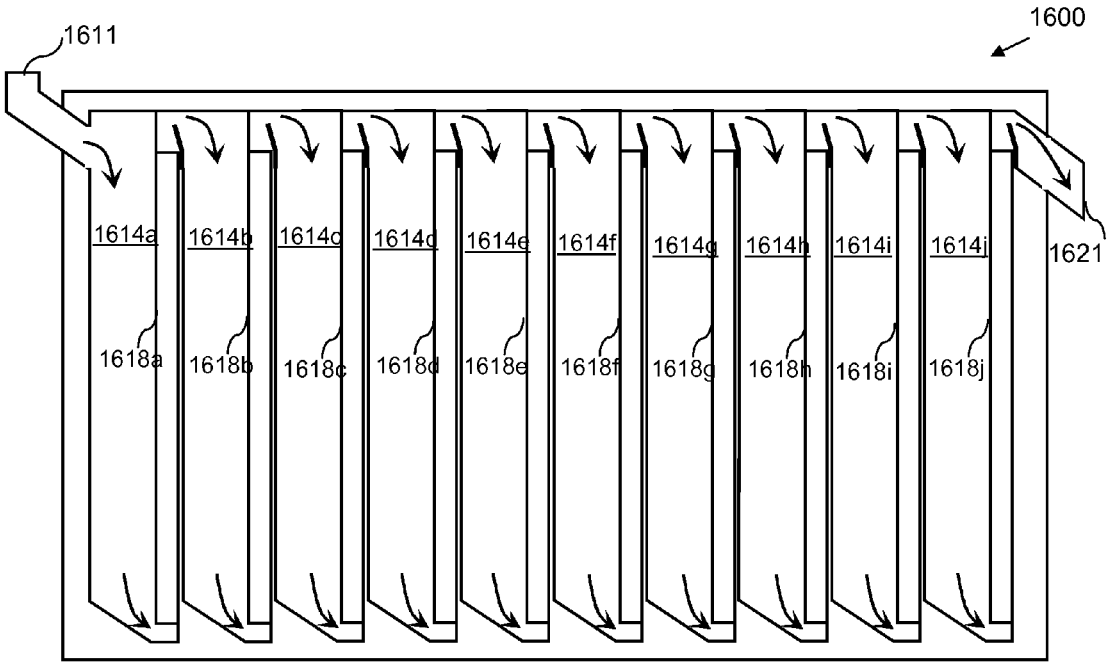
FIG. 37A is a schematic drawing illustrating the cathode chamber side of an electrowinning reactor having multiple asymmetric spouting cathode bed chambers connected in series, in accordance with an embodiment of the invention.
Figure 37B:
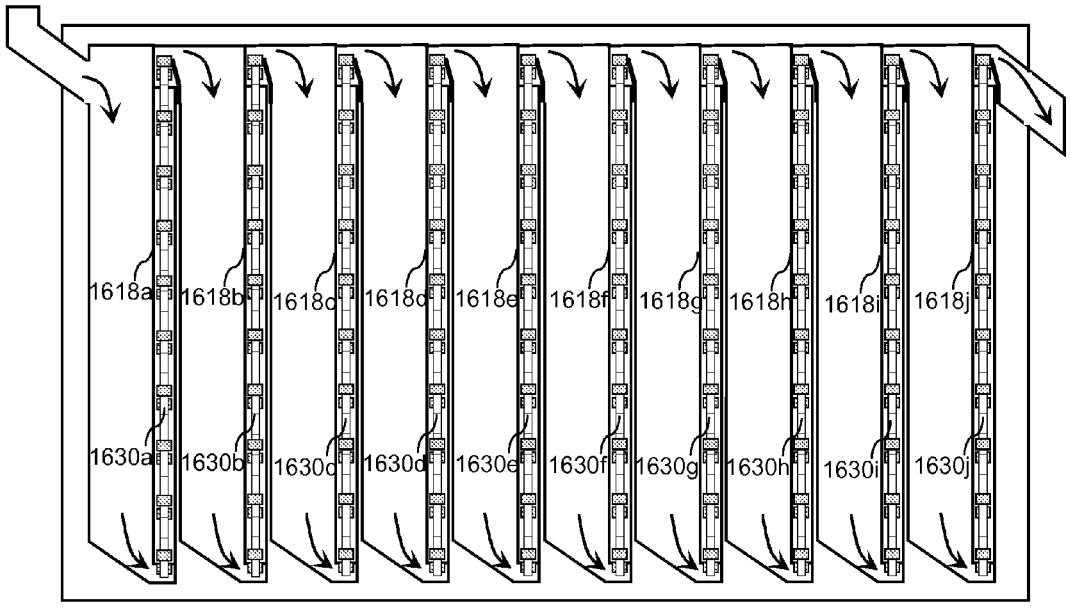
FIG. 37B illustrates the multiple cathode chamber side of FIG. 37A, in which each cathode chamber has a magnet spouting mechanism, in accordance with certain embodiments of the invention.

Referring now to FIGS. 37A-B, an embodiment of an electrowinning reactor includes multiple asymmetric spouting cathode bed chambers connected in series and preferably contained in a single body or unit. A cutaway view of the cathode side of multi-reactor 1600 shows the multistage cathode section of the reactor configured for continuous feeding of cathode particles into inlet 1611 of the reactor, transporting the cathode particles through the reactor with a predetermined residence time for metal plating, and configured for continuously releasing cathode particles from the outlet 1621 of the reactor. The counterpart anode chambers (not shown) of reactor 1600 have respective anodes positioned behind cathode bed chambers 1614*a*-1614*i* with a membrane or diaphragm separator between anode and cathode (analogous to the single cell illustrated in FIG. 3). A suitable metal plate or sheet such as stainless steel serves as a common current collector plate over the face of the cathode chambers, conceptually similar to the design used in the smaller batch reactors (FIG. 3, for example). FIG. 37B shows the same cathode section of FIG. 37A in which the draft tubes 1618*a*-1618*j* enclose respective cathode particle conveyor devices 1630*a*-1630*j*, which may be any suitable mechanical or electromagnetic device as described herein. For example, a magnetic conveyor assembly as described with respect to FIGS. 2A-B. The reactor is also configured for receiving a metal-containing solution to be processed and is configured for flowing the solution (i.e., the catholyte) either co-currently, counter-currently or cross-flow to the movement of the cathode particles. As with the other electrowinning embodiments described herein, in this multistage continuous flow system the transfer of cathode particles and associated churning of the cathode beds are not coupled to, or dependent upon, the flow of a liquid stream.

For continuous operation, the cathode particles are fed into the first electrified cathode bed chamber 1614*a*, transported up draft tube 1618*a* by spouting mechanism 1630*a*. The curved arrows in FIGS. 37A and B indicate the path of the cathode particles through the reactor. The cathode particles are released to only one side of the draft tube so that they drop down into the next cathode bed chamber 1614*b* in series. This sequence is repeated through each succeeding draft tube and cathode bed chamber in the series, moving from left to right, through chambers 1614*c* to 1614*j*, via respective draft tubes 1618*b*-1618*j* and particle conveying devices 1630*a*-1630*j*, until the final draft tube 1618*j* leads to the cathode particle outlet 1621, where the cathode particles are released or removed from the reactor. The cathode particle spouting rate and number of cathode chambers in series determine the residence time of the particles in the reactor. Metal is deposited onto the surface of the electrified cathode particles while moving through the reactor. The cathode particles collected from the exit of the reactor (outlet 1621) may be used for metal product harvest or fed to the entrance of the same process reactor or fed to another process reactor, as desired.

Cathode particles can be used in either batch or continuous operating mode. For batch operation, cathode particles are loaded into a reactor for a period of operation time during which they enlarge with a deposited metal product. After the particles grow to fill the head space above a particle bed (i.e., the reactor is full) the reactor is shut down and the enlarged particles are drained from the reactor. New cathode particles are then loaded into the reactor and the batch processing is restarted.

For continuous operation either (1) the reduced metal product must not adhere to the cathode particles so that the product may be flushed from the reactor or (2) the cathode particles must be cycled through cathodes and or reactors in series to increase the residence time of the particles so that they may grow large enough with deposited metals to produce a marketable quantity of product. For dilute metal-containing liquid streams targeted by embodiments of this technology, the cathode particle residence time required for economic metal production is long enough (e.g., usually in the range of days to weeks) that the particles require several passes through a continuous reactor or reactor system having several reactor cathodes in series. One advantage to using a continuous reactor process with series flow of cathode particles is that the reactors need not be shut down to remove product or add cathode particles. Another advantage is the continuous output of product over time from a single reactor system.

In a reactor that has a spout tube asymmetrically positioned on one side of the cathode (as in FIG. 37) the catholyte fluid can be passed from one end of the particle bed to the other either co-current or countercurrent (fluid inlets and outlets on either end of the particle bed). Any of the reactors described herein in which a spout tube or particle transport channel is symmetrically positioned in the middle of the particle bed can be operated using co-current or countercurrent flow of catholyte if desired. A crosscurrent configuration (i.e., fluid inlets and outlets on either side of the bed) requires a perforated spout tube that allows fluid to pass perpendicular to the spout tube, but maintains confinement of the particles moving parallel to the spout tube. In any of the reactor configurations described herein, the anolyte may be circulated over the anode co-currently, counter-currently or cross-flow relative to the catholyte flow. As noted elsewhere herein, the anolyte and catholyte solutions are preferably electrically isolated from each other.

While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. The electrowinning processes described herein are considered representative of other mechanically, magnetically or electromagnetically spouted bed processes which provide mutual independence of feed stream flow and spouted bed particle flow, provide for controlling residence time of a feed stream independently of spouted bed particles, and define inlets and outlets for a feed stream independent of inlets and outlets for spouted bed particles. Accordingly, the scope of protection is not limited by the representative description set out above, but is only limited by the claims which follow, that scope including all equivalents of the subject matter of the claims. The disclosures of all patents, patent applications, and publications cited herein are hereby incorporated herein by reference in their entirety, to the extent that they provide exemplary, procedural, or other details supplementary to those set forth herein.

TABLE 1

Standard Reduction Potentials of Exemplary Target Metals.

| Target Metal | Reduction Potential $E^0$/V (vs SHE) |
|---|---|
| $Ag^+ + e \leftrightarrow Ag$ | 0.7796 |
| $Cu^{2+} + 2e \leftrightarrow Cu$ | 0.3419 |
| $HAsO_2 + 3H^+ + 3e \leftrightarrow As + 2H_2O$ | 0.248 |
| $2H^+ + 2e \leftrightarrow H_2$ (hydrogen production) | 0.00000 |
| $Fe^{3+} + 3e \leftrightarrow Fe$ | −0.037 |
| $Pb^{2+} + 2e \leftrightarrow Pb$ | −0.1262 |
| $Sn^{2+} + 2e \leftrightarrow Sn$ | −0.1375 |
| $Ni^{2+} + 2e \leftrightarrow Ni$ | −0.257 |
| $Cd^{2+} + 2e \leftrightarrow Cd$ | −0.403 |
| $Cr^{3+} + 3e \leftrightarrow Cr$ | −0.744 |
| $Zn^{2+} + 2e \leftrightarrow Zn$ | −0.7618 |
| $2H_2O + 2e \leftrightarrow H_2 + 2OH^-$ (water reduction) | −0.8277 |
| $Mn^{2+} + 2e \leftrightarrow Mn$ | −1.185 |

Source: CRC Handbook of Chemistry and Physics," 72nd Ed., D. R. Lide, Ed., CRC Press, Ann Arbor, MI; 1991, Ch 8, Table 1.

TABLE 2

Magnetically Spouted Electrolytic Cell Electrowinning Tests

| Ex. No. | Cathode | Feed Solution | Feed Volume/ Flow Rate | Cell Potential/ Current (current density) | Run Time (to lowest or undetectable conc.) | Initial/ Final Conc. (mg/L) | Percent Removal | Average Removal Rate | Average Faradaic Efficiency |
|---|---|---|---|---|---|---|---|---|---|
| 1 (Cu) | #7 Steel Shot Zn coating removed, Electroless Cu coating | 0.1M $H_2SO_4$ | 7 L/ 7.5 Lpm | 0.83 V/ current ND | 40 min | 85.9/<4 | 95.3% | 0.860 g/h | ND |
| 2 (Cu) | #7 Steel Shot* | 0.1M $H_2SO_4$ | 7 L/ 7.5 Lpm | 0.83 V/ current ND | 20 min | 66.6/<4 | 63.6% | 1.32 g/h | ND |
| 3 (Cu) | #7 Steel Shot* | 0.1M $H_2SO_4$ | 12 L/ 7.5 Lpm** | 0.83 V/ current ND | 100 min*** | 198.0/7.6 | 96.2% | 1.37 g/h (100 min) 6.85 g/h (20 min) | ND |
| 4 (Cu) | #7 Steel Shot* | 0.1M $H_2SO_4$ | 7 L/ 7.5 Lpm | 0.83 V/ current ND | 20 min | 191.3/<4 | 97.9% | 3.93 g/h | ND |
| 5 (Cu) | #7 Steel Shot* | 0.1M $H_2SO_4$ | 12 L/ 7.5 Lpm | 0.83 V/ current ND | 40 min | 179.5/3.4 | 98.1% | 3.17 g/h | ND |
| 6 (Ni) | #7 Steel Shot* | 0.1M $H_2SO_4$ | 7 L/ 7.5 Lpm | 0.83 V/ 8.1 A (45.0 mA/cm$^2$) | 80 min | 185.8/119.2 | 35.8% | 0.350 g/h | 3.9% |
| 7 (Ni) | #7 Steel Shot* | 0.1M $H_2SO_4$ | 7 L/ 22.4 Lpm | 0.83 V/ 8.9 A (49.4 mA/cm$^2$) | 10 min | 201.8/5.1 (reduced to 0.09 mg/L by 60 min) | 97.5% (99.6% by 60 min) | 8.26 g/h | 78.3% |
| 8 (Ni) | #7 Steel Shot* | 0.1M $H_2SO_4$ | 7 L/ 22.4 Lpm | 0.83 V/ current ND | 57 min | 190/181 | 4.7% | 0.066 g/h | ND |
| 9 (Cu) | #7 Steel Shot* | 0.1M $H_2SO_4$ | 12 L/ 22.4 Lpm | 0.83 V/ 8.9 A (49.4 mA/cm$^2$) | 20 min | 197.0/2.3 (reduced to 0.3 mg/L by 40 min) | 98.8% (99.8% by 40 min) | 7.01 g/h | 66.4% |
| 10 (Cu) | #7 Steel Shot* | 0.1M $H_2SO_4$ | 7 L/ 13.8 Lpm | 0.83 V/ 16.5 A (91.7 mA/cm$^2$) | 10 min | 871.7/1.66 (reduced to 0.4 mg/L by 15 min) | 99.8% (99.95% by 15 min) | 36.54 g/h | 187% (electroless processes included) |

TABLE 2-continued

Magnetically Spouted Electrolytic Cell Electrowinning Tests

| Ex. No. | Cathode | Feed Solution | Feed Volume/ Flow Rate | Cell Potential/ Current (current density) | Run Time (to lowest or undetectable conc.) | Initial/ Final Conc. (mg/L) | Percent Removal | Average Removal Rate | Average Faradaic Efficiency |
|---|---|---|---|---|---|---|---|---|---|
| 11 (Ni) | #7 Steel Shot* | 0.01M $H_2SO_4$ | 7 L/ 13.6 Lpm | 0.83 V/8.3 A (46.1 mA/cm$^2$) | 80 min | 178.5/119.3 (147.6 mg/L at 12 min) | 33.2% (17.3% at 12 min) | 0.312 g/h (1.30 g/h at 12 min) | 3.4% (14.2% at 12 min) |
| 12 (Ni) | #7 Steel Shot* | 0.01M $H_2SO_4$ | 7 L/ 22.9 Lpm | 0.83 V/7.9 A (43.9 mA/cm$^2$) | 60 min | 189.1/157.0 (153.1 mg/L at 10 min) | 17.0% (19.0% at 10 min) | 0.222 g/h (1.51 g/h at 10 min) | 2.6% (17.5% at 10 min) |
| 13 (Zn) | #7 Steel Shot* | 0.01M $H_2SO_4$ | 7 L/ 4.7 Lpm | 0.83 V/9.2 A (51.1 mA/cm$^2$) | 60 min | 219.8/174.7 (187.6 mg/L at 10 min) | 20.5% (14.6% at 10 min) | 0.318 g/h (1.35 g/h at 10 min | 2.8% (12.0% at 10 min) |
| 14 (Zn) | #7 Steel Shot* | 0.01M $H_2SO_4$ | 7 L/ 6.7 Lpm | 0.83 V/ 10.4 A (57.8 mA/cm$^2$) | 93 min | 249.7/185.0 (177.6 mg/L at 20 min) | 25.9% (28.9% at 20 min) | 0.292 g/h (1.51 g/h at 20 min) | 2.3% (11.9% at 20 min) |
| 15 (Mn) | #7 Steel Shot* | 0.01M $H_2SO_4$ | 7 L/ 3.4 Lpm | 0.83 V/6.1 A (34 mA/cm$^2$) | 40 min | 275.5/237.4 (242.2 mg/L at 10 min) | 12.1% | 0.400 g/h (1.40 g/h at 10 min) | 6.4% (22.4% at 20 min) |

*#7 Steel Shot used in Ex. No. 1 (Cu), after storing under isopropanol and reloading into cell.

**Catholyte did not flow for first 60 min. (Ex. 3 (Cu)).

***Bulk of Cu removal occurred in 20 min period after flow recovered (Ex. 3 (Cu)).

TABLE 3

Magnetically Spouted Electrolytic Cell Electrowinning Tests

| Exp. | Cathode | Metal Solution Conc. (mg/L) initial/final | Feed Volume, Flow Rate | Cell Potential, Current, Current Density | Run Time | Average Faradaic Efficiency |
|---|---|---|---|---|---|---|
| 16 (Cu) | Copper-coated #7 steel shot fresh | Cu: 241.2/59.8 Cu/$Cu_2O$ recovered (0.01N $H_2SO_4$) | 12 L, 13 L/min | 0.83 V (CV) 0.3 A (t = 0) 1.16 mA/cm$^2$ | 10 min | >100% electroless reduction processes promoted |
| 17 (Cu) | Copper-coated #7 steel shot re-used | Cu: 242.1/54.0 Cu/$Cu_2O$ recovered (0.01N $H_2SO_4$) | 12 L, 13 L/min | 2.0 V (CV) 1.3 A (t = 0) 5.0 mA/cm$^2$ | 10 min | >100% electroless reduction processes |
| 18 (Cu) | Copper-coated #7 steel shot re-used | Cu: 233.0/57.7 Cu/$Cu_2O$ recovered (0.01N $H_2SO_4$) | 12 L, 13 L/min | 1.4 V (CV) 0.6 A (t = 0) 2.3 mA/cm$^2$ | 10 min | >100% electroless reduction processes |
| 19 (Cu) | Copper-coated #7 steel shot re-used | Cu: 242.3/84.6 Cu/$Cu_2O$ recovered (0.01N $H_2SO_4$) | 12 L, 8.5 L/min | 0.83 V (CV) 0.4 A (t = 0) 1.55 mA/cm$^2$ | 11 min | >100% electroless reduction processes |
| 20 (Cu) | Copper-coated #7 steel shot re-used | Cu: 205.7/86.9 Cu/$Cu_2O$ recovered (0.01N $H_2SO_4$) | 12 L, 8.5 L/min | 0.83 V (CV) 0.3 A (t = 0) 1.16 mA/cm$^2$ | 6 min | >100% electroless reduction processes |
| 21 (Cu) | Copper-coated #7 steel shot re-used | Cu: 199.5/113.7 Cu/$Cu_2O$ recovered (0.01N $H_2SO_4$) | 12 L, 4.25 L/min | 0.83 V (CV) 0.3 A (t = 0) 1.16 mA/cm$^2$ | 5 min | >100% electroless reduction processes |
| 22 (Cu) | Copper-coated #7 steel shot re-used | Cu: 218.4/101.1 Cu/$Cu_2O$ recovered (0.01N $H_2SO_4$) | 12 L, 13 L/min | 0.97 V (t = 0) 0.3 A (CC) 1.16 mA/cm$^2$ | 6 min | >100% electroless reduction processes |
| 23 (Cu) | Copper-coated #7 steel shot re-used | Cu: 213.5/61.0 Cu/$Cu_2O$ recovered (0.01N $H_2SO_4$) | 12 L, 13 L/min | 0.97 V (t = 0) 0.3 A (CC) 1.16 mA/cm$^2$ | 10 min | >100% electroless reduction processes |

TABLE 3-continued

| Magnetically Spouted Electrolytic Cell Electrowinning Tests | | | | | | |
|---|---|---|---|---|---|---|
| Exp. | Cathode | Metal Solution Conc. (mg/L) initial/final | Feed Volume, Flow Rate | Cell Potential, Current, Current Density | Run Time | Average Faradaic Efficiency |
| 24 (Cu) | Copper-coated #7 steel shot re-used | Cu: 241.2/<0.05 $Cu/Cu_2O$ recovered (0.01N $H_2SO_4$) | 12 L, 13 L/min | 0.83 V (CV) 0.1 A (t = 0) 0.4 mA/cm$^2$ | 24 min | >100% electroless reduction processes |
| 25 (Cu) | Copper-coated #7 steel shot re-used | Cu: 214.6/185.4 $Cu/Cu_2O$ recovered (0.01N $H_2SO_4$) | 12 L, 8.5 L/min single pass | 1.3 V (t = 0) 0.3 A (CC) 1.16 mA/cm$^2$ | flow-through (1.5 min) | >100% electroless reduction processes |
| 26 (Ni/Fe) | Copper-coated #7 steel shot re-used | Ni: 152.2/~95 (interferences in analyses) Fe: 200-500 est., $Fe_3O_4$ recovered (0.01N $H_2SO_4$) | 12 L, 13 L/min | 2.0 V (CV) 0.5 A (t = 0) 1.9 mA/cm$^2$ | 16 min | >100% electroless reduction processes promoted |
| 27 (Ni/Fe) | Copper-coated #7 steel shot re-used | Ni: 206.8/~190 (interferences in analyses) Fe: 200-500 est., $Fe_3O_4$ recovered (0.01N $H_2SO_4$) | 12 L, 13 L/min | 3.0 V (CV) 0.4 A (t = 0) 1.55 mA/cm$^2$ | 24 min | >100% electroless reduction processes promoted |
| 28 (Ni/Fe) | Copper-coated #7 steel shot re-used | Ni: 167.8/117.8 Fe: 200-500 est., $Fe_3O_4$ recovered (0.01N $H_2SO_4$) | 12 L, 13 L/min | 2.0 V (CV) 0.6 A (t = 0) 2.3 mA/cm$^2$ | 60 min | >100% electroless reduction processes |
| 29 (Ni/Fe) | Copper-coated #7 steel shot re-used | Ni: 202.8/183.5 Fe: 200-500 est., $Fe_3O_4$ recovered (0.01N $H_2SO_4$) | 12 L, 4.5 L/min | 2.0 V (CV) 0.6 A (t = 0) 2.3 mA/cm$^2$ | 60 min | >100% electroless reduction processes |
| 30 (Ni/Fe) | Copper-coated #7 steel shot re-used | Ni: 192.8/181.6 Fe: 200-500 est., $Fe_3O_4$ recovered (0.01N $H_2SO_4$) | 12 L, 13 L/min | 2.75 V (t = 0) 0.6 A (CC) 2.3 mA/cm$^2$ | 25 min | >100% electroless reduction processes |
| 31 (Zn) | Zinc-coated #7 steel shot fresh | Zn: 294/463 (0.01N $H_2SO_4$) | 12 L, 13 L/min | 3.0 V (CV) 0.35 A (t = 0) 1.36 mA/cm$^2$ | 40 min | <0%, cathode corrosion |
| 32 (Zn) | Zinc-coated #7 steel shot re-used | Zn: 448/448 re-used (0.01N $H_2SO_4$) | 12 L, 13 L/min | 12.0 V (CV) 3.1 A (t = 0) 12.0 mA/cm$^2$ | 15 min | 0% |
| 33 (Zn) | Zinc-coated #7 steel shot fresh | Zn: 326 at 10 min/ 268 (0.01N $H_2SO_4$) | 12 L, 13 L/min | 27.0 V (t = 0) 15.0 A (CC) 58.1 mA/cm$^2$ | 30 min | 11.4% |
| 34 (Zn) | Zinc-coated #7 steel shot fresh | Zn: 236 at 3 min/ 219 (0.01N $H_2SO_4$) | 12 L 7 L/min | 20.0 V (t = 0) 18.0 A (CC) 69.8 mA/cm$^2$ | 21 min | 3.1% |
| 35 (As) | Zinc-coated #7 steel shot re-used | As: 10/0.150 (0.01N $H_2SO_4$) | 7 L 13 L/min | 9.0 V (t = 0) 5.0 A (CC) 19.4 mA/cm$^2$ | 30 min | ND |

TABLE 4

| Metal Removal Optimization | | | |
|---|---|---|---|
| Target Metal Ion | Reduction Potential, $E^0$ vs SHE | Feed Flow Range | Current Density (Cell Voltage) |
| $Cu^{2+}$ | 0.342 V | 14-40 Lpm (3.7-10.6 gpm) | 50-120 mA/cm$^2$ (0.83-2.0 V) |
| $Fe^{3+}$ | −0.037 V | 8-40 Lpm (2.1-10.6 gpm) | 50-120 mA/cm$^2$ (0.83-2.0 V) |
| $Pb^{2+}$ | −0.126 V | 8-40 Lpm (2.1-10.6 gpm) | 50-120 mA/cm$^2$ (0.83-2.0 V) |

TABLE 4-continued

| Metal Removal Optimization | | | |
|---|---|---|---|
| Target Metal Ion | Reduction Potential, $E^0$ vs SHE | Feed Flow Range | Current Density (Cell Voltage) |
| $Ni^{2+}$ | −0.257 V | 4-14 Lpm (1-3.7 gpm) | 60-120 mA/cm$^2$ (1.0-2.0 V) |
| $Zn^{2+}$ | −0.762 V | 4-14 Lpm (1-3.7 gpm) | 60-120 mA/cm$^2$ (1.0-2.0 V) |
| $Mn^{2+}$ | −1.185 V | 2-14 Lpm (0.53-3.7 gpm) | 60-120 mA/cm$^2$ (1.0-2.0 V) |

TABLE 5

| Berkeley Mine Pit Contaminants | |
|---|---|
| Contaminant | Quantity |
| pH | 2.8 |
| Primary Anion | |
| $SO_4^{2-}$ | 7600 ppm |
| Primary Toxic Cations | |
| Al | 260 ppm |
| Mn | 185 ppm |
| Fe | 1058 ppm |
| Cu | 172 ppm |
| Zn | 550 ppm |

TABLE 6

| Typical AMD and DOE Site Metal Contamination | |
|---|---|
| Metal | Concentration Range, ppm |
| Common to AMD | |
| Al | 10's-100's |
| Mn | 10's-1000's |
| Fe | 100's-1000's |
| Cu | 10's-1000's |
| Zn | 10's-1000's |
| As | <1-~9 |
| Pb | 10's-~6000 |
| Common to DOE Facilities | |
| Cr* | <1-~9 |
| Cu | <1-~3 |
| Zn* | <1-~700 |
| As* | <1-~32 |
| 0Cd | No Data |
| Hg | <1-~220 |
| Pb* | <1-~120 |

*Most frequent contaminants

What is claimed is:

1. A spouted bed reactor comprising:

a particle bed;

an inlet for a flowing fluid stream;

a particle bed churning device configured for spouting particle bed particles in said reactor independently of the flow of said fluid stream, the churning device having an inlet and an outlet; and a check valve configured for preventing spouting particle bed particles from re-entering the particle bed churning device outlet.

2. The reactor of claim 1, further comprising a particle inlet distinct from said flowing fluid stream inlet.

3. The reactor of claim 1, further comprising a fluid stream outlet distinct from a particle outlet.

4. The reactor of claim 1 configured for flowing said fluid stream co-currently, counter-currently, or cross-flow relative to said spouting.

5. The reactor of claim 1 configured for electrowinning a heavy metal from said fluid stream, wherein said particle bed comprises electrically conductive cathode particles and said fluid stream comprises an electrically conductive solution comprising said heavy metal.

6. The reactor of claim 5, comprising:

at least one electrolytic cell, each cell comprising:

an anolyte chamber comprising an anode and configured for containing an anolyte, a catholyte chamber comprising a current collector and configured for containing a particulate cathode bed and a flowing stream of said fluid, and an ion-permeable membrane separating said anolyte chamber and said catholyte chamber.

7. The reactor of claim 6, wherein said catholyte chamber comprises said particle bed churning device or a portion thereof

8. The reactor of claim 5, wherein said catholyte chamber further comprises at least one catholyte inlet configured for receiving said fluid stream and at least one catholyte outlet configured for releasing a discharge stream; and said anolyte chamber further comprises at least one anolyte inlet configured for receiving an anolyte stream and at least one anolyte outlet configured for removing said anolyte stream.

9. The reactor of claim 5, wherein said catholyte chamber comprises a cathode particle transport channel configured for receiving said spouting device or a portion thereof, said channel comprising a cathode particle inlet and a cathode particle outlet.

10. The reactor of claim 9, wherein said catholyte inlet is distinct from the cathode particle inlet of said channel.

11. The reactor of claim 5 wherein said particle bed churning device comprises a magnetic conveyor assembly, an array of electromagnets, a conveyor belt or auger screw.

12. The reactor of claim 11, wherein said cathode particles are magnetic and said device comprises a magnetic conveyor assembly comprising a plurality of magnets attached to a conveyor belt or comprises an array of electromagnets.

13. The reactor of claim 12, wherein said catholyte chamber comprises a window configured to receive said magnets or electromagnets.

14. The reactor of claim 13, wherein said current collector comprises a planar surface covering said window, and said planar surface is configured for contacting said magnets or electromagnets through said window.

15. The reactor of claim 9 comprising a particle diverter device disposed at said channel outlet configured for diverting released cathode particles away from said channel outlet.

16. The reactor of claim 15 wherein said particle diverter device comprises a laterally displaced magnetic force.

17. An electrowinning system comprising:

at least one spouted bed reactor wherein each said reactor comprises:

an anolyte chamber comprising an anode and configured for containing an anolyte, a catholyte chamber comprising a current collector and configured for containing a particulate cathode bed and a flowing stream of an electrically conductive metal-containing fluid, and a membrane separating said anolyte chamber and said catholyte chamber, an inlet for an electrically conductive heavy metal-containing fluid stream; and a particle bed churning device configured for spouting particle bed particles in said reactor independently of the flow of said fluid stream, wherein the particle bed churning device has an inlet, an outlet, and a check valve disposed at the outlet.

18. The system of claim 17 wherein said at least one spouted bed reactor comprises at least two catholyte chambers in parallel flow arrangement with respect to the flow of said fluid stream.

19. The system of claim 17 wherein said at least one spouted bed reactor comprises at least two catholyte chambers in series flow arrangement with respect to the flow of said fluid stream.

20. The system of claim 17 wherein said at least one spouted bed reactor comprises at least two catholyte chambers in series flow arrangement with respect to spouted cathode particles.

21. The system of claim 17 wherein said at least one spouted bed reactor comprises at least two said catholyte chambers configured for operation in series with respect to electric power.

22. The system of claim 17 wherein said at least one spouted bed reactor comprises at least two said catholyte chambers configured for operation in parallel with respect to electric power.

23. The system of claim 17 wherein said at least one spouted bed reactor comprises at least two anolyte chambers in series flow arrangement with respect to the flow of anolyte.

24. The system of claim 17 wherein said at least one spouted bed reactor comprises at least two said anolyte chambers configured for operation in series with respect to electric power.

25. The system of claim 17 wherein said at least one spouted bed reactor comprises at least two anolyte chambers configured for operation in parallel with respect to electric power.

26. The system of claim 17 wherein said at least one reactor is configured for continuous addition and removal of cathode particles from at least one said catholyte chamber.

27. The system of claim 17 wherein each said particle bed churning device comprises a magnetic conveyor assembly, an array of electromagnets, a conveyor belt or auger screw.

28. The system of claim 17 wherein each said particle bed churning device is configured for spouting said particles vertically or in a plane that is inclined at an angle between 45 degrees to +45 degrees relative to the vertical axis of said catholyte chamber.

29. The system of claim 17 wherein said system comprises at least one anolyte inlet and at least one anolyte outlet and is configured for mutual electrical isolation of anolyte and catholyte solutions.

30. An electrowinning process comprising:

(a) providing an electrowinning system according to claim 17;

(b) flowing an electrically conductive anolyte solution through said anolyte chamber;

(c) flowing a catholyte solution through a cathode particle bed in said catholyte chamber, wherein said catholyte solution comprises an electrically conductive fluid containing at least one heavy metal salt dissolved therein;

(d) establishing a predetermined voltage and current across said electrolytic cell sufficient to effect reduction of a selected heavy metal at said particle bed and cause an oxidation reaction at said anode; and (e) spouting said cathode particles, said spouting being independent of the flow of the catholyte solution of step (c).

31. The process of claim 30 wherein spouting said cathode particles comprises transporting said particles vertically or in a plane that is inclined at an angle between −45 degrees to +45 degrees relative to the vertical axis of said catholyte chamber.

32. The process of claim 30 wherein, in step (e), spouting said cathode particles comprises transporting a multiplicity of said cathode particles through a channel from a first point in said catholyte chamber to a second point in said catholyte chamber.

33. The process of claim 32, further comprising:

(f) deterring re-entry into said channel of the released multiplicity of particles at said second point in said catholyte chamber.

34. The process of claim 33 wherein deterring re-entry into said channel of said particles comprises applying a laterally displaced magnetic force at said second point in said catholyte chamber.

35. The process of claim 33 wherein deterring re-entry into said channel of said particles comprises operating a check valve at said second point in said catholyte chamber.

36. The process of claim 32, wherein step (e) comprises:

($e_1$) applying a magnetic force to a multiplicity of cathode particles in said bed sufficient to attract said multiplicity of particles; and ($e_2$) moving said magnetic force along said channel to carry a multiplicity of magnetically attracted particles from a first point in said catholyte chamber to a second point in said catholyte chamber.

37. The process of claim 36, wherein step (e) further comprises:

($e_3$) ceasing application of said magnetic force at said second point to release said multiplicity of magnetically attracted particles at said second point in said catholyte chamber.

38. The process of claim 37, wherein said multiplicity of cathode particles comprises a first portion of said cathode particle bed, and said magnetic force comprises a first magnetic force, and step (e) further comprises:

($e_4$) applying at least one subsequent magnetic force, respectively, to at least one subsequent portion of said particle bed, sufficient to attract each said subsequent portion; and ($e_5$) moving each subsequent magnetic force sufficiently to carry, respectively, each subsequent attracted portion through said cathode particle transport channel from said first point in said catholyte chamber to said second point in said catholyte chamber.

39. The process of claim 30 wherein, in step (e) spouting said cathode particles comprises transporting said particles from a first point in said catholyte chamber to a second point in said catholyte chamber using a conveyor belt assembly disposed, at least in part, inside said catholyte chamber.

40. The process of claim 30 wherein, in step (e), spouting said cathode particles comprises transporting said particles from a first point in said catholyte chamber to a second point in said catholyte chamber using an auger screw assembly disposed, at least in part, inside said catholyte chamber.

41. The process of claim 30 comprising maintaining electrical isolation of said anolyte solution from said catholyte solution during operation of said process.

42. The process of claim 41 wherein said anolyte solution is contained in a circulation loop that is electrically separate from said catholyte solution.

43. The process of claim 30, wherein said heavy metal is selected from the group consisting of chromium, manganese, iron, cobalt, nickel, copper zinc, gallium, germanium, arsenic, molybdenum, ruthenium, rhodium, palladium, silver, cadmium, indium, tin, antimony, tungsten, rhenium, osmium, iridium, platinum, gold, mercury, thallium, lead, and bismuth.

44. The process of claim 30, wherein said electrically conductive fluid stream has a pH between −1 and 14.

45. The process of claim 44, wherein said electrically conductive fluid stream has a pH between −1 and 6.

46. The process of claim 30, wherein the anolyte solution comprises an electrically conductive sulfate or phosphate compound, or a combination thereof, dissolved in said anolyte solution.

47. The process of claim 30, wherein the catholyte comprises an electrically conductive sulfate, chloride, bromide, phosphate, nitrate, perchlorate, acetate, citrate, cyanide, thiocyanate or hydroxide compound, or any combination of any of those, dissolved therein.

48. The process of claim 30, wherein the catholyte feed stream comprises less than 2000 mg/L of said heavy metal.

49. The process of claim 30, wherein the catholyte comprises a dissolved gas containing air, nitrogen, oxygen, argon or hydrogen, or any combination of any of those.

50. The process of claim 30 comprising continuous flow treatment of said metal-containing fluid stream to electrowin at least one said heavy metal.

51. The process of claim 30, wherein said metal-containing fluid stream comprises dissolved iron salts, and step (d) comprises establishing reducing cathode potentials, the process further comprising:

(g) producing at least one iron oxide from said dissolved iron salts under said reducing cathode potentials.

52. The process of claim 51 wherein said at least one iron oxide is selected from the group consisting of magnetite, iron ferrihydrite and hematite.

53. The process of claim 30, wherein said metal-containing fluid stream comprises dissolved copper salts, and step (d) comprises establishing reducing cathode potentials, the process further comprising:

(g') producing at least one copper oxide from said dissolved copper salts under said reducing cathode potentials.

54. The process of claim 53 wherein said at least one copper oxide is selected from the group consisting of cuprous oxide and cupric oxide.

55. The process of claim 30, further comprising:

(h) recovering at least one said selected heavy metal or an oxide thereof from cathode particles containing deposited heavy metal.

56. The process of claim 55, wherein step (h) comprises exposing said cathode particles containing deposited heavy metal to oxidizing potentials whereby said heavy metal oxide product is recovered.

57. The process of claim 56, wherein said heavy metal oxide is selected from the group consisting of magnetite, iron ferrihydrite, hematite, cuprous oxide, cupric oxide, and combinations thereof.

58. The process of claim 56 wherein step (h) comprises recovering said heavy metal oxide as solid particles with a mean diameter of less than 100 microns.

59. The process of claim 58, wherein said heavy metal oxide solid particles have a mean diameter of less than 100 nanometers.

* * * * *